US011781823B2

(12) United States Patent
Gromes, Sr. et al.

(10) Patent No.: US 11,781,823 B2
(45) Date of Patent: Oct. 10, 2023

(54) METHOD OF USING A LANCE CLEANING SYSTEM WITH MOVABLE SUPPORT

(71) Applicant: TERYDON, INC., Navarre, OH (US)

(72) Inventors: Terry D. Gromes, Sr., Navarre, OH (US); Kristen E. Griffin, Navarre, OH (US)

(73) Assignee: TERYDON, INC., Navarre, OH (US)

( * ) Notice: Subject to any disclaimer, the term of this patent is extended or adjusted under 35 U.S.C. 154(b) by 71 days.

(21) Appl. No.: 17/715,119

(22) Filed: Apr. 7, 2022

(65) Prior Publication Data

US 2022/0228821 A1 Jul. 21, 2022

Related U.S. Application Data

(62) Division of application No. 16/737,150, filed on Jan. 8, 2020, now Pat. No. 11,674,761.

(51) Int. Cl.

| | |
|---|---|
| ***F28G 9/00*** | (2006.01) |
| ***F28G 15/08*** | (2006.01) |
| ***F28G 15/02*** | (2006.01) |

(52) U.S. Cl.

CPC ..... *F28G 9/00* (2013.01); *F28G 15/02* (2013.01); *F28G 15/08* (2013.01)

(58) Field of Classification Search

None

See application file for complete search history.

(56) References Cited

U.S. PATENT DOCUMENTS

| | | | |
|---|---|---|---|
| 3,157,903 | A | 11/1964 | Matthews |
| 3,174,179 | A | 3/1965 | Benson |
| 3,389,713 | A | 6/1968 | Pittman |
| 3,581,341 | A | 6/1971 | Perry |
| 3,901,252 | A | 8/1975 | Riebe |
| 3,938,535 | A | 2/1976 | Cradeur et al. |
| 4,079,892 | A | 3/1978 | Hodgson |
| 4,095,305 | A | 6/1978 | Goodwin |
| 4,219,976 | A | 9/1980 | Burack et al. |
| 4,893,566 | A | 1/1990 | Fukuda |
| 5,018,544 | A | 5/1991 | Boisture et al. |
| 5,031,691 | A | 7/1991 | Boisture |
| 5,549,079 | A | 8/1996 | Johnston, Jr. et al. |
| 5,695,098 | A | 12/1997 | King |
| 5,735,964 | A | 4/1998 | Amnuny |
| 5,866,085 | A | 2/1999 | Yelvington |
| 5,913,769 | A | 6/1999 | Byma et al. |

(Continued)

FOREIGN PATENT DOCUMENTS

| | | |
|---|---|---|
| DE | 102004021500 | 11/2005 |
| DE | 202008017321 | 5/2009 |

(Continued)

*Primary Examiner* — Natasha N Campbell
*Assistant Examiner* — Pradhuman Parihar
(74) *Attorney, Agent, or Firm* — SAND, SEBOLT & WERNOW CO., LPA

(57) ABSTRACT

The present disclosure relates generally to water jet equipment. Specifically, water jet equipment that includes a support frame comprised of a plurality of stackable trollies that support a plurality of lances as those lances are inserted into and withdrawn from heat exchanger tubes during a cleaning operation of the same. A method of cleaning elongated tubes by positioning and rotating the lances while moving in a first direction is further provided.

17 Claims, 40 Drawing Sheets

(56) References Cited

U.S. PATENT DOCUMENTS

| | | | | |
|---|---|---|---|---|
| 7,066,291 | B2 | 6/2006 | Martins et al. | |
| 7,118,366 | B2 | 10/2006 | Grimm et al. | |
| 7,520,662 | B2 | 4/2009 | Farrell | |
| 8,628,629 | B2 | 1/2014 | Gromes, Sr. | |
| 9,372,037 | B2 | 6/2016 | Gromes, Sr. | |
| 2004/0006841 | A1 | 1/2004 | Jameel et al. | |
| 2010/0126540 | A1 | 5/2010 | Geppert et al. | |
| 2010/0318241 | A1 | 12/2010 | Post, II et al. | |
| 2012/0103368 | A1* | 5/2012 | Gromes, Sr. ..... | F28G 1/163 134/22.12 |

FOREIGN PATENT DOCUMENTS

| | | |
|---|---|---|
| EP | 531871 | 3/1993 |
| FR | 2302331 | 9/1976 |
| FR | 2646274 | 10/1990 |
| JP | 2009269298 | 11/2009 |

* cited by examiner

METHOD OF USING A LANCE CLEANING SYSTEM WITH MOVABLE SUPPORT

CROSS-REFERENCE TO RELATED APPLICATIONS

The present application is a Divisional of U.S. patent application Ser. No. 16/737,150, filed Jan. 8, 2020, the entire disclosure of which is incorporated herein by reference.

TECHNICAL FIELD

The present disclosure relates generally to water jet equipment. More particularly, the present disclosure is directed to water jet equipment that is used for cleaning objects. Specifically, the present disclosure is water jet equipment that includes a support frame comprised of a plurality of stackable trollies that support a plurality of lances as those lances are inserted into and withdrawn from heat exchanger tubes during a cleaning operation of the same.

BACKGROUND

Background Information

Heat exchangers are used for the transfer of heat from a solid object to a fluid or from one fluid to another fluid. A heat exchanger will generally include a plurality of elongate conduits or tubes that carry steam or water in the bores thereof. If two fluids are involved, one of the fluids passes through the bores of the conduits or tubes and the other of the fluids passes around an outside of the tubes. The tubes terminate in an end plate which defines a plurality of openings therein. Each opening aligns with a bore of one of the tubes in the heat exchanger. Over time, deposits from the fluid traveling through the tube bores tends to accumulate on the interior surface of the tubes and affect the efficiency of the heat exchange process. The deposits may accumulate to the point that one or more tubes in the heat exchanger become blocked.

It is therefore customary to scour the deposits from the interior surfaces of the tubes from time to time. This cleaning is typically accomplished using a high pressure water jet to blast away the deposited solid materials. In particular, a lance or washer arm is connected to a high pressure water supply and a nozzle at the free end of the lance is systematically introduced into the bore of each tube through an associated opening in the heat exchanger's end plate. The high pressure water jet is sprayed out of the nozzle and into the bore to blast away the deposits. The water pressure in a lance may easily exceed 10,000 psi with flow rates in excess of 100 gallons per minute.

There are a number of problems inherent in using this type of water jet equipment to clean heat exchanger tubes. For example, it is very difficult to keep the lance from buckling and bending while it is being guided into and out of the tube bores. A more serious problem, however, is jet reaction from the high pressure stream. Since the fluid is forced through the lance at extremely high pressures (in excess of 10,000 psi) the fluid discharge from the lance tip can blow backward when it strikes a blockage in a tube bore or if the operator accidentally directs the fluid toward a solid region of the end plate instead of into a bore of a tube. The blowback can strike the operator guiding the lance and can injure him or her.

In order to reduce the possibility of the lance buckling as it is introduced into or removed from a tube bore, the PRIOR ART has proposed an apparatus for supporting a rear portion of the lance in an elongated channel member which has an open top. In other words, the PRIOR ART has proposed supporting the rear portion of the lance in a U-shaped channel support. The nozzle end (i.e., operating end) of the lance is fed from the U-shaped channel member and into the tube bore through a vertically-oriented separator plate positioned at the front end of the channel member. A drive mechanism, comprising a set of motor-driven friction rollers, engages the lance immediately rearward of the separator plate, i.e., in a position rearward of the separate plate relative to the nozzle. The drive mechanism moves the lance forwardly toward the tube bore and along the U-shaped channel member. A major portion of the lance is supported in the open channel member behind the drive rollers and the motor. One of the major issues with this PRIOR ART apparatus is that, in many instances, the lance that is being used is quite long and even though the rear portion of the lance is supported, the lance tends to flex and buckle and is generally difficult to accurately position into the tube bore. This may put the operator at risk if the high pressure water jet contacts the end plate and deflects backward toward the operator of the water jet equipment.

SUMMARY

There is therefore a need in the art for improved heat exchanger cleaning technology. The apparatus and method discussed herein addresses the shortcomings of the prior art.

In one aspect, the present disclosure may provide an assembly for cleaning elongated tubes comprising: a rail, a rotation mechanism operatively engaged with the rail, at least one lance extending outwardly from the rotation mechanism and over the rail, a translation mechanism coupled with the rotation mechanism and being operable to move the rotation mechanism and the at least one lance in unison in one of a first direction and a second direction relative to the rail, and at least one trolley operatively engaged with the rail and supporting a portion of the at least one lance; said at least one trolley being movable along the rail in the one of the first direction and the second direction in response to operation of the translation mechanism. This exemplary embodiment or another may provide the at least one trolley defines at least one opening therein and the at least one lance extends through the at least one opening. This exemplary embodiment or another may provide the at least one trolley includes one or more wheels that engage the rail. This exemplary embodiment or another may provide at least one rail stop fixedly engaged on the rail; wherein the at least one rail stop arrests movement of the at least one trolley in the second direction. This exemplary embodiment or another may provide at least one locking mechanism that selectively secures the at least one trolley to the at least one rail stop. This exemplary embodiment or another may provide the locking mechanism comprises a first magnetic component provided on the at least one trolley and a second magnet component provided on the at least one rail stop, and wherein the first and second magnetic component are selectively magnetically attracted to each other. This exemplary embodiment or another may provide the at least one trolley comprises a plurality of trollies and the at least one rail stop comprises a plurality of rail stops, wherein each rail stop is dedicated to arrest the movement of on one of the plurality of trollies. This exemplary embodiment or another may provide a pusher operatively engaged with the translation mechanism, said pusher engaging the at least one trolley to impart motion in the first direction thereto. This exemplary embodiment or another may provide the at least one trolley comprises a plurality of trollies and the assembly further comprises: a stacker operatively engaged with one of the translation mechanism and the rotation mechanism, and a channel defined in each of the plurality of trollies, wherein the stacker is selectively receivable through the channel of one or more of the plurality of trollies when the translation mechanism moves the rotation mechanism in the first direction. This exemplary embodiment or another may provide a puck provided on the stacker, said puck being selectively movable from an un-deformed state to a deformed state to move through the channel of the one or more of the plurality of trollies. This exemplary embodiment or another may provide a pusher operatively engaged with the translation mechanism, said pusher engaging the at least one trolley to impart motion in the first direction thereto. This exemplary embodiment or another may provide at least one lance comprises a plurality of lances, and wherein the rotation mechanism is configured to rotate each of the plurality of lances an axis extending along a length of the respective lance.

In another aspect, the present disclosure may provide a method of cleaning elongated tubes comprising: positioning a terminal end of at least one lance adjacent an opening to an elongated tube bore, rotating the at least one lance about an axis utilizing a rotation mechanism movably mounted on a support rail, supporting the at least one lance with one or more trolleys engaged on the support rail forwardly of the rotation mechanism, activating a translation mechanism, moving linearly, with the translation mechanism, the rotation mechanism and the at least one lance in a first direction along the support rail, advancing the at least one lance in the first direction toward the opening and into the tube bore, moving the one or more trolleys along the rail as the translation mechanism moves the least one lance and the rotation mechanism in the first direction. This exemplary embodiment or another may provide connecting the at least one lance to a source of high pressure fluid, and spraying a volume of high pressure fluid out of the terminal end of the at least one lance and into the tube bore. This exemplary embodiment or another may provide the moving of the one or more trolleys along the support rail in the first direction is preceded by: disengaging a locking mechanism that secures at least one of the one or more trolleys to a rail stop engaged on the support rail. This exemplary embodiment or another may provide the moving of the one or more trolleys in the first direction includes: contacting at least one of the one or more trolleys with a pusher extending forwardly from the translation mechanism, and imparting motion to the at least one of the one or more trolleys with the pusher. This exemplary embodiment or another may provide stacking the one or more trolleys on a stacker when the one or more trolleys are moved in the first direction. This exemplary embodiment or another may provide moving the translation mechanism in a second direction along the support rail, and moving the rotation mechanism and the at least one lance in the second direction with the translation mechanism. This exemplary embodiment or another may provide withdrawing, progressively, the stacker from the one or more trolleys, contacting, with a puck provided on the stacker, a front surface of a forwardmost one of the one or more trolleys, and imparting motion in the second direction to the one more trolleys with the puck. This exemplary embodiment or another may provide engaging, progressively, each of the one or more the trolleys with an associated one of a plurality of dedicated rail stops provided on the rail, and arresting, progressively, motion of the one of the one or more trolleys in the second direction.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

A new lance cleaning system 10 and method of operation thereof is depicted in FIGS. 1-23 and discussed in the present disclosure. System 10 is a new and improved apparatus for performing cleaning operations, as will be discussed hereafter, but system 10 may also be used in other applications.

Figure 1:
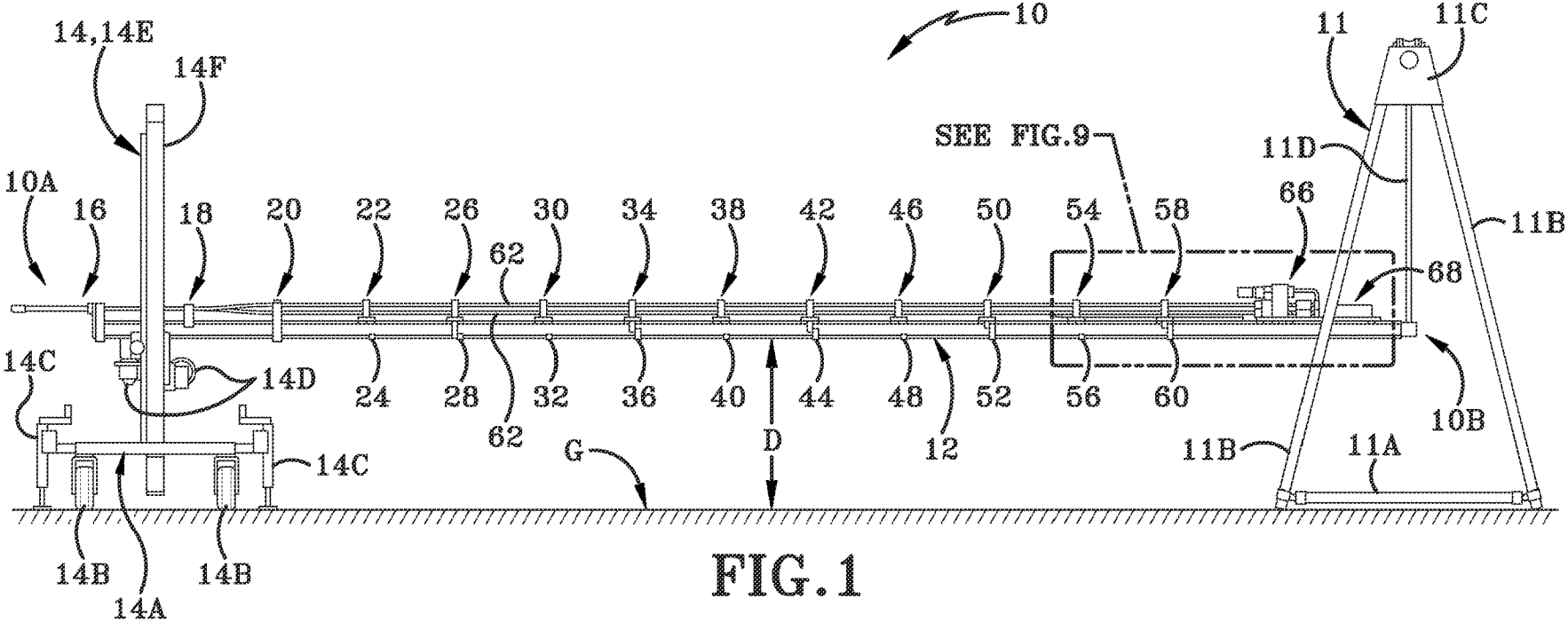
FIG. 1 is a left side elevation view of an exemplary lance cleaning system with movable support in accordance with the present disclosure.
Figure 2:
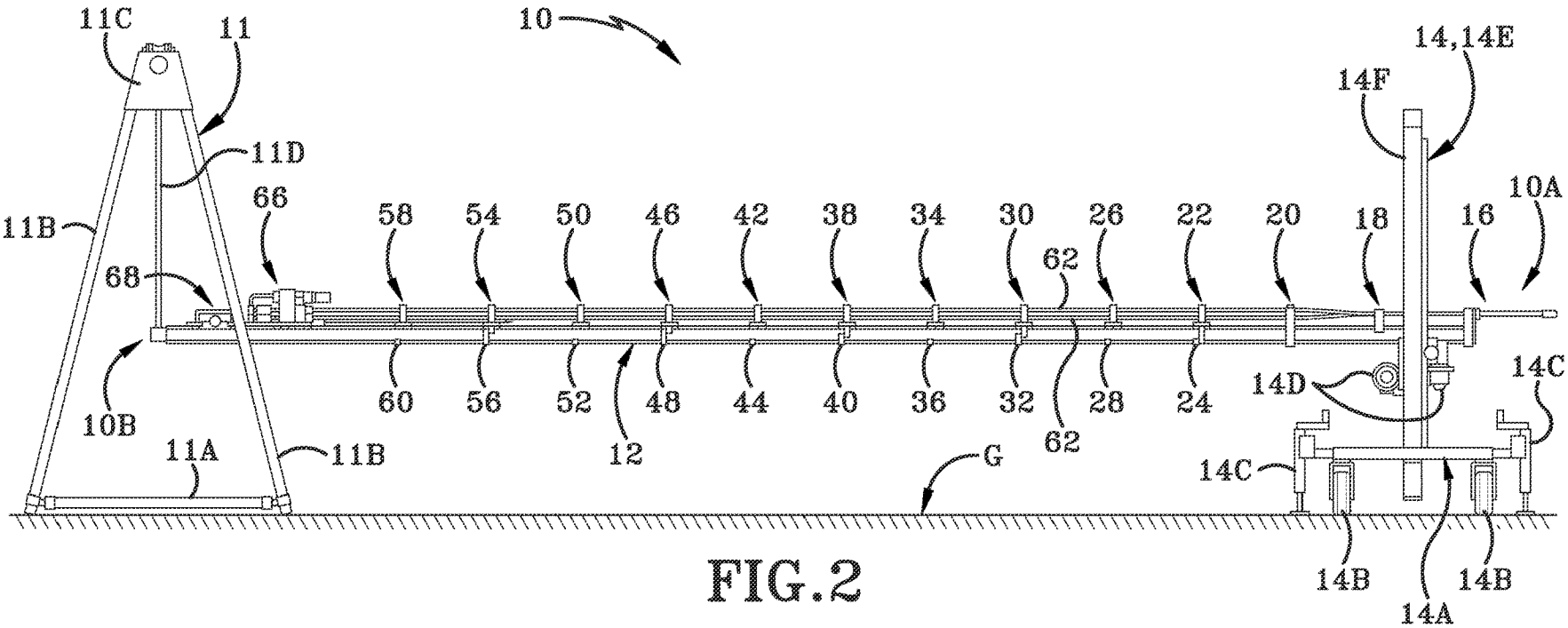
FIG. 2 is a right side elevation view of the exemplary lance cleaning system of FIG. 1.

Referring now to FIG. 1 and FIG. 2, an exemplary lance cleaning system 10 that includes movable supports is shown ready for operation and in an expanded position. Lance cleaning system 10 may interchangeably be referred to herein by the terms "lance cleaning system 10" and "system" 10. System 10 has a front end 10A and a rear end 10B transversely opposed to the front end 10A. A longitudinal axis "Y" (FIG. 10) of system 10 extends between front end 10A and rear end 10B.

Figure 4:
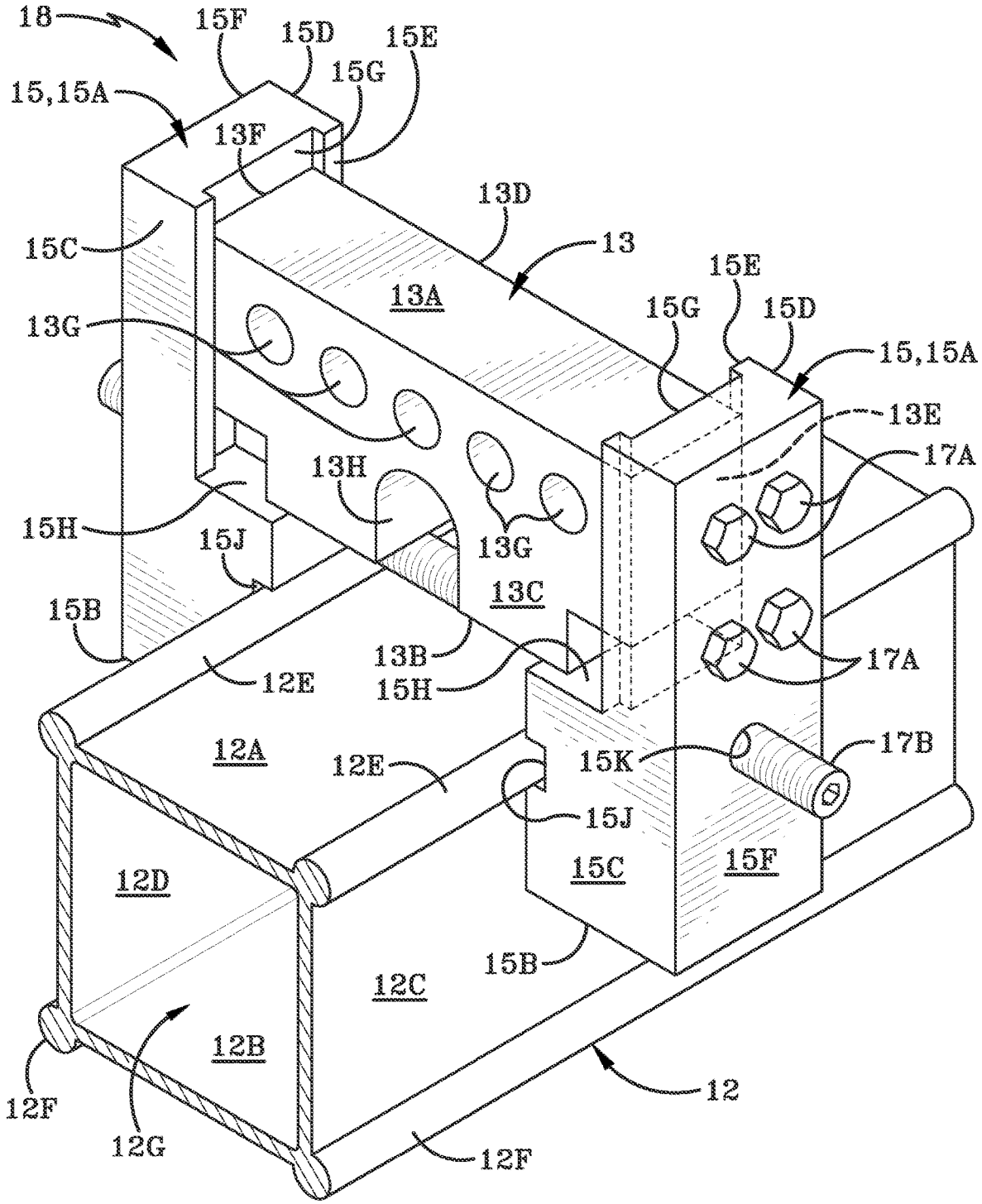
FIG. 4 is a front left side perspective view of a transition guide of the lance cleaning system shown engaged with a section of the rail.

System 10 includes a support rail 12 that has a first end and a second end. Support rail 12 extends longitudinally from proximate front end 10A of system 10 to proximate rear end 10B of system 10. FIGS. 1, 2 and 4 show that rail 12 comprises an elongate body having a top side 12A, a bottom side 12B, a left side 12C, and a right side 12D. Rounded upper edges 12E project outwardly from the corners where top side 12A intersects left side 12C and right side 12D, respectively. Rounded lower edges 12F project outwardly from the corners where bottom side 12B intersects left side 12C and right side 12D, respectively. Edges 12E, 12F extend for substantially the entire length of rail 12 from proximate first end to proximate second end thereof. Rail 12 is hollow and defines a bore 12G (FIG. 4) therethrough that extends from proximate first end to proximate second end. The provision of bore 12G helps to reduce the overall weight of rail 12.

Figure 10:
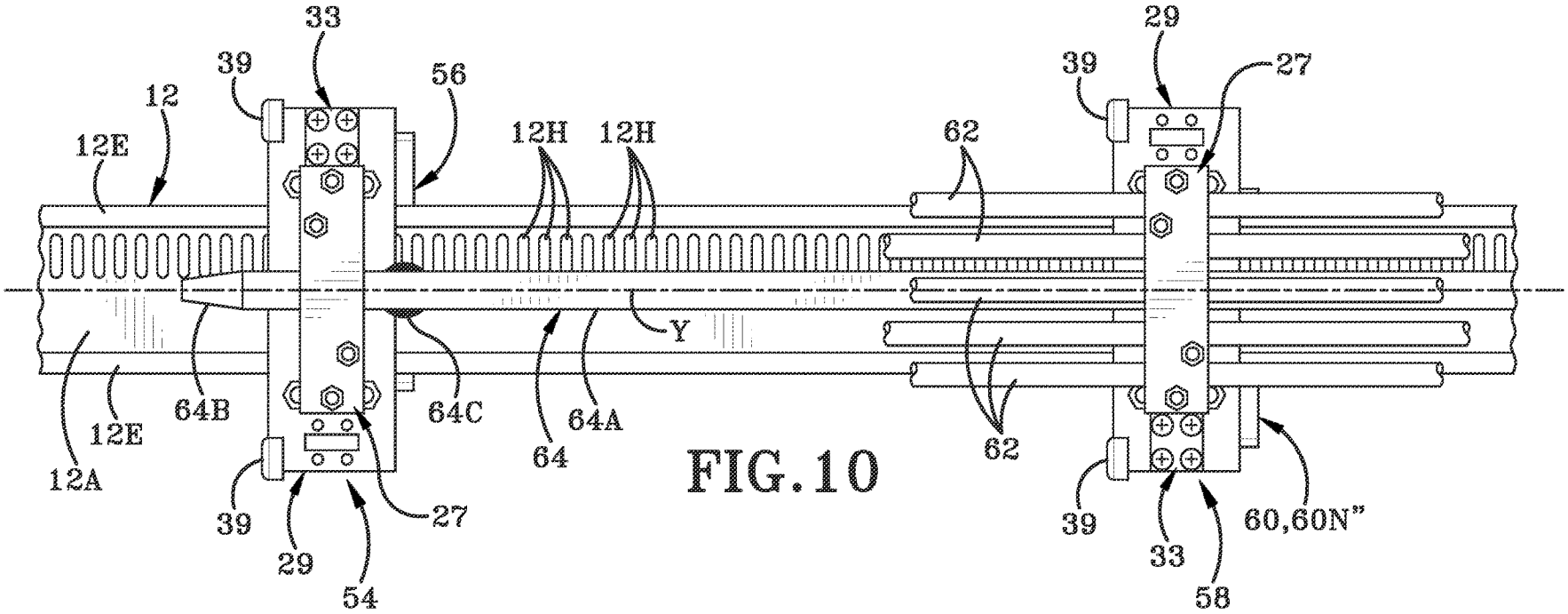
FIG. 10 is a top plan view of the exemplary trolley assemblies taken along line 10-10 of FIG. 9A.

As best seen in FIG. 10, rail 12 also includes a track 12H that extends for at least a portion of top side 12A from proximate the second end of rail 12 (i.e., proximate rear end 10B) and towards the first end of rail 12 (i.e., towards front end 10A). Track 12H, as illustrated herein, comprises a plurality of spaced apart apertures 12H' that are in fluid communication with bore 12G. The purpose of track 12H will be discussed later herein. It should be understood that not all figures provided herewith shows track 12H for clarity of illustration. Track 12H does, however, extend along substantially the entire length of rail 12.

Rail 12 is supported a distance vertically above the ground "G" by a support frame 11 and an indexer 14. As illustrated in FIGS. 1 and 2, indexer 14 extends upwardly from a base 14A. A plurality of wheels or casters 14B extend downwardly from base 14A and contact ground "B". Casters 14B may be utilized to move indexer 14 and thereby system 10 across the ground "B". One or more locking mechanisms 14C are engaged with base 14A and are selectively extendable to contact ground "G" to secure system 10 in a particular position. Indexer 14 may further include various operating components 14D for controlling indexer 14. Support frame 11 may include a base 11A and a plurality of frame members 11B that extend upwardly from the base 11A and which may meet at an apex 11C. Base 11A and/or frame members 11B contact ground "G". A suspension rod 11D is shown in FIGS. 1 and 2 as extending downwardly from apex 11C and attaching to the second end of rail 12. As indicated earlier herein, support frame 11 and indexer 14 together hold system 10 a distance "D" above the ground "G". The distance "D" may be varied as needed for the operation of system 10. It will be understood that any suitable support frame 11 and indexer 14 may be used in conjunction with system 10.

System 10, shown in FIGS. 1 and 2 includes a plurality of components that are supported by or carried on rail 12. These components include an end guide 16 (FIG. 3), a transition guide 18 (FIG. 4), a lance guide 20 (FIG. 5), a first trolley 22 (FIG. 1), a first rail stop 24 (FIG. 2), a second trolley 26, a second rail stop 28 (FIG. 1), a third trolley 30, a third rail stop 32 (FIG. 2), a fourth trolley 34, a fourth rail stop 36 (FIG. 1), a fifth trolley 38, a fifth rail stop 40 (FIG. 2), a sixth trolley 42, a sixth rail stop 44 (FIG. 1), a seventh trolley 46, a seventh rail stop 48 (FIG. 2), an eighth trolley 50, an eighth rail stop 52 (FIG. 1), a ninth trolley 54, a ninth rail stop 56 (FIG. 2), a tenth trolley 58, and a tenth rail stop 60 (FIG. 1). All of the trolleys 22, 26, 30, 34, 38, 42, 46, 50, 54, and 58 are substantially identical to each other in structure and function. An exemplary trolley, the second trolley 26, is shown in detail in FIGS. 6 and 7. Each trolley is selectively engaged by way of a differently configured rail stop 24, 28, 32, 36, 40, 44, 48, 52, 56, and 60. In particular, the differently configured rail stops 24, 28, 32, 36, 40, 44, 48, 52, 56, and 60 are engaged with alternating sides of the associated trolleys as will be described later herein with reference to FIGS. 8A-8F. This alternating arrangement helps the trolleys move smoothly along rail 12. It will be understood that fewer than ten trolleys and rail stops may be supported by rail 12. Alternatively, more than ten trolleys and rail stops may be supported by rail 12.

The end guide 16, transition guide 18, lance guide 20, and the various trolleys 22, 26, 30, 34, 38, 42, 46, 50, 54, and 58, together support a plurality of lances 62 (FIGS. 9A, 9B and 10) that are connected to a report high pressure source of fluid. In one embodiment, the high pressure fluid is water but it will be understood that air or other gases and liquids may be piped through lances 62. Additionally, the fluid (liquid or gas) may have solid particulate matter entrained therein.

The attached figures illustrate five lances 62 used in system 10. It will be understood that fewer than five lances 62 may be provided in system 10. In other instances, more than five lances 62 may be utilized. Rail 12 may further support a stacker 64 (FIGS. 9A, 9B and 10), a rotation mechanism 66 (FIGS. 3B, and 5-7), and a translation mechanism 68 (FIGS. 9B, 11, 14, and 15).

Figure 3:
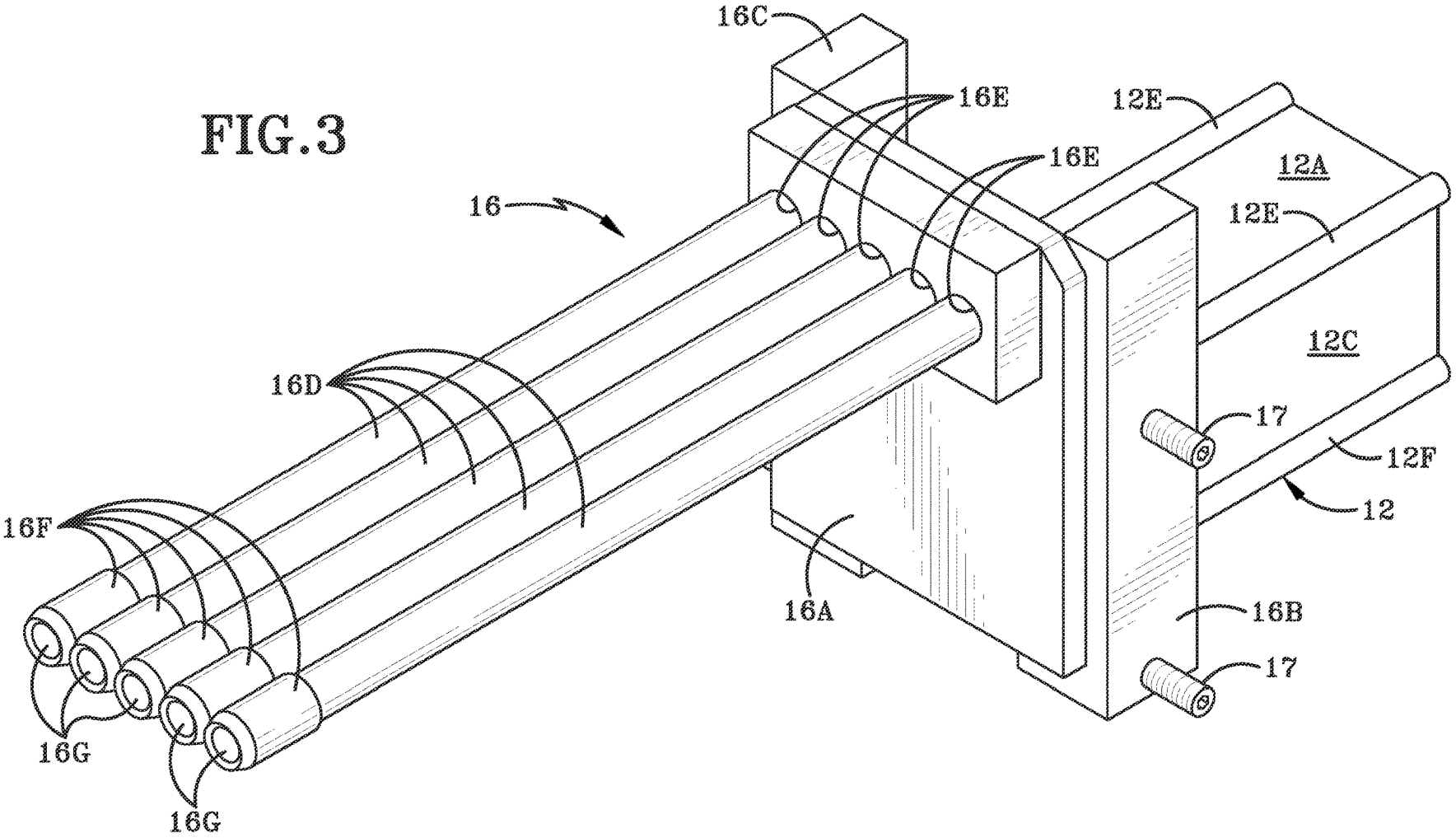
FIG. 3 is a front left side perspective view of an end guide of the lance cleaning system shown engaged with the rail, and showing a plurality of lances (in phantom) extending outwardly from the tubes of the end guide.

The various components of system 10 will now be described in greater detail. Referring to FIG. 3, the end guide 16 is illustrated. End guide 16 includes a housing that is generally U-shaped when viewed from above and includes a front panel 16A, a left side panel 16B, and a right side panel 16C. The housing is fixedly engaged with a front end of rail 12. In particular, front panel 16A abuts the front end of rail 12 and left and right side panels 16B, 16C of housing 16A abut and are secured to the left and right sides 12C, 12D of rail 12 by one or more fasteners 17. The fasteners 17 are passed through aligned openings defined in left and right side panels 16B, 16C and in rail 12. A plurality of tubes 16D extend outwardly from a front surface of front panel 16A. Tubes 16D pass through apertures 16E defined in front panel. The apertures 16E are horizontally aligned with each other and are located so as to be positioned a distance vertically above top 12A of rail 12. Each tube 16D terminates in a nosepiece 16F. Each tube 16D defines a bore 16G therethrough that runs the length of tube 16D. Each bore 16G is configured to be able to receive one of the lances 62 therethrough.

As will be understood, if fewer than five lances 62 are utilized in system 10, then a complementary number of apertures 16E, 16D, and nosepieces 16F may be utilized in end guide 16. As will be further understood, if more than five lances 62 are utilized in system 10, then a complementary number of apertures 16E, 16D, and nosepieces 16F may be utilized in end guide 16. It should further be understood that even though five apertures 16E, 16D, and nosepieces 16F are provided in end guide 16, fewer than five lances 62 may be utilized in system 10 and then the lances 62 will simply be inserted through an appropriate number of apertures 16E, 16D, and nosepieces 16F.

FIG. 4 shows the transition guide 18 that is positioned a distance longitudinally rearwardly of end guide 16. Transition guide 18 includes a transition guide body 13, a pair of mounting blocks 15 and a plurality of fasteners 17A, 17B. Transition guide body 13 is generally rectangular in shape and includes a top 13A, a bottom 13B, a front 13C, a back 13D, a left side 13E, and a right side 13F. Transition guide body 13 defines a plurality of apertures 13G therethrough. Each aperture 13G extends from front 13C through to back 13D. Transition guide body 13 is illustrated as defining five apertures 13G therein; each of the apertures 13G being shaped and sized to receive one of the five lances 62 therethrough. Apertures 13G are aligned in a horizontal row that is substantially identical to the configuration shown in end guide 16. As will be understood, if fewer than five lances 62 are utilized in system 10, then a complementary number of apertures 13G may be defined in transition guide body 13. As will be further understood, if more than five lances 62 are utilized in system 10, then a complementary number of apertures 13G may be defined in transition guide body 13. It should further be understood that even though five apertures 13G are defined in transition guide body 13, fewer than five lances 62 may be utilized in system 10 and then the lances 62 will simply be inserted through an appropriate number of apertures 13G.

A channel 13H is defined in transition guide body 13. Channel 13H extends between front 13C and back 13D of transition guide body 13 and extends downwardly to an opening defined in bottom 13B. Channel 13H is illustrated as being an inverted U-shape but it will be understood that in other embodiments, channel 13H may be differently shaped. Channel 13H is positioned, shaped, and sized to selectively receive stacker 64 therethrough during operation of system 10.

Transition guide body 13 also defines a generally square or rectangular notch 13J in each lower corner of the body, i.e., where bottom 13B intersects the front, back, left side and right side 13C-13F. These notches 13J may be omitted.

Mounting blocks 15 are generally L-shaped when viewed from the front and are configured to engage the transition guide body 13 and rail 12. A first mounting block 15 is engaged with a left side region of transition guide body 13 and a left side region of rail 12. A second mounting block 15 is engaged with a right side region of transition guide body 13 and a right side region of rail 12. The mounting blocks are mirror images of each other. Each mounting block 15 has a top 15A, a bottom 15B, a front 15C, a back 15D, an inside surface 15E, and an outside surface 15F. The inside surface 15E defines a vertically-oriented recess 15G that is shaped to receive one of the end regions (proximate left side 13E or right side 13F. The bottom 13B of transition guide body 13 is positioned above a horizontal surface 15H of each of the mounting blocks 15.

Each of the inside surfaces 15E of mounting blocks 15 also defines a horizontally-oriented slot 15J that is located a distance vertically downward from horizontal surface 15H and is positioned, shaped and sized to receive a portion of the curved edge 12E of rail 12 therein.

Mounting blocks 15 also define a plurality off first holes (not shown) that extend between exterior surface 15F and a region of interior surface 15E which is located in the recess 15G. A plurality of first fasteners 17A pass through these first holes and into aligned holes defined in the associated one of the left side 13E or right side 13F of transition guide body 13. First fasteners 17A secure transition guide body 13 between mounting blocks 15. A second hole (15K) is defined in each mounting block 15 a distance vertically below the plurality of first holes. The second holes 15K in the two mounting blocks 15 are aligned with each other and a fastener 17B is passed therethrough. Second fastener 17B secures mounting blocks 15 to each other and clampingly engage transition guide body between mounting blocks 15. Second fastener 17B is tightened to the point that transition guide 18 is retained in a fixed location along the length of rail 12. If it is desired to reposition transition guide 18 for any reason, then second fastener 17B is loosened, guide 18 is moved along the edges 12E of rail 12 to a desired position, and then second fastener 17B is tightened up once again.

Figure 5:
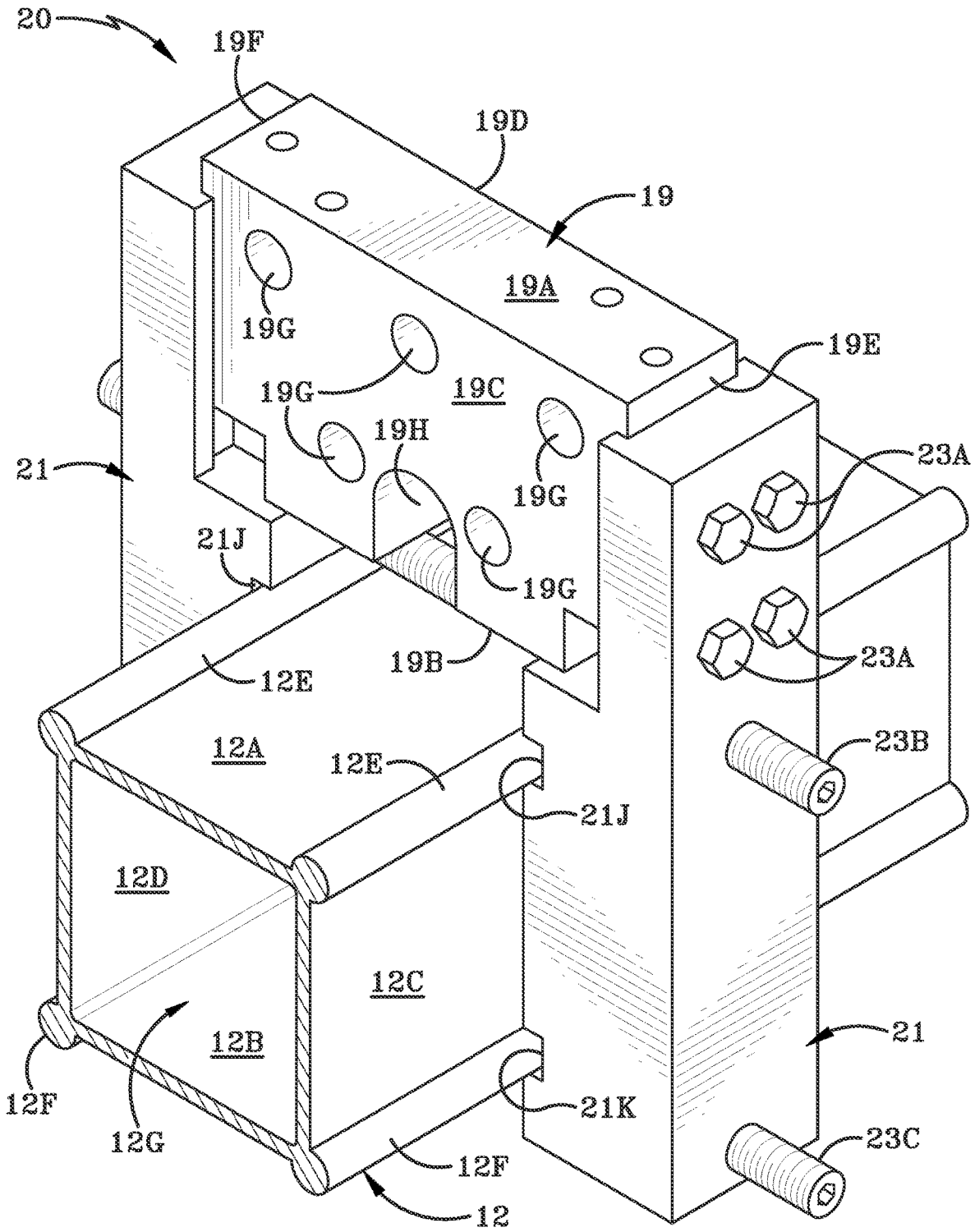
FIG. 5 is a front left side perspective view of a stationary lance guide of the lance cleaning system shown engaged with a section of a rail of the lance cleaning system.

Referring to FIG. 5, the lance guide 20 is shown. Lance guide 20 is substantially similar to transition guide in that it comprises a lance guide body 19 that is engaged with two opposed mounting blocks 21 by a plurality of fasteners 23. Lance guide body 19 is substantially identical in structure and function to transition guide body 13 except for the arrangement of the openings therethrough which receive the lances 62, as will be later described herein. Lance guide body 19 is generally rectangular in shape and includes a top 19A, a bottom 19B, a front 19C, a back 19D, a left side 19E, and a right side 19F. Transition guide body 19 defines a plurality of apertures 19G therethrough. Each aperture 19G extends from front 19C through to back 19D. Transition guide body 19 is illustrated as defining five apertures 19G therein; each of the apertures 19G being shaped and sized to receive one of the five lances 62 therethrough. Apertures 19G are arranged in a pattern. In particular, apertures 19G are arranged in two horizontally-oriented rows that are spaced a vertical distance apart from each other. The rows comprise an uppermost row (proximate top 19A) and a lowermost row (proximate bottom 19B). FIG. 5 shows three apertures 19G in the uppermost row and two apertures 19G in the lowermost row. In the pattern, the apertures 19G are also transversely staggered relative to each other. For example, each aperture 19G in the lowermost row is located between two apertures of the uppermost row. It will be understood that the particular pattern of the apertures 19G and therefore of the lances 62 may be varied by configuring the pattern of the apertures 19G differently. As will be understood, if fewer than five lances 62 are utilized in system 10, then a complementary number of apertures 19G may be defined in lance guide body 19. As will be further understood, if more than five lances 62 are utilized in system 10, then a complementary number of apertures 19G may be defined in lance guide body 19. It should further be understood that even though five apertures 19G are defined in lance guide body 19, fewer than five lances 62 may be utilized in system 10 and then the lances 62 will simply be inserted through an appropriate number of apertures 19G.

A channel 19H is defined in lance guide body 19. Channel 19H extends between front 19C and back 19D of lance guide body 19 and extends downwardly to an opening defined in bottom 19B. Channel 19H is illustrated as being an inverted U-shape but it will be understood that in other embodiments, channel 19H may be differently shaped. Channel 19H is positioned, shaped, and sized to selectively receive stacker 64 therethrough during operation of system 10. Lance guide body 19 also defines a generally square or rectangular notch 19J in each lower corner of the body, i.e., where bottom 19B intersects the front, back, left side and right side 19C-19F. These notches 19J may be omitted.

Mounting blocks 21 are substantially identical to mounting blocks 15 in function and are of the same general shape and structure as mounting blocks 15. Because of the similarity between mounting blocks 15 and 21, the various component parts of mounting blocks 21 have not been discussed herein or labeled in the drawings. One difference between mounting blocks 21 and mounting blocks 15 is that mounting blocks 21 are longer and extend downwardly for a distance beyond the bottom 12B of rail 12. Mounting blocks 15, on the other hand, have a bottom 15B that terminates at a location between upper edge 12E and lower edge 12F of rail 12. Mounting blocks 21 define an upper slot 21J, similar to slot 15J, and configured to receive the upper edge 12E of rail therein. Mounting blocks 21 differ from mounting blocks 15 in that the blocks 21 further define a lower slot 21K that is positioned, shaped, and sized to receive lower edge 12F of rail 12 therein. A plurality of first fasteners 23A secure mounting blocks 21 to lance guide body 19. A second fasteners 23B and a third fastener 23C secure the first mounting block 21 and second mounting block 21 to each other.

Second and third fasteners 23B, 23C secure mounting blocks 21 to each other and clampingly engage lance guide body 19 between them. Fasteners 23B, 23C are tightened to the point that lance guide 20 is retained in a fixed location along the length of rail 12. If it is desired to reposition lance guide 20 for any reason, then fasteners 23B, 23C are loosened, guide 20 is moved along the edges 12E, 12F of rail 12 to a desired position, and then fasteners 23B, 23C are tightened up once again.

Figure 6:
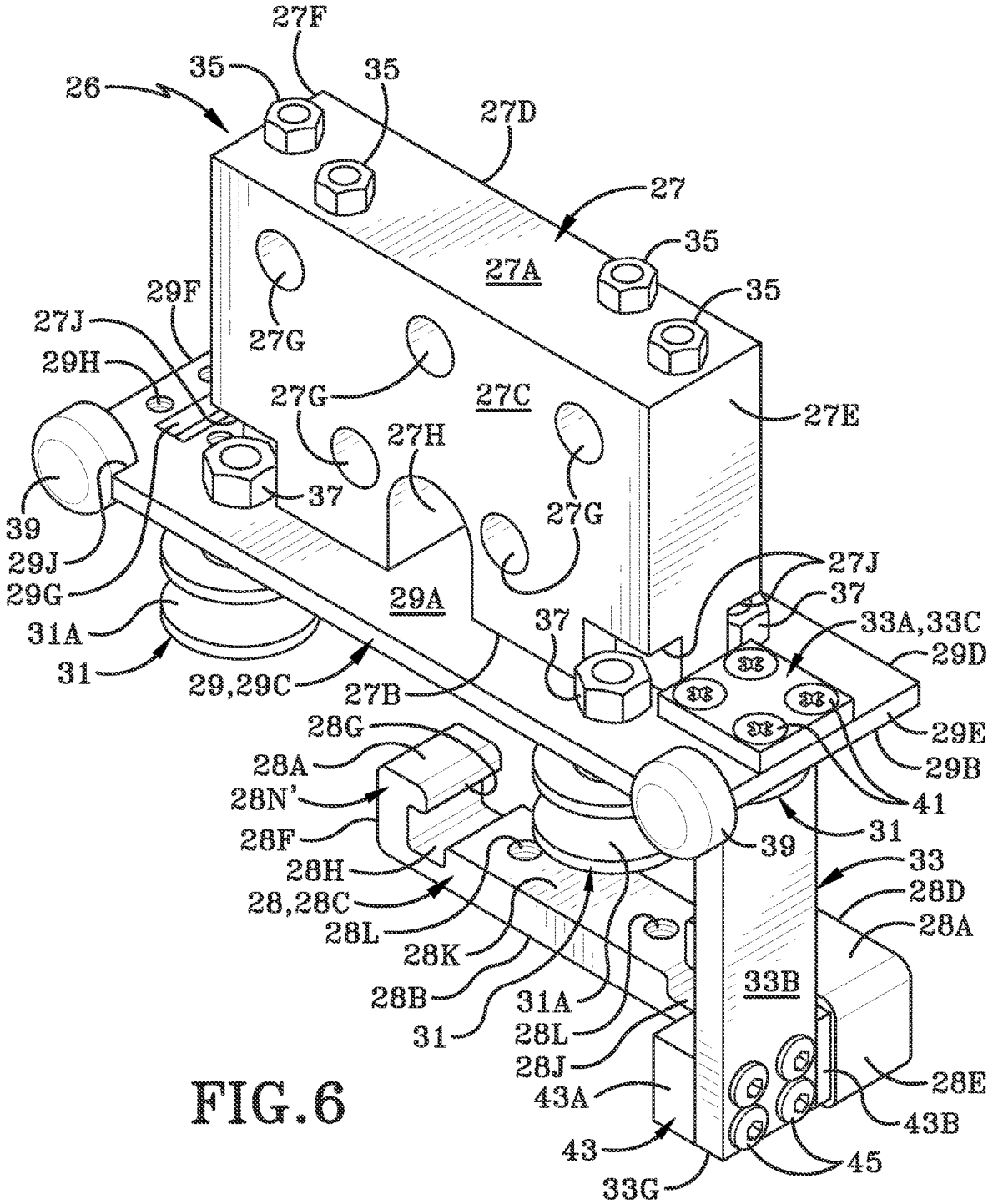
FIG. 6 is a front, left side perspective view of an exemplary trolley assembly of the lance cleaning system, in particular the second trolley assembly, shown engaged with an exemplary rail stop of the lance cleaning system, in particular the second rail stop thereof.
Figure 7:
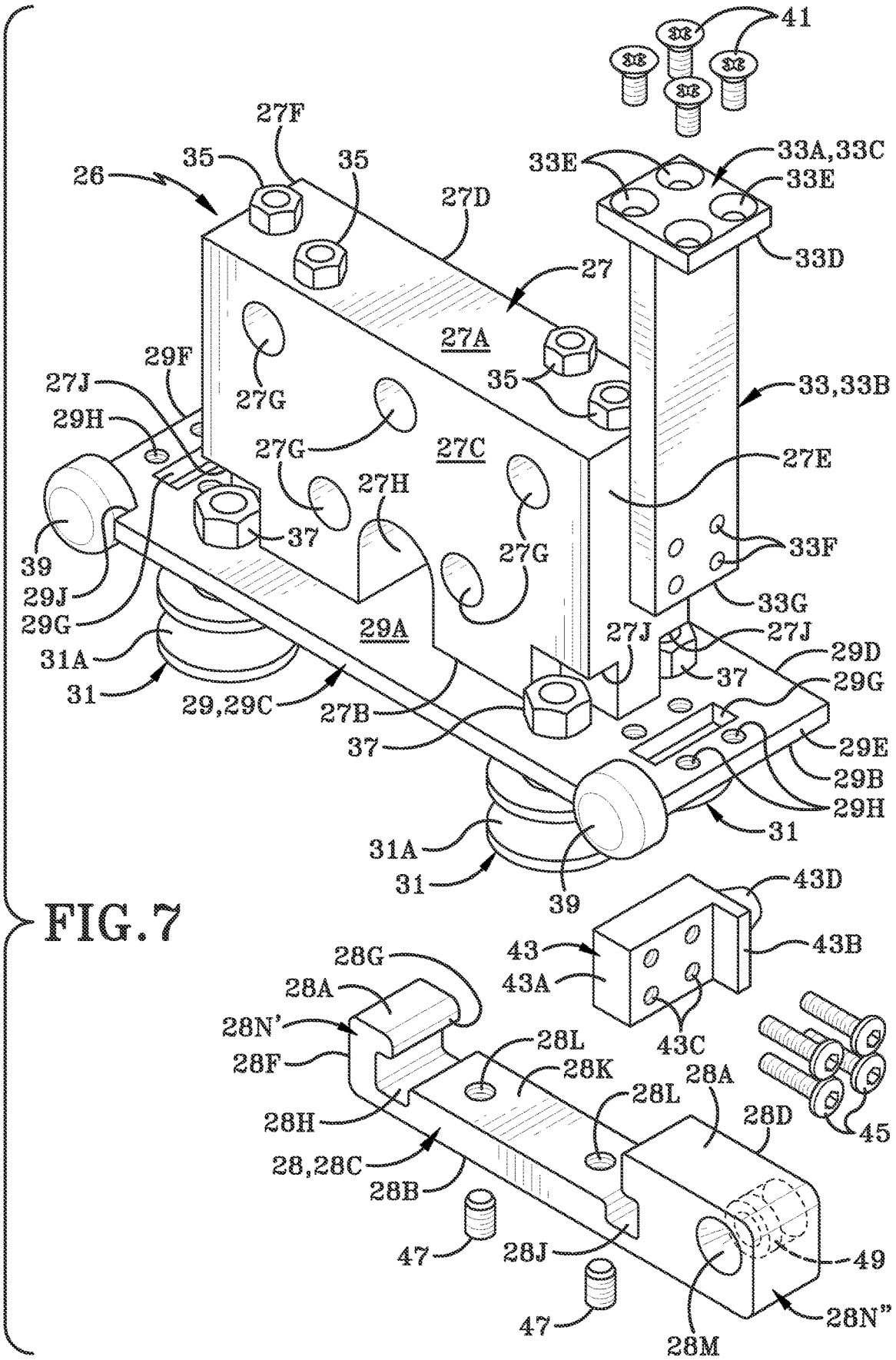
FIG. 7 is an exploded front, left side perspective view of the exemplary trolley assembly and rail stop of FIG. 6.

Referring particularly to FIGS. 6 and 7, an exemplary trolley and exemplary rail stop are shown. The exemplary trolley shown in these figures is the second trolley 26 but it should be understood that all of the trolleys 22, 26, 30, 34, 38, 42, 46, 50, 54, and 58 provided in system 10 are substantially identical in structure and function. The rail stop shown in FIGS. 6 and 7 is the second rail stop 28. Certain features of this second rail stop 28 are found in all of the rail stops 24, 28, 32, 36, 40, 44, 48, 52, 56, and 60 used in system 10. There are differences from one rail stop to the next and these will be pointed out with respect to the discussion relating to FIGS. 12A through 12F.

Still referring particularly to FIGS. 6 and 7, second trolley 26 comprises a trolley body 27, a plate 29, a plurality of wheels 31, and an arm 33

Trolley body 27 is generally rectangular in shape and includes a top 27A, a bottom 27B, a front 27C, a back 27D, a left side 27E, and a right side 27F. Plate 29 is generally rectangular and includes a top 29A, a bottom 29B, a front 29C, a back 29D, a left side 29E, and a right side 29F. Bottom 27B of trolley body 27 abuts top 29A of plate 29 and a plurality of fasteners 35 are utilized to secure trolley body 27 to plate 29.

Trolley body 27 defines a plurality of apertures 27G therethrough. Each aperture 27G extends from front 27C through to back 27D. Trolley body 27 is illustrated as defining five apertures 27G therein; each of the apertures 27G being shaped and sized to receive one of the five lances 62 therethrough. As will be understood, if fewer than five lances 62 are utilized in system 10, then a complementary number of apertures 27G may be defined in trolley body 27. As will be further understood, if more than five lances 62 are utilized in system 10, then a complementary number of apertures 27G may be defined in trolley body 27. It should further be understood that even though five apertures 27G are defined in trolley body 27, fewer than five lances 62 may be utilized in system 10 and then the lances 62 will simply be inserted through an appropriate number of apertures 27G.

FIGS. 6 and 7 also illustrate that the apertures 27G are arranged in a pattern. In particular, apertures 27G are arranged in two horizontally-oriented rows that are spaced a vertical distance apart from each other. The rows comprise an uppermost row (proximate top 27A) and a lowermost row (proximate bottom 27B). The figures show three apertures 27G in the uppermost row and two apertures 27G in the lowermost row. In the pattern, the apertures 27G are also transversely staggered relative to each other. For example, each aperture 27G in the lowermost row is located between two apertures of the uppermost row. It will be understood that the particular pattern of the apertures 27G and therefore of the lances 62 may be varied by configuring the pattern of the apertures 27G differently.

A channel 27H is defined in trolley body 27. Channel 27H extends between front 27C and back 27D of trolley body 27 and extends downwardly to an opening defined in bottom 27B. If plate 29 was not engaged with trolley body 27, channel 27H would be accessible through the opening in bottom 27B. Channel 27H is illustrated as being an inverted U-shape but it will be understood that in other embodiments, channel 27H may be differently shaped. Channel 27H is positioned, shaped, and sized to selectively receive stacker 64 therethrough during operation of system 10.

Trolley body 27 also defines a generally square or rectangular notch 27J in each lower corner of the body, i.e., where bottom 27B intersects the front, back, left side and right side 27C-27F. Fasteners 37 are used to mount wheels 31 to body 27 and plate 29. The heads of fasteners 37 (or nuts engaged with fasteners 37) are received in the notches 27J.

Plate 29 defines a variety of different openings that extend between top 29A and bottom 29B. Some of these openings receive the fasteners 35, 37 therethrough but are not shown in FIGS. 6 and 7. Additionally, a pair of longitudinally-oriented and rectangularly-shaped slots 29G are defined in opposed regions of plate 29. In particular, the slots 29 are arranged on either side of trolley body 27, particularly between sides 27E and 29E, and between sides 27F and 29F. A plurality of holes 29H are defined in plate and proximate slots 29G. As illustrated, two holes 29H are located laterally on either side of each slot 29G. As will be discussed later herein, one or the other of the groups of slots 29G and associated holes 29H is utilized to secure arm 33 to plate 29. Because this is the second trolley 26, the arm 33 is engaged in the slot 29G located proximate left side 29E of plate 29. Arm 33 is engaged with plate 29 at this location because it is then in the correct position to selectively be engaged with second rail stop 28, as will be described later herein.

Recesses 29J are defined in each of the front corners of plate 29, i.e., where front 29C intersects left side 29E and right side 29F, respectively. The notches 29J extend from top 29A through to bottom 29B. Resilient bumpers 39 are engaged with the plate 29 and each bumper 39 is seated within one of the recesses 29J. Bumpers 39 are secured to plate 29 in any suitable manner. Bumpers 39 may be fabricated from a material such as rubber so that impacts to trolley body 27 as trolley body slides along rail 12 may be absorbed thereby.

Each wheel 31 that is engaged with plate 29 and trolley body 27 by fasteners 37 is configured to engage rail 12. Each wheel 31 defines an annular C-shaped groove 31A therein. Groove 31A is complementary in curvature to the radius of curvature of the upper edges 12E of rail 12. The lateral spacing between the two wheels 31 proximate the left side 29E of plate 29 and the two wheels 31 proximate the right side 29F of plate 29 is complementary to the spacing between the upper edges 12E of rail 12. When second trolley 26 is engaged with rail 12, the wheels 31 proximate left side 29E of plate 29 receive the upper edge 12E of rail 12, where the upper edge 12E is the one located at the intersection of top 12A and left side 12D. The wheels 31 proximate right side 29F of plate 29 receive the upper edge 12E located at the intersection of top 12A and right side 12C of rail 12. The engagement between wheels 31 and rail 12 allows second trolley 12 to selectively move along rail 12 in one a first direction (toward front end 10A) and a second direction (toward rear end 10B).

As indicated earlier herein, second trolley 26 also includes an arm 33 that extends downwardly for a distance belong bottom 29B of plate 29 (FIG. 6). As illustrated, arm 33 is a generally T-shaped component when viewed from the front and includes a base 33A and a leg 33B. Base 33A is horizontally-oriented and may be generally square in shape when viewed from above. Base 33A includes an upper surface 33C and a lower surface 33D (FIG. 7). Leg 33B extends vertically downwardly from lower surface 33D. A plurality of through-holes 33E are defined in base 33A and extend from upper surface 33C through to lower surface 33D. Holes 33E are arranged in two laterally spaced-apart rows on either side of leg 33B. The arrangement and spacing of holes 33E is complementary to the arrangement and spacing of holes 29H in plate 29. Leg 33B is located between the two laterally-spaced apart rows of holes 33E and is shaped and sized to be received through slot 29G defined in plate 29. Leg 33B is thereby generally rectangular in cross-sectional shape. Arm 33 is engaged with plate 29 by inserting leg 33B through slot 29G and then inserting fasteners 41 through the aligned holes 33E, 29H. Each fastener 41 may be a lock screw or something similar that does not require a nut to secure the fastener in place.

As best seen in FIG. 7, leg 33B defines a plurality of apertures 33F that extend between a left side surface and a right side surface of leg 33B. Apertures 33F are therefore oriented at right angles to the longitudinal axis "Y" of system 10 when trolley 26 is engaged with rail 12. A locking member 43 is secured to leg 33B. Locking member 43 comprises a generally L-shaped base when viewed from above. The base includes a first leg 43A and a second leg 43B that meet at right angles to each other. First leg 43A defines a plurality of openings 43C therein that extend between a left side surface and a right side surface of the first leg 43A. The arrangement, shape, and size of openings 43C is complementary to the arrangement, shape, and size of apertures 33F in leg 33B. After leg 33B has been inserted through slot 29G and fasteners 41 have secured base 33A to plate 29, locking member 43 is positioned in contact with the end of leg 33B that defines apertures 33F therein. In particular, leg 33B is received in the right-angled corner defined between first leg 43A and second leg 43B of locking member 43 and so that the right side surface of leg 33B abuts the left side surface of locking member 43. Fasteners 45 are inserted through the aligned apertures 33F and openings 43C to secure locking member 43 to leg 33B.

FIG. 7 shows that locking member 43 is provided with a boss 43D that extends outwardly from second leg 43C in a direction opposite to first leg 43A. Consequently, when second trolley 26 is engaged on rail, boss 43D will be generally aligned parallel to longitudinal axis "Y". Boss 43D is fabricated from a magnetic or ferromagnetic material. Boss 43D is illustrated as being a truncated cone but any other suitable shape boss 43D may be utilized. Locking member 43 is utilized to temporarily secure second trolley 26 to second rail stop 28, as will be later described herein. It will be understood that other types of locking member may be utilized on second trolley 26 in the place of locking member 43.

While only the second trolley 26 has been described in detail herein, it will be understood that all of the trolleys 22-58 are substantially identical except for the few differences pointed out herein. Because of the substantial similarity between the trolleys 22-58, reference characters used in the description of trolley 26 will be utilized in this description to also identify features and components of any of the other trolleys under discussion in any particular part of this disclosure unless otherwise specified.

Figure 8A:
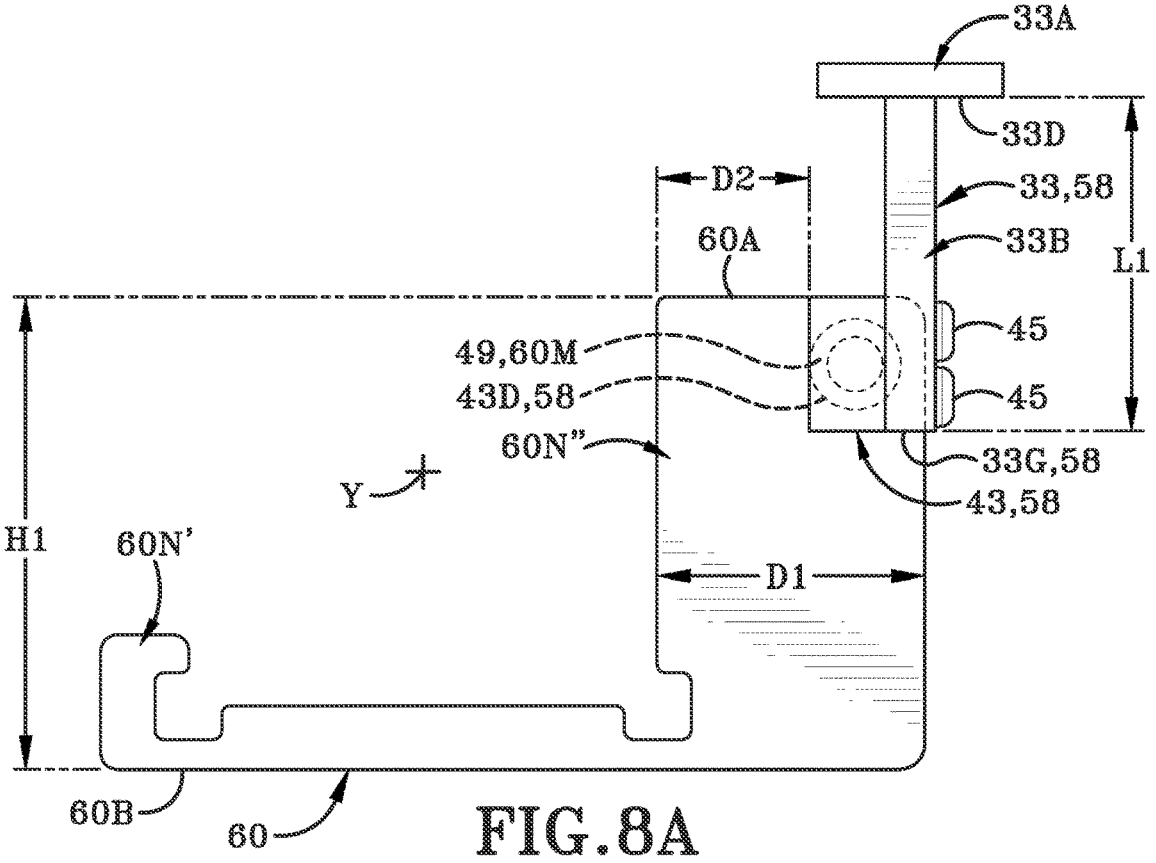
FIG. 8A is a front elevation view of the tenth rail stop and the leg from the tenth trolley.
Figure 8B:
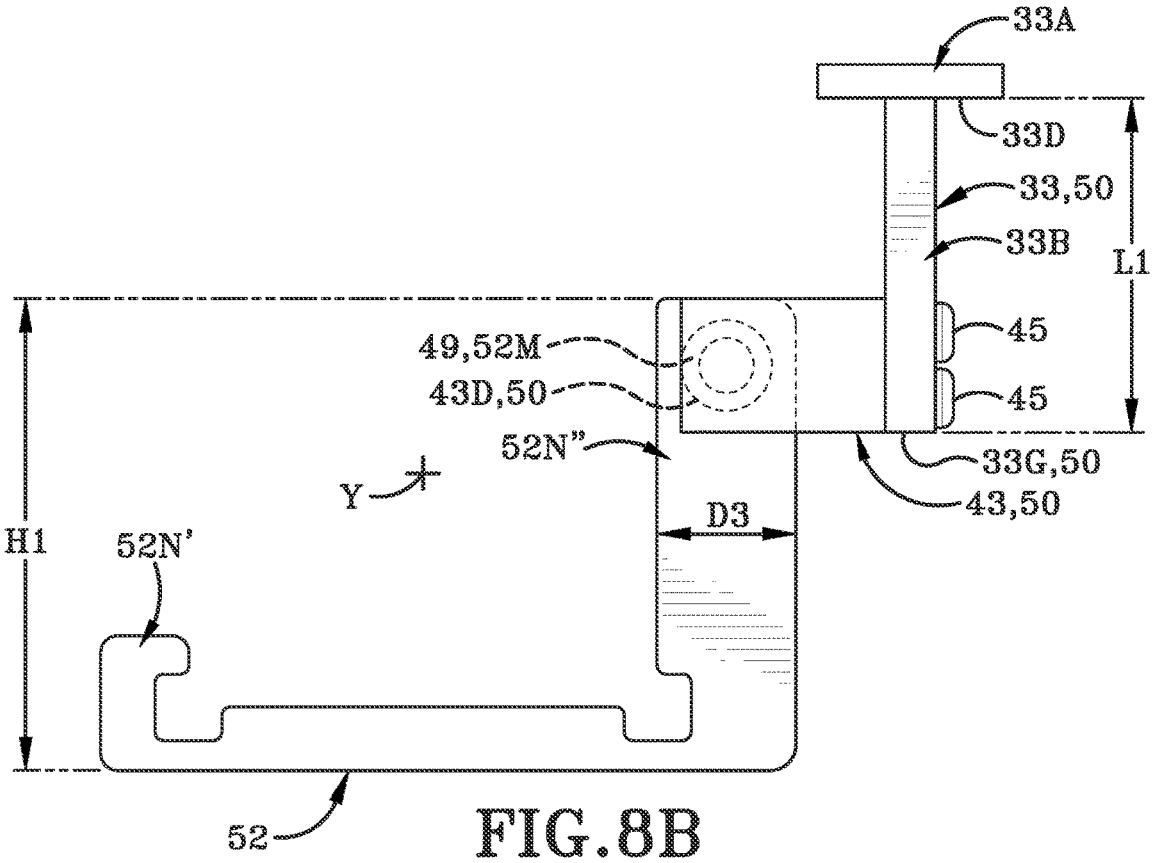
FIG. 8B is a front elevation view of the eighth rail stop and the leg from the eighth trolley.
Figure 8C:
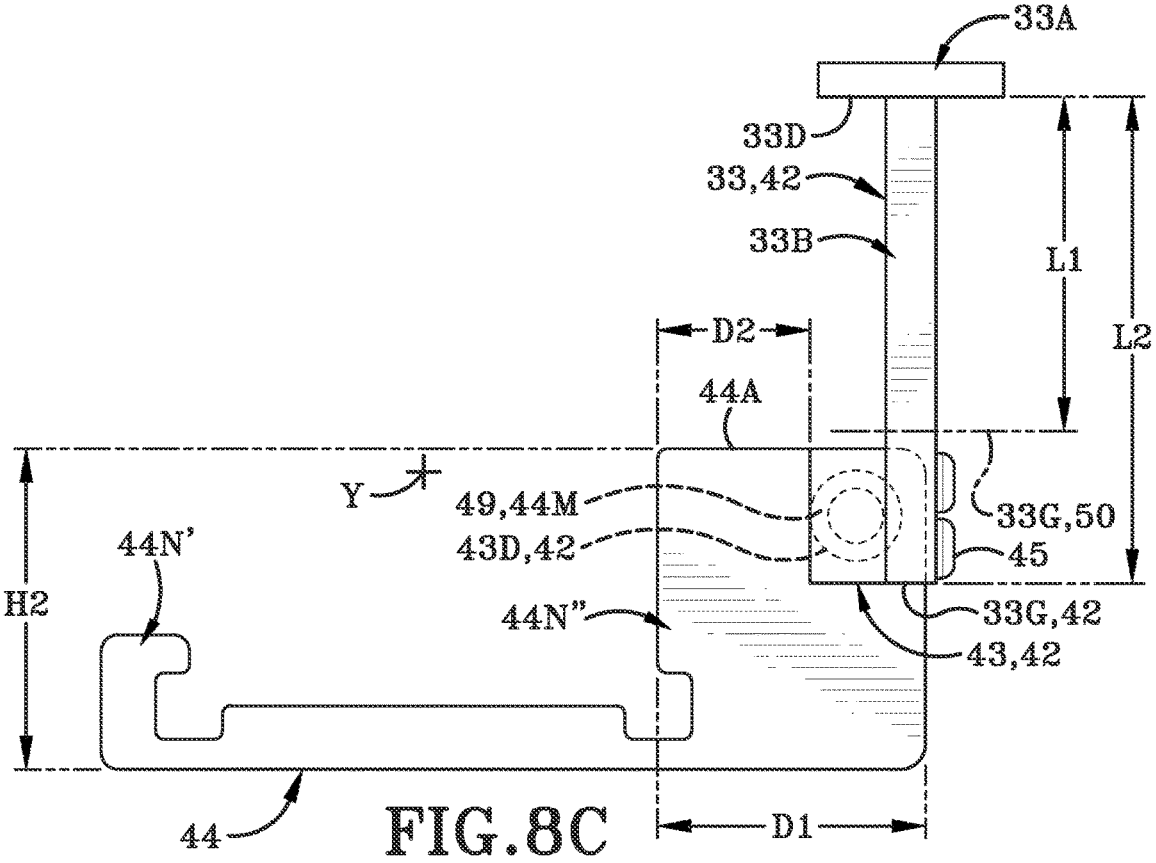
FIG. 8C is a front elevation view of the sixth rail stop and the leg from the sixth trolley.
Figure 8D:
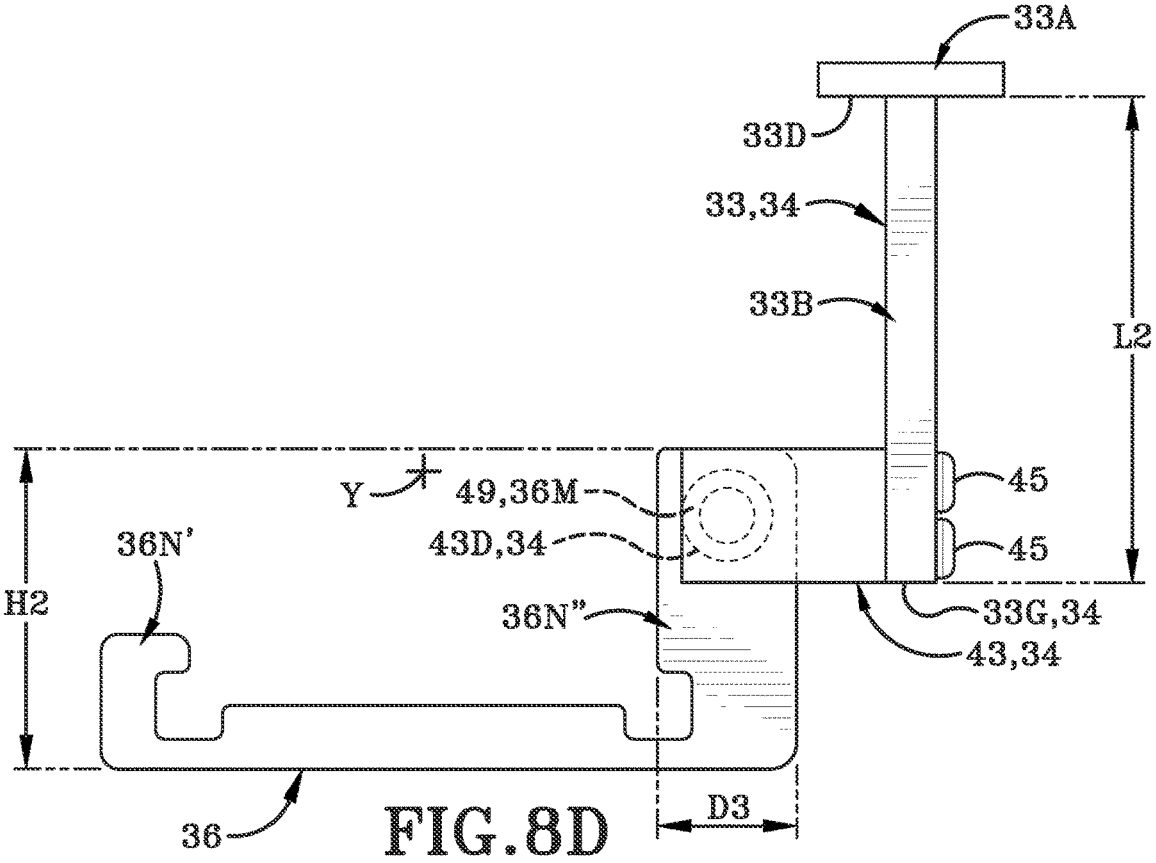
FIG. 8D is a front elevation view of the fourth rail stop and the leg from the fourth trolley.
Figure 8E:
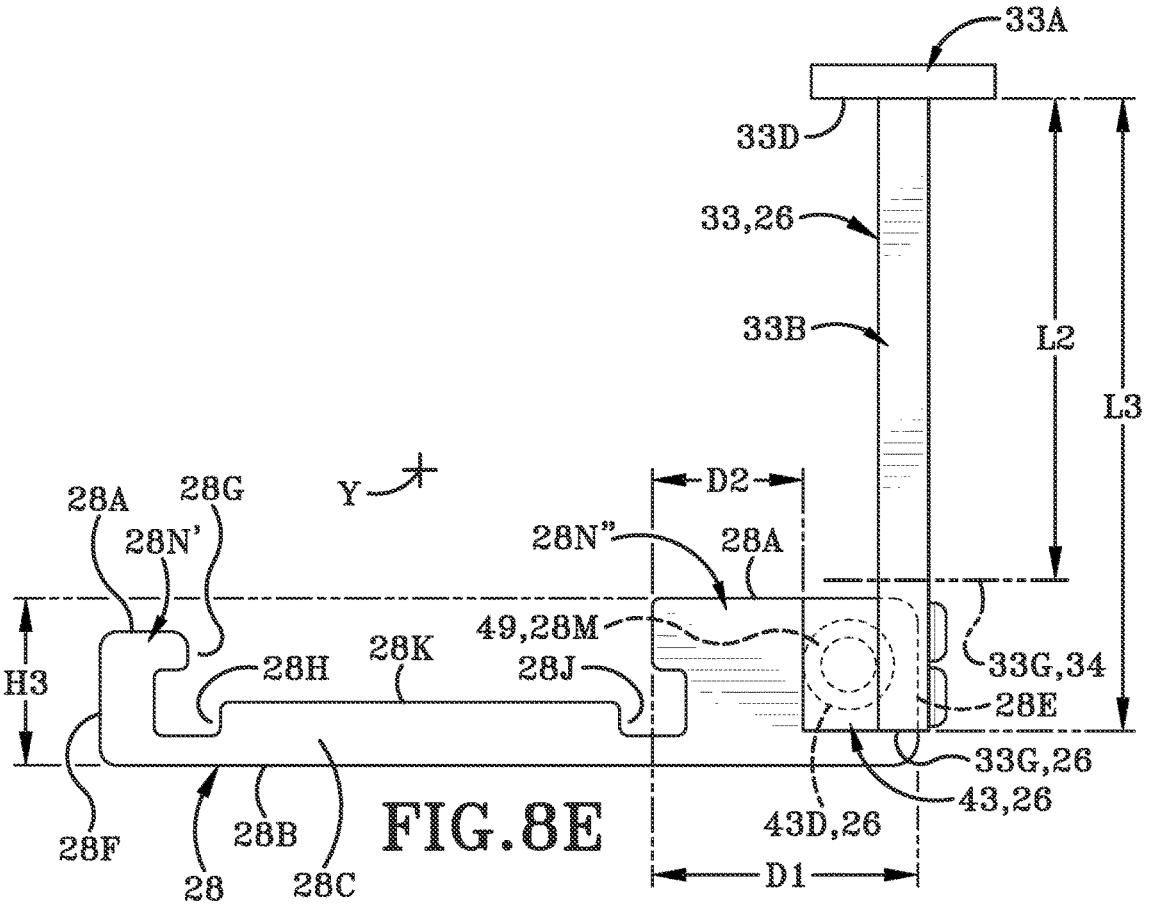
FIG. 8E is a front elevation view of the second rail stop and the leg from the second trolley.

FIGS. 6, 7, and 8E show second rail stop 28 in greater detail. Rail stop 28 comprises a block of material having a top 28A, a bottom 28B, a front 28C, a back 28D, a left side 28E, and a right side 28F. A first recess 28G is defined in top 28A and this recess 28G extends downwardly toward bottom 28B but terminates a distance away from bottom 28B. Recess 28G also extends from front 28C through to back 28D. Two grooves 28H, 28J are defined in the block of material extending from front 28C through to back 28D. Each of the grooves 28H, 28J is generally square in cross-sectional shape and is cut deeper than recess 28G. Groove 28H is spaced laterally from groove 28J. A raised region 28K extends upwardly beyond grooves 28H, 28J and into recess 28G. Raised region 28K is located a distance vertically lower than top 28A. The shape of raised region 28K and of the two grooves 28H, 28J is complementary to the shape of the lower portion of rail 12. In particular, grooves 28H, 28J are configured to each receive one of the curved regions 12F of rail 12 therein. When the curved regions 12F are received in grooves 28H, 28J, the bottom 12B of rail stop 28 rests on raised region 28*k* and second rail stop 26 is latched to rail 12.

Rail stop 28 further defines a pair of laterally-spaced apart, threaded apertures 28L therein. Apertures 28L extend from an upper surface of raised region 28K through to bottom 28B. A pair of set-screws 47 are threadably engaged in apertures 28L and are rotated upwardly to bear against bottom 12B of rail 12 and thereby to lock the latched rail stop 28 to rail 12. The set screws 47 are rotated to the point that the position of rail stop 28 on rail 12 is substantially fixed, i.e., rail stop 28 does not tend to slide along rail 12 but rather remains in the same position.

Rail stop 28 further defines an opening 28M in front 28C. The opening 28M extends inwardly toward rear 28D. Opening 28M is shaped to be complementary to boss 43D on locking member 43. A magnet 49 is seated within opening 28M a distance inwardly from front 28C of rail stop 28. Alternatively, a ferromagnetic material may coat the interior surface of the opening 28M if a magnet is provided as part of boss 43D on locking member 43.

In accordance with an aspect of the present disclosure, the overall shape of the second rail stop 28 is not symmetrical when the rail stop is viewed from the front as in FIG. 8E. In particular, the second rail stop 28 includes a first region 28N' defined between groove 28H and right side 28F and includes a second region 28N" defined between groove 28J and left side 28E. Second region 28N" is substantially wider than first region 28N' where the widths are measured between the groove 28H or 28J and the associated side 28F or 28E, respectively. The height of first region 28N' and second region 28N" (as measured between top 28A and bottom 28B) is substantially the same.

It will be understood that each of the trolleys 22, 30, 34, 38, 42, 46, 50, 54, and 58 includes a body 27 and a plate 29 that are identical in structure and function to the body 27 and plate 29 of second trolley 26. Furthermore, each of the trolleys 22, 30, 34, 38, 42, 46, 50, 54, and 58 includes an arm 33 that engages the plate 29 of that particular trolley and which further engages an associated rail stop in a similar manner to how the arm 33 of trolley 26 engages rail stop 28.

The arms 33 on the trolleys 22, 26, 30, 34, 38, 42, 46, 50, 54, and 58 differ from each other in one or more ways. Firstly, the arm 33 may be engaged proximate the left side 29E of the plate 29 of the particular trolley or the arm 33 may be engaged proximate the right side 29F of the plate 29. As illustrated in FIGS. 1 and 2, the trolleys 26, 34, 42, 50, and 58 all have arms 33 engaged proximate left side 29E of their plates 29. The trolleys 22, 30, 38, 46, and 54 all have their arm 33 engaged proximate the right side 29F of their plates 29. Consequently, the placement of the arm 33 alternates between the right side and left side of the plates 29 of the trolleys along the length of rail 12.

Secondly, the length of the arm 33 on any particular trolley may be different from the length of the arm 33 on the adjacent trolleys. Additionally, the shape of the locking member 43 engaged with each arm 33 may be different from the shapes of the locking members 43 on adjacent trolleys. The different lengths of the arms 33 and shapes of the associated locking members 43 is varied so that one or more of the trolleys can slide past one or more of the rail stops so that the trolleys can be stacked. (This will be described later herein.)

Figure 8F:
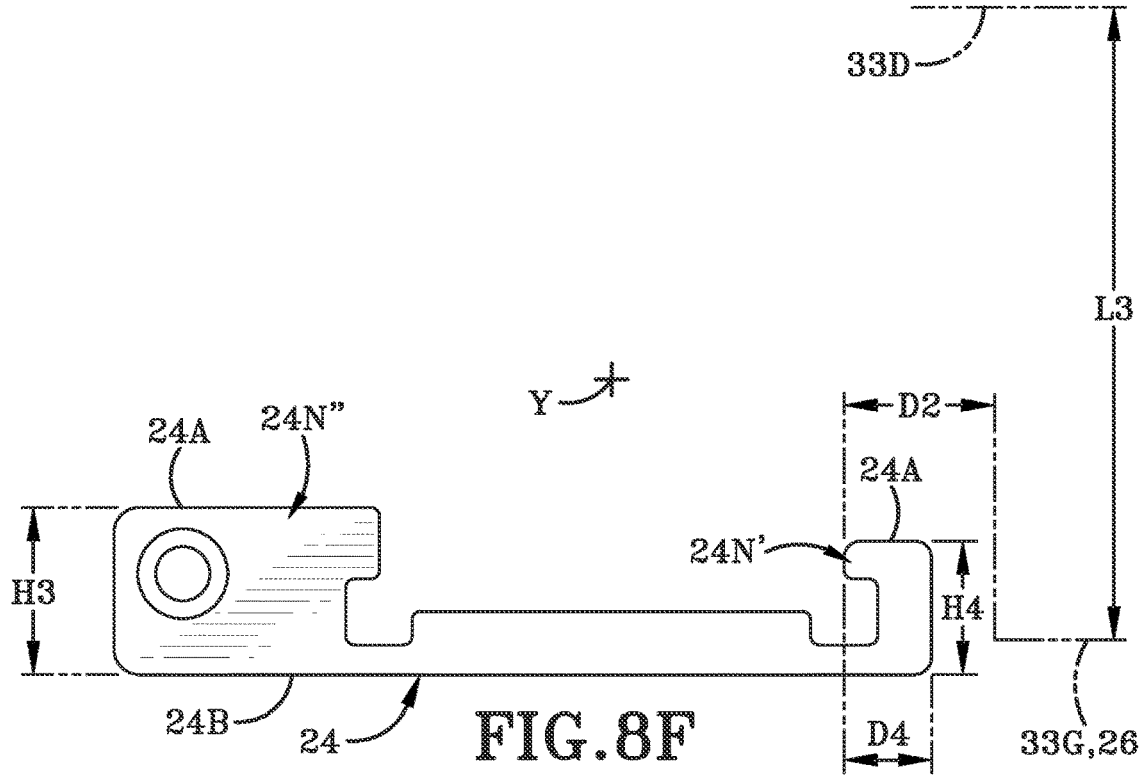
FIG. 8F is a front elevation view of the first rail stop.

FIGS. 8A-8F each show a particular rail stop and the arm 33 associated therewith. In some instances, at least part of the locking member 43 that will engage that particular rail stop is illustrated. FIG. 8A shows the tenth rail stop 60 engaged with the arm 33 of the tenth trolley 58. FIG. 8B shows the eighth rail stop 52 engaged with the arm 33 of the eighth trolley 50. FIG. 8C shows the sixth rail stop 44 engaged with the arm 33 of the sixth trolley 42. FIG. 8D shows the fourth rail stop 36 engaged with the arm 33 of the fourth trolley 34. FIG. 8E shows the second rail stop 28 engaged with the arm 33 of the second trolley 26. FIG. 8F shows the first rail stop 24. As can be seen from FIG. 1, the arm 33 of first trolley 22 will be located on an opposite side of the first trolley 22 relative to the arms 33 shown in FIGS. 8A-8E. If each of the rail stops and arms illustrated in FIGS. 8A-8E are rotated through 170 degrees, then those resultant rail stops and arms will be the ninth, seventh, fifth, third, and first rails stops and associated trolley arms, respectively.

As is evident from FIGS. 6, 7, and 8A-8F, each rail stop includes a first region (identified by the number of the particular rail stop plus N') and a second region (identified by the number of the particular rail stop plus N"). The first region s substantially identical across all of the illustrated rail stops 60, 52, 44, 36, 28, and 24 but the second region thereof differs in one or more of height, width, and placement of the aperture that includes the locking magnet. In other words, the first regions 60N', 52N', 44N', 36N' 28N', and 24N' are substantially identical in shape and size but the second regions 60N", 52N", 44N", 36N", 28N", and 24N" differ from each other. The particular shapes of the second regions and the placement of the magnet 43D therein permit movement of the associated trolleys past each other as will be described later herein. In particular, the shape and size of the cooperating parts of the trollies and rail stops allows each trolley to move past all but one complementary rail stop. Additionally, the arrangement of the locking mechanisms (magnets) on the trollies and associated rail stops is laterally and/or vertically staggered relative to the remaining trollies and rail stops so that each trolley is able to move past all but one complementary rail stop. This aspect of the present disclosure will be described in greater detail hereafter.

Referring specifically to FIG. 8A, tenth rail stop has a second region 60N" that is of a first width D1 measured from a left side edge to a right side edge of the second region and perpendicular relative to these side edges. The width D2 of second region 60N" is measured from the right side edge to a beginning of the opening 60M that retains a magnet 49 therein. Width D2 is less than the width D1. Second region 60N" also has a height H1 measured from top 60A to bottom 60B. This figure also shows the arm 33 of tenth trolley 58 shown on its own with the locking member 43, particularly the magnetic portion 43D thereof, engaged in the opening 60M of tenth rail stop 60. The locking member 43 overlaps part of second region 60N" so that the opening 60M is aligned with magnetic portion 43D. In particular, the leg 33B overlaps part of the width D1 and part of the height H1 of second region 60N". In this position, tenth trolley 58 is magnetically secured to tenth rail stop 60. Leg 33 of tenth trolley is of a length L1 measured from the bottom of the base 33A to free end 33G thereof. (It will be understood that the configuration of the rail stop and trolley leg illustrated in FIG. 8A is also used on ninth trolley 54 and ninth rail stop 56, respectively, except the illustrated rail stop and leg will be rotated through 170 degrees. In other words, the first region of the ninth rail stop 56 will be longitudinally aligned with the second region 60N" of tenth rail stop 56.)

Although not illustrated herein, it will be understood that tenth rail stop 60 is fixedly secured to rail 12 by set screws 47 (FIG. 7) but tenth trolley 58 is movable in one of a first direction and a second direction along rail. The movement of tenth trolley 58 is substantially parallel to longitudinal axis "Y". When tenth trolley 58 is to move toward front end 10A (FIG. 1) along rail 12, the magnetic engagement between locking member 43 and magnet 49 must first be broken (as will be described later herein). Once the magnetic engagement is broken, tenth rail stop 60 remains in place on rail 12 but tenth trolley 58 moves toward ninth rail stop 52 and ninth trolley 50. When tenth trolley 58 contacts ninth trolley 54, the bumpers 39 will strike the back of the plate on ninth trolley 54 and impart motion to ninth trolley 54 in the direction towards front end 10A.

Tenth trolley 58 is selectively able to move past ninth trolley 54 because only the first region of ninth rail stop 56 is engaged with rail 12 and that first region does not include any type of magnet to engage with locking member 43. Additionally, the arm 33 on tenth trolley 58 is of an insufficient length to come into contact the first region of ninth rail stop 56. Tenth trolley 58 will therefore readily move past ninth rail stop 56 and toward eighth rail stop 52 shown in FIG. 8B.

FIG. 8B shows the eighth rail stop 52 along with the arm of the eighth trolley 50. The length of arm 33 on eighth trolley 50 is of the same length L1 as the arm 33 on tenth trolley 58 (FIG. 8A). The second region 52N" of eighth rail stop 52 has a width D3 that is less than the width D2 of second region 60N" of tenth rail stop 60. The opening 58M that includes magnet 49 is defined in the second region 60N". The second region 52N" is of the same height H1 as second region 60N" of tenth rail stop. As is evident from comparing FIGS. 8A and 8B, the locking member 43D of tenth trolley 58 will not align with the opening 58M on eighth rail stop 52. Additionally, the width D3 is narrower than D2 and so the tenth trolley is capable of moving past eighth rail stop 52 if sufficient force is applied to tenth trolley 58. So, while the length L1 of leg 33B of tenth trolley 58 overlaps the height H1 of second region 52N", that leg 33B does not overlap the width D3. Consequently, leg 33B of tenth trolley 58 is able to move past second region 52N" of eighth trolley 52.

FIG. 8B shows that the locking member 43D of eighth trolley 50 will align with the opening 58M in eighth rail stop 52. It is therefore possible for eighth trolley 50 to be magnetically engaged with eighth rail stop 52. It will be understood that the same configuration of the eighth rail stop 52 and arm 33 of eighth trolley 50 will be provided on seventh rail stop 48 and seventh trolley 46 except rotated through 170 degrees so that the arm is adjacent the right side 12D of rail 12.

If the ninth trolley 56 is caused to move toward front end 10A by tenth trolley 60, the bumpers 30 on ninth trolley 56 will in turn strike the rear of the plate of the eighth trolley 50 and break the magnetic connection between eighth trolley 50 and eighth rail stop 52. The leg on the ninth trolley 56 is able to move past the first region 52N' of the eight rail stop 52. If the eighth trolley 50 is caused to move toward front end 10A, the leg 33B of the eighth trolley 50 is able to move easily past the first region of the seventh rail stop 48 as there is no opening or magnet in the first region thereof.

FIG. 8C shows the sixth rail stop 44 and six trolley leg 33B. Second region 44N" of sixth rail stop 44 is of the same width D1 as second region 60N" of tenth rail stop 60 (FIG. 8A) but is of a height H2 from top 44A to bottom 44B that is shorter than the height H1 of second region 60N" or second region 52N". The height H2 of second region 44N" is low enough that a leg 33B of length L1 is able to pass over the top of second region 44N". Consequently, the legs 33B of each of the tenth trolley 58 and the eighth trolley 50 will readily move over the top 44A of second region 44N" and therefore their motion won't be impeded or halted by sixth rail stop 44.

FIG. 8C also shows the leg 33B of the sixth trolley 42. The leg 33B of sixth trolley 42 is of a length L2 as measured from the bottom of base 33A to free end 33G thereof. The length L2 is longer than the length L1. The locking member 43 of sixth trolley 42 includes a magnetic portion that will overlap and be received in the opening 44M defined in sixth rail stop 44. Sixth rail stop 44M is therefore able to magnetically retain sixth trolley 42 in engagement therewith. Fifth rail stop 40 and fifth trolley 38 will be similarly configured to sixth rail stop 44 and sixth trolley 42 but will be rotated through 170 degrees relative thereto. The tenth, ninth, eighth, seventh trolleys are able to move past both of the fifth and sixth rail stops 40, 42 because of the configuration of the legs 33B and the second regions of the fifth and sixth rail stops 40, 42.

FIG. 8D shows the second region 36N" of the fourth rail stop 36 having a width D3 that is identical to that of the second region 52N" of eighth rail stop 52, and further having a height H2 that is identical to that of the second region 44N" of sixth rail stop 44. Comparing FIGS. 8C and 8D, it can be seen that the leg 33B of sixth trolley 42 will readily move past the fourth rail stop 36 because the position of the magnetic portion of the locking member 43 is laterally offset from the opening 36M and magnet 49 provided on second region 36N" of sixth rail stop 36.

FIG. 8D further shows the leg 33B of the fourth trolley 34 that is of the same length L2 as the leg 33B of the sixth trolley 42, where length L2 is measured from the bottom surface of the base 33A to the tip 33G of the sixth trolley's leg 33B. The locking portion 43D of the locking member 43 engaged with leg 33B of the sixth trolley 34 is positioned to align with the opening 36M and magnet 49 provided on fourth rail stop 36. Fourth rail stop 36 is therefore able to arrest movement of fourth trolley 34 but will not arrest movement of the sixth trolley 34 because of the lateral offset between the magnetic locking portion 43D on the sixth trolley's leg 33B and the opening 36M on the fourth rail stop 36. It will be understood that the configuration of the third rail stop 32 and leg on the third trolley 30 will be substantially identical to the configuration of the fourth rail stop 36 and fourth trolley 34 except rotated through 170 degrees. As before, the third rail stop 32 will not impede the motion of any of the trolleys located rearwardly of it, i.e., trolleys 34, 38, 42, 46, 50, 54, and 58.

FIG. 8E shows the second rail stop 28 and leg 33B of second trolley 26. Second region 28N" of second rail stop 28 is of the same width D1 as second regions 60N" of tenth rail stop 60 and sixth rail stop 44 (FIGS. 8A and 8C) but is of a height H3 that is shorter than the heights H1 and H2 of the previously described second regions. The height H3 of second region 28N" is measured between the top 28A and bottom 28B of second region 28N". Height H3 is low enough that a leg 33B of length L1 and a leg 33B of length L2 is able to pass over the top 28A of second region 28N". Consequently, the legs 33B of each of the trolleys located rearwardly of second trolley 26 will readily move over the top 28A of second region 28N" and therefore their motion won't be impeded or halted by second rail stop 28. In other words, trolleys 30, 34, 38, 42, 46, 50, 54, and 58 could readily move past second rail stop 28.

FIG. 8E also shows the leg 33B of the second trolley 26. The leg 33B of second trolley 26 is of a length L3 as measured from the bottom of base 33A to free end 33G thereof. The length L3 is longer than the length L1 and the length L2. The locking member 43 of second trolley 26 includes a magnetic portion that will overlap and be received in the opening 28M defined in second rail stop 28 and become magnetically engaged with magnet 49 thereof. Second rail stop 28M is therefore able to magnetically retain second trolley 26 in engagement therewith. First rail stop 24 is substantially identical to second rail stop 28 but is rotated through 170 degrees. First rail stop 24 (shown in FIG. 8F) presents a first region 24N' instead of a second region 24N" adjacent the left side 12C of rail 12. This first region 24N' is of a height H4 measured between top 24A and bottom 24B. This height H4 is lower than any of the heights H1, H2, and H3. The height H4 is sufficiently low enough to allow a leg of lengths L1 and L2 and the location of the outermost side of the first region 24N' is located a distance D4 that is short enough that the leg having a length L3 are able to move past the same. First rail stop 24 therefore will not impede any of the trolleys two through ten, i.e., trolleys 26, 30, 34, 38, 42, 46, 50, 54, and 58.

Referring to FIGS. 9-15; the rotation mechanism 66 and translation mechanism 68 are shown in greater detail. Rotation mechanism 66 is provided to impart rotation to the lances 62 of system 10, where each lance 62 is rotated about an axis that is parallel to longitudinal axis "Y". Translation mechanism 68 is provided to impart linear motion to trolleys 22-58 along rail 12 in one of a first direction toward first end 10A of system 10 and in a second direction toward second end 10B thereof.

Figures 9, 9A, 9B:
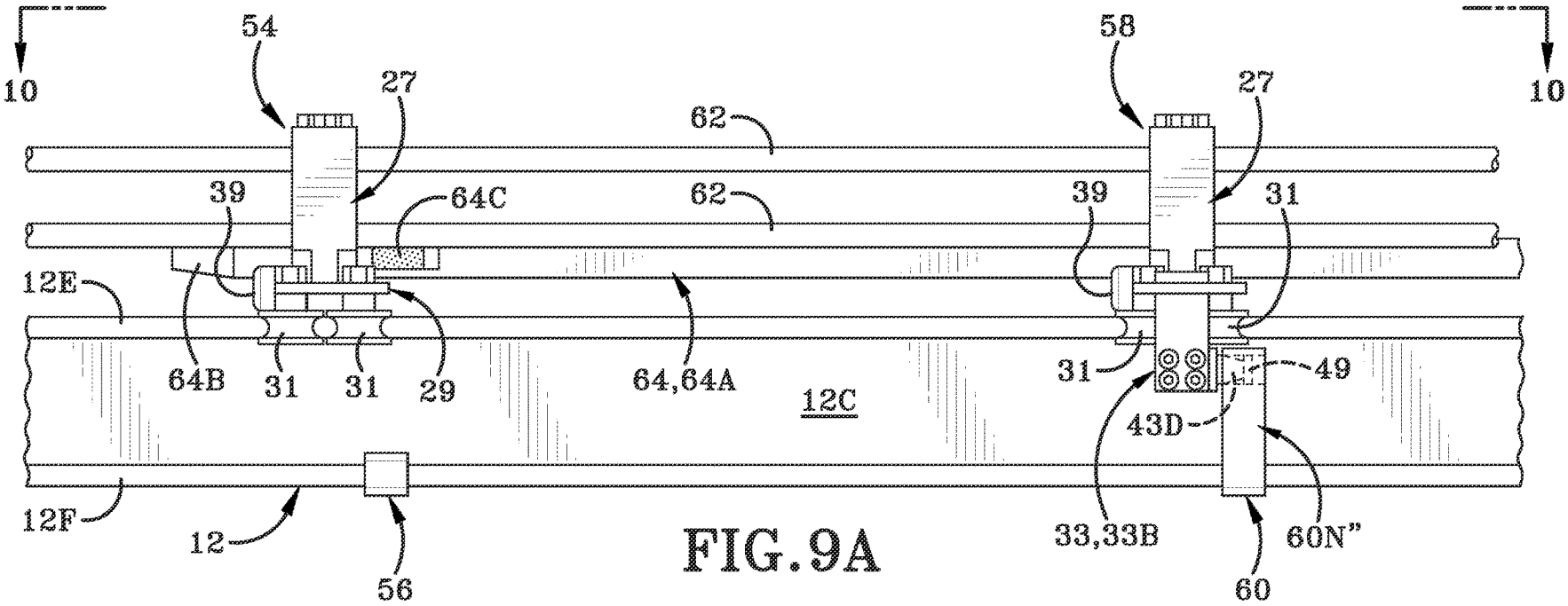
FIG. 9 is a block diagram showing the relationship of FIG. 9A and FIG. 9B, which together are an enlargement of the highlighted region of FIG. 1.
FIG. 9A is an enlargement of a first portion of the highlighted region of FIG. 1 showing exemplary trolley assemblies of the lance cleaning system.
FIG. 9B is an enlargement of a second portion of the highlighted region of FIG. 1 showing a rotation mechanism and a translation mechanism of the lance cleaning system.
Figure 9B:
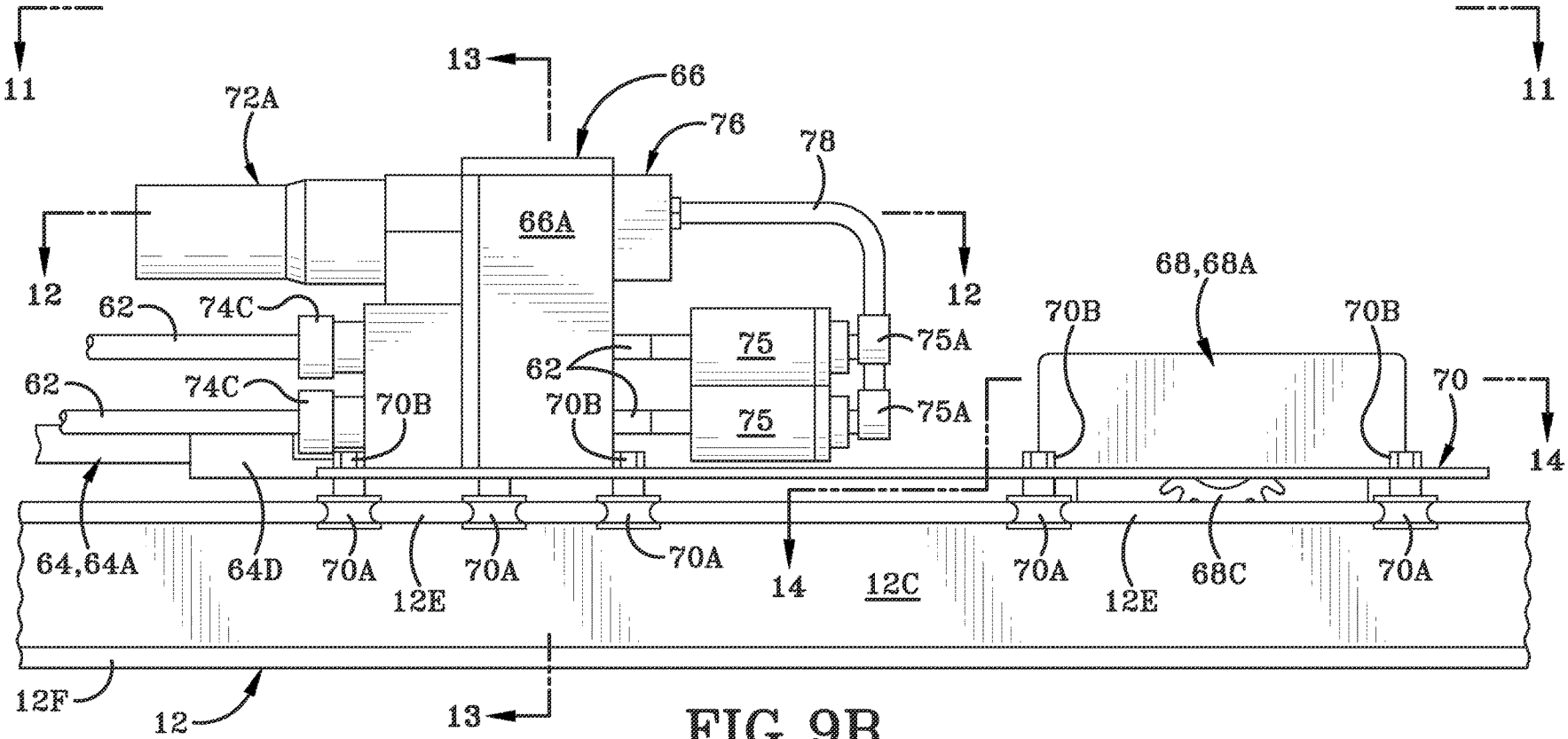

FIG. 9A shows a left side view of ninth trolley 54, ninth rail stop 56, tenth trolley 58, and tenth rail stop 60 engaged with rail 12. Stacker 64 is shown positioned between upper edge 12E of rail 12 and the lowermost lances 62. It will be understood that the stacker 64 passes through a channel defined in each of ninth trolley 54 and tenth trolley 48. The channel is substantially identical to channel 27H (FIG. 6) is aligned with similar channels in each of the first trolley 22 to the eighth trolley 50 and the channels 19H of lance guide 20 and channel 13H of transition guide 18. As is evident from FIGS. 1 and 2, the lances 62 are located a distance above rail 12 and substantially parallel with each other until the lower lances 62 angle upwardly to pass through the openings 13*g* in transition guide 18. After transition guide 18, all of the lances are arranged in the same plane and extend through the tubes 13D of end guide 16.

Stacker 64 is operatively engaged with and extends forwardly from rotation mechanism 66 and is moved in unison therewith along rail 12. Stacker 64 includes an elongated shaft 64A that terminates in a tapered tip 64B (FIG. 10). The tip 64B is located longitudinally remote from rotation mechanism 66. A resilient, deformable puck 64C is provided on shaft 64A a distance rearwardly from tip 64B. A second end of shaft 64A is fixedly engaged with a pusher 64D (FIG. 9B) operatively engaged with translation mechanism 66. The purpose of stacker 64 will be described later herein.

Rotation mechanism 66 and translation mechanism 68 are mounted on a platform 70. Platform 70 is a horizontally-oriented plate that has a plurality of horizontally-oriented wheels 70A mounted a distance below a bottom surface thereof by fasteners 70B. Wheels 70A are substantially identical in structure and function to wheels 31 utilized on second trolley 26. Wheels 70A are therefore configured to operatively engage the associated upper edge 12E of rail 12 and to enable the platform 70 and thereby the rotation mechanism 66 and translation mechanism 68 to move linearly along rail 12.

Figure 11:
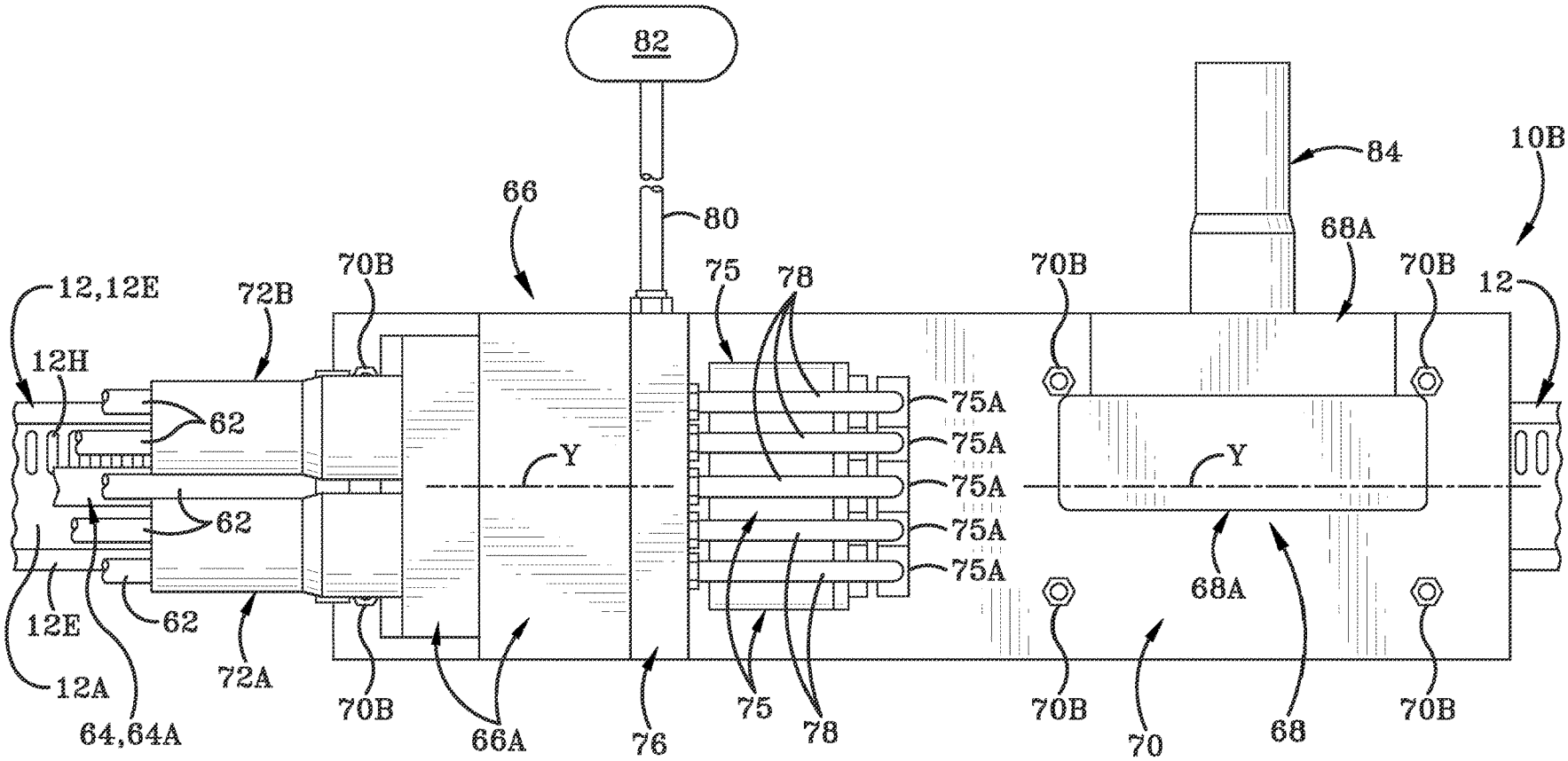
FIG. 11 is a top plan view of the rotation mechanism and translation mechanism taken along line 11-11 of FIG. 9B.
Figure 12:
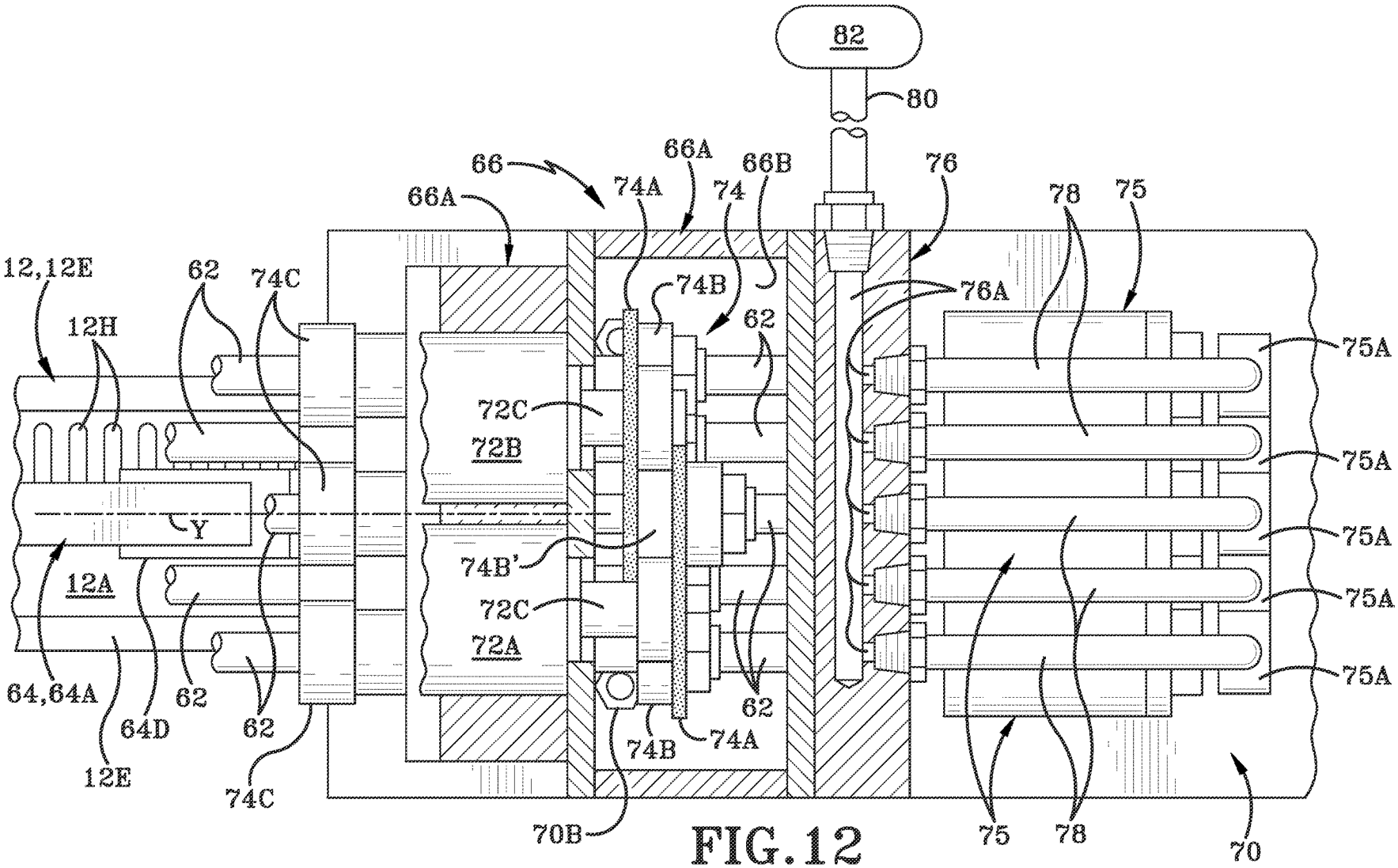
FIG. 12 is a partial cross-section of the rotation mechanism taken along line 12-12 of FIG. 9B.

FIGS. 9B, 11, and 12 show rotation mechanism 66 and translation mechanism 68 in greater detail. It should be understood that rotation mechanism 66 is shown diagrammatically in these figures. Rotation mechanism 66 includes a housing 66A having an interior chamber 66B (FIGS. 12 and 13) within which at least a portion of several components are housed. The rotation mechanism 66 includes a set of motors 72A and 72B each having a drive shaft 72C that is operatively engaged with a lance drive mechanism, generally indicated at 74. Lance drive mechanism 74 shows diagrammatically a pair of drive members 74A and a plurality of driven members 74B. Each driven member 74B is fixedly engaged with one of the lances 62. The drive members 74A are rotated by drive shafts 72C about an axis that is oriented parallel to longitudinal axis "Y". The drive members 74A in turn rotate the driven members 74B about another axis that is oriented parallel to longitudinal axis "Y". As each driven member 74B rotates, it causes rotational motion of the lance 62 with which that driven member is fixedly engaged. The drive members 74A may comprise a drive chain or a drive belt, for example. The driven members 74B may comprise a sprocket or gear (if the drive member is a drive chain) or a pulley (if the drive member is a drive belt). Any other suitable type of lance drive mechanism may be provided within rotation mechanism 66. Support bearings 74C are engaged with each of the lances 62 and extend outwardly from a front of housing 66A. It will be understood that various other bushings or bearings (not numbered) are engaged with the drive shafts 72C and other components of the lance drive mechanism 74 in order to ensure smooth rotation of the lances 62. Each of the two motors 72A, 72B drives one of the driven members 74A.

Figure 13:
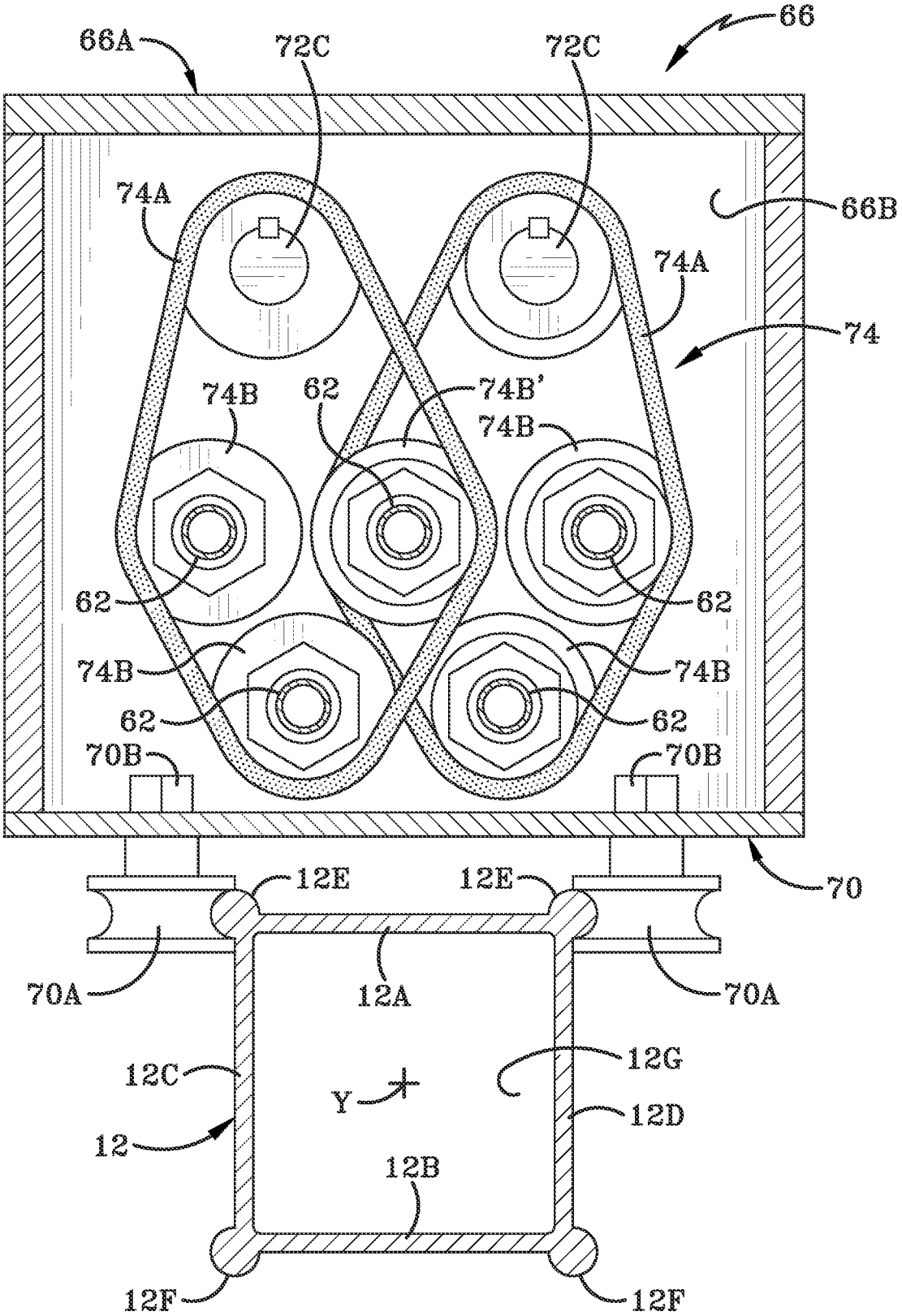
FIG. 13 is a partial cross-section of the rotation mechanism taken along line 13-13 of FIG. 9B.
Figure 14:
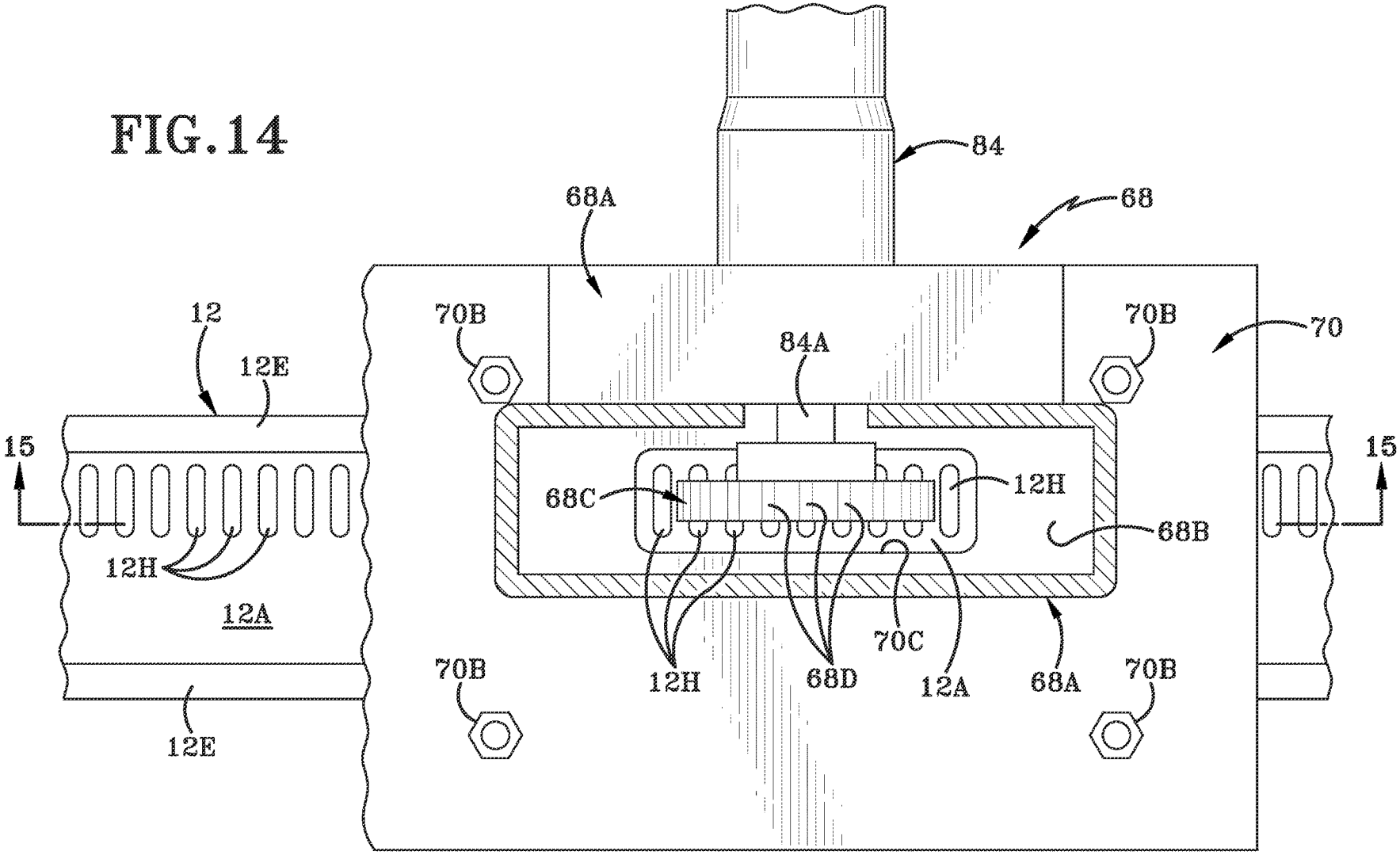
FIG. 14 is a partial cross-section of the translation mechanism taken along line 14-14 of FIG. 9B.
Figure 15:
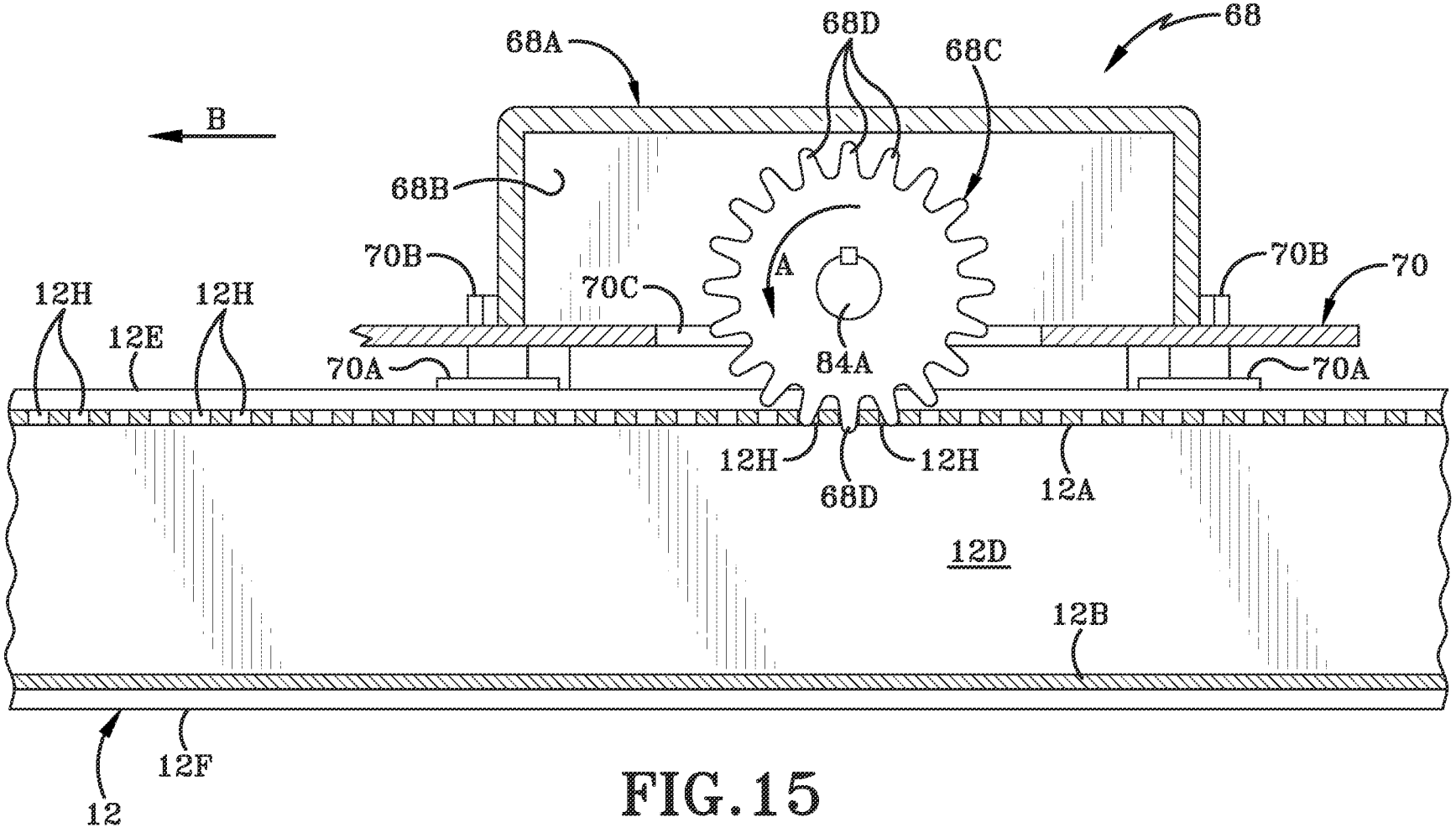
FIG. 15 is a partial cross-section of the translation mechanism taken along line 15-15 of FIG. 14.

As can be seen in FIG. 13, each of the drive members 74A is operatively engaged with three of driven members 74B which are engaged with the lances 62. One of the driven members, identified by the reference character 74B' is rotated by both of the drive members 74A. The drive members 74A overlap each other as they are both engaged with driven member 74B' and because of this, all lances 62 will rotate in unison.

A rear end of each lance 62 is operatively engaged with a swivel 75 that is, in turn, operatively engaged with a splitter assembly 76 (FIGS. 11 and 12) via feed lines 78. An inlet pipe 80 is operatively engaged with splitter assembly 76 at one end and is connected to a remote fluid supply at the other end. The remote fluid supply may provide a liquid or gas to splitter assembly 76. The liquid or gas is supplied to the lances 62 from splitter assembly 76 via the swivels 75. Swivels 75 rotate in unison with the associated lances 62 and are internally configured to enable the liquid or gas to flow steadily into lances from splitter assembly 76. It should be noted that the remote fluid supply is preferably a source 82 (FIG. 12) of high pressure liquid or gas. The lances 62 pass through the various openings 27G in the trolleys 22-58, openings 19G in lance guide 20, openings 13G in transition guide 18, and through tubes 16D of end guide 16 and the terminal ends of the lances 62, which typically will include a nozzle exit from the nosepieces 16F (FIG. 3). The high pressure fluid flows through the bore of each lance and exits therefrom through the nozzles at the terminal ends thereof.

Translational mechanism 68 is located longitudinally rearwardly from rotation mechanism 66 on platform 70. Translation mechanism 68 includes a housing 68A that defines an interior chamber 68B (FIG. 15) that housing a drive gear 68C therein. Drive gear 68C is operatively engaged with a motor 84 via a drive shaft 84A. When motor 84 is actuated, drive shaft 84A rotates about an axis that extends along the drive shaft 84A and turns drive gar 68C about that axis. The axis about which drive gear 68C rotates is oriented at right angles to longitudinal axis "Y". Housing 68A is mounted on platform 70 and an opening 70C (FIG. 15) is defined in the platform 70 in a location that falls directly above the track 12H on rail 12 and below housing 68A. More specifically, the opening 70C permits a portion of drive gear 68C to extend downwardly below a bottom surface of platform 70 and engage track 12H. Drive gear 68C includes a plurality of teeth 68D thereon that are configured and spaced to engage in the apertures that form track 12H.

When drive gear 68C is rotated about the axis along drive shaft 84A in a first direction, the engagement of teeth 68D and apertures 12H cause drive shaft 68C to advance down track 12H in a first direction toward front end 10A of system 10. When drive gear 68C is rotated in the opposite direction, the interlocking engagement of teeth 68D and apertures 12H result in drive gear advancing in the second direction toward rear end 10B of system 10. Because drive gear 68C is operatively engaged with platform 70, when drive gear 68C advances along track 12H in the first direction, the platform 70 also moves along rail 12 in the first direction. Wheels 70A on platform 70 ride along upper edge 12E of rail 12. If platform 70 moves in the first direction along rail 12, then rotation mechanism 66 also moves in unison therewith in the first direction. Since stacker 64 is operatively engaged with rotation mechanism 66/translation mechanism 68 and thereby with platform 70, as platform 70 moves in the first direction, stacker 64 also moves in the first direction.

As platform 70 advances toward front end 10A, the tip 64B of stacker 64 advances through the channel 27H in tenth trolley 58 and pusher 64 ultimately contacts a rear end 29D of the plate 29 of the tenth trolley 58. As drive gear 68C continues to rotate, sufficient force is applied to plate 29 of the tenth trolley 58 by the translation mechanism 68 to break the magnetic engagement of tenth trolley 58 with the tenth rail stop 60 and tenth trolley 58 starts to move linearly along rail 12 in the first direction.

It will be understood that if the drive gear 68B is rotated in the opposite direction, the platform 70 will be moved in the second direction along the rail 12 and therefore the trolleys are able to move linearly in the second direction along rail 12.

It will be understood that the motors 72A, 72B and 84 may be driven by one or more of water, air, electricity, magnetism, and electromagnetism.

Having thus described an exemplary non-limiting configuration of the system 10, the system's operation will be discussed hereafter with reference particularly to FIGS. 16-23.

Figure 16:
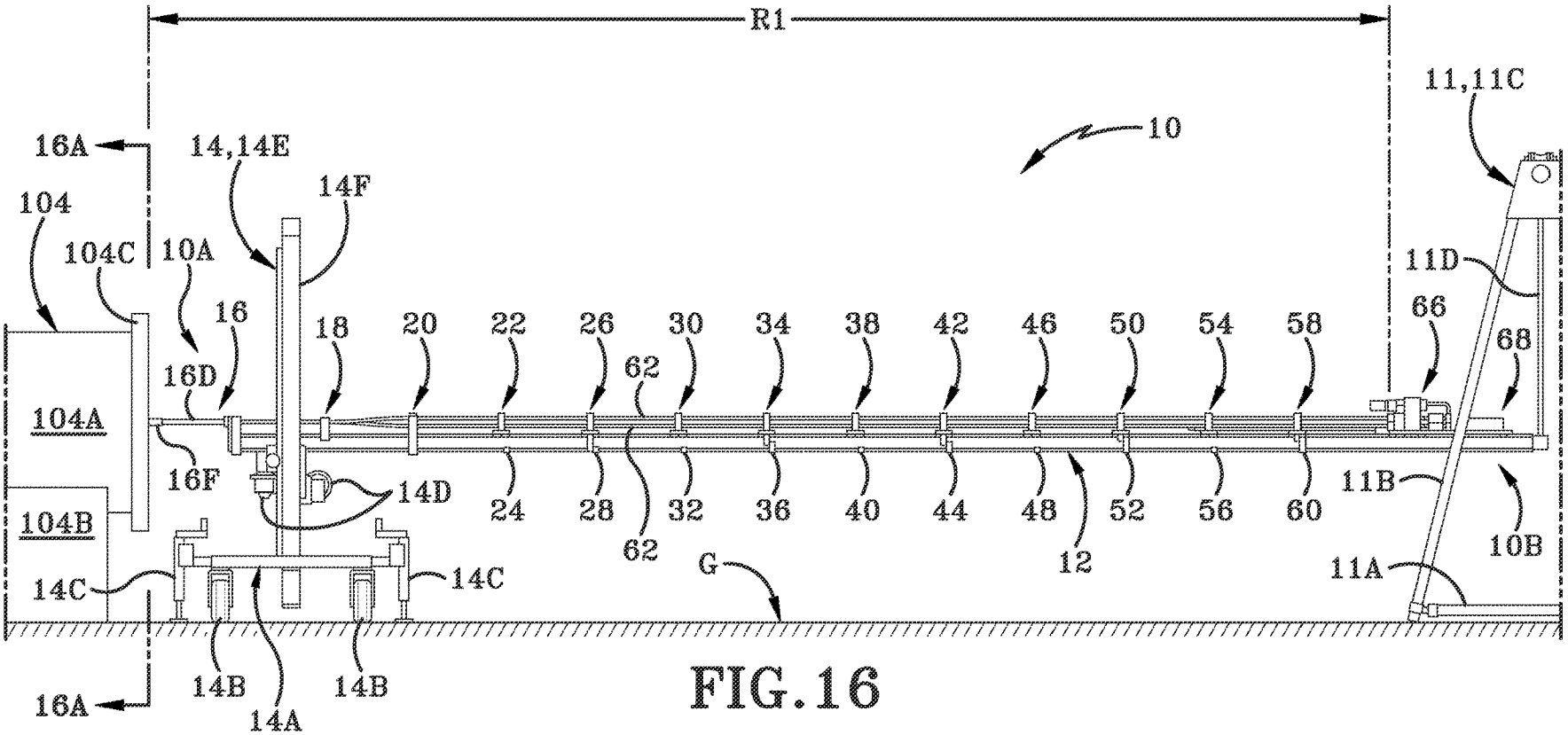
FIG. 16 is a left side elevation view of the exemplary lance cleaning system positioned to clean a tube bundle of an exemplary heat exchanger.

FIG. 16 shows the system 10 positioned adjacent a heat exchanger 104 that is to be cleaned and ready to perform a cleaning operation on tubes of the heat exchanger. Heat exchanger 104 includes a tube bundle that is located within a housing 104A (FIGS. 16 and 17) engaged with a support 104B and retained a distance above the ground "G". The housing 104A terminates in an end plate 104C which defines a plurality of openings 104D therein. Each opening 104D is aligned with a bore of one of the heat exchanger tubes that forms part of the tube bundle retained within the housing 104A.

Figure 16A:
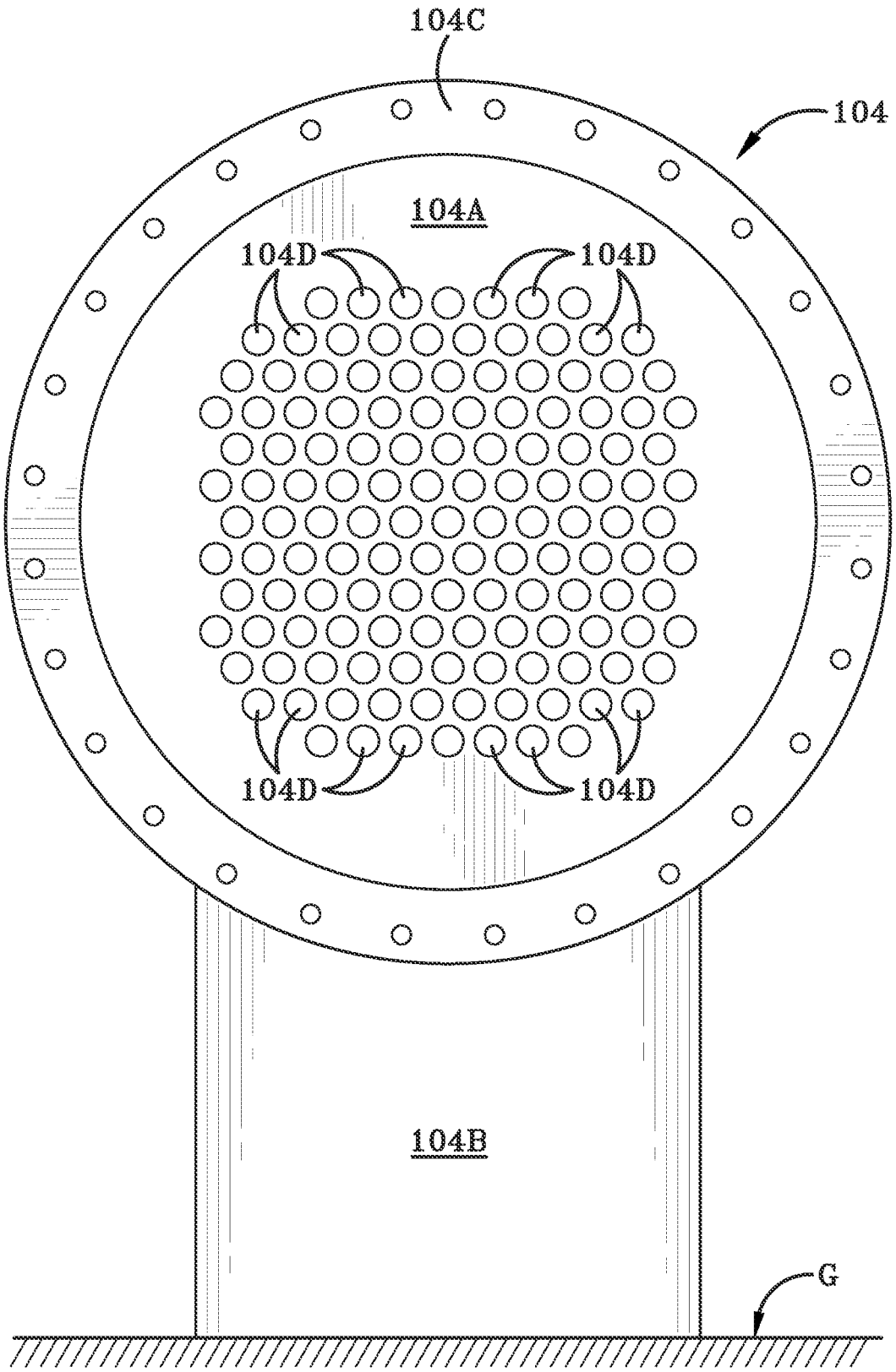
FIG. 16A is a rear end elevation view of an end plate of the exemplary heat exchanger taken along line 16A-16A of FIG. 16.

Referring to FIGS. 16 and 16A, system 10 is supported in position proximate end plate 104C by support frame 11 and indexer 14. The end guide 16 extends forwardly and outwardly beyond a front end 14E of indexer 14 so that the nosepieces 16F of end guide 16 form a leading end of the system 10. The rest of the system 10 extends rearwardly from the rear surface 14B of indexer 14. The rear end 10B of system 10 is suspended from support frame 11 by suspension rod 11D so that the indexer 14 may perform its functions properly. Indexer 14 itself may be locked into position on ground "G" using locking mechanisms 14C. Locking mechanisms 14C help to either prevent the wheels 14B of indexer moving across the ground "G" or lifting the wheels 14B off the ground and thereby preventing the shifting of system 10 relative to end plate 104C of indexer 14. The indexer 14 may be utilized to move system 10 in any desired direction relative to end plate 104C and along one or both of a vertical axis and a horizontal axis relative thereto. In particular, the indexer may be utilized to position nosepieces 16F in close proximity to a set of aligned openings 104D in end plate 104C. Since system 10 includes five lances 62, indexer 14 may be utilized to position the five nosepieces 16F and thereby the five terminal ends of the lances 62 immediately adjacent five openings 104D in end plate 104C. Indexer 14 positions nosepieces 16F by moving the front end 10A of system 10 up, down, to the left, to the right, along a diagonal or at an angle relative to the horizontal and vertical axes.

Figure 17A:
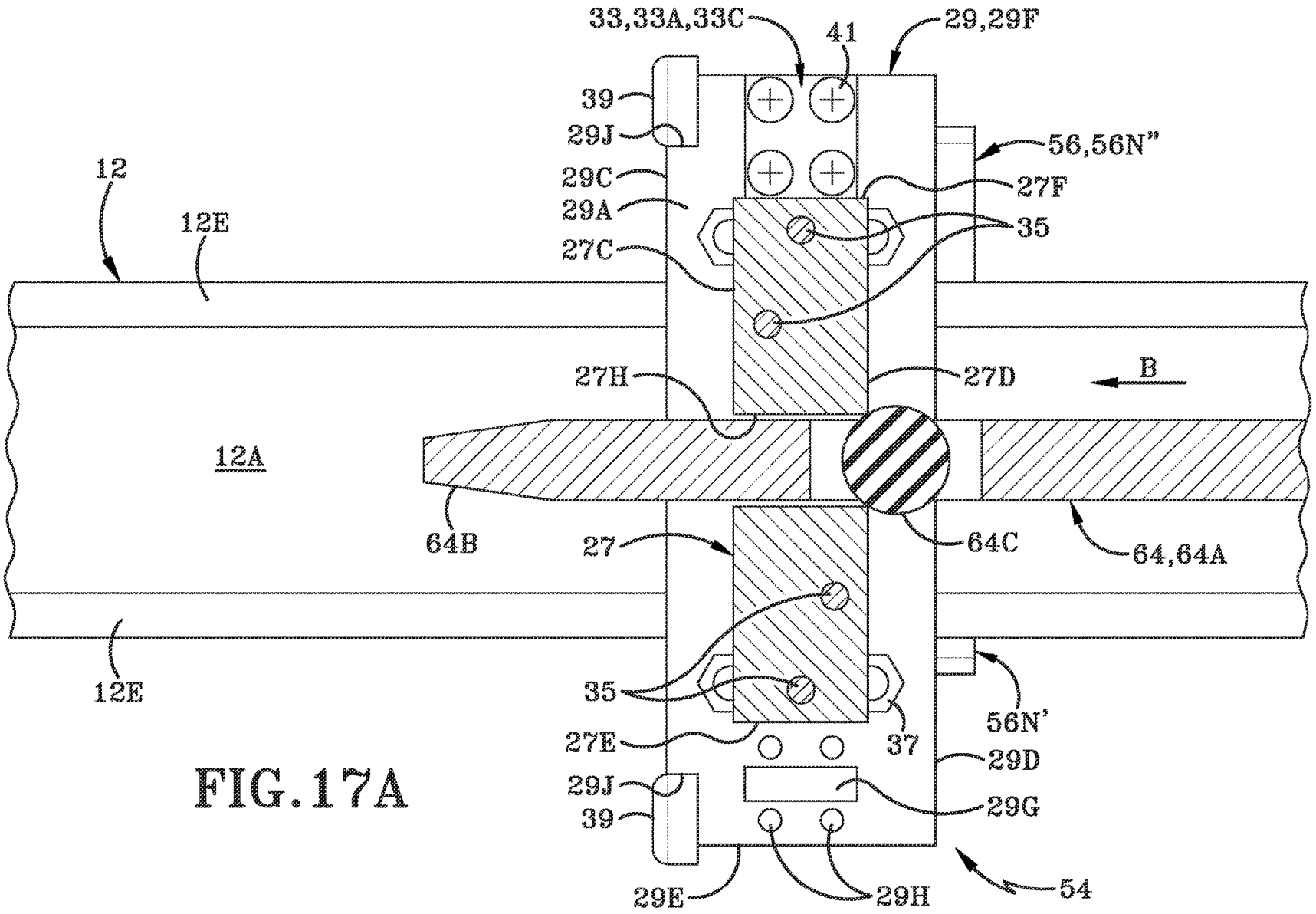
FIG. 17A is a partial cross-section of the ninth trolley taken along line 17A-17A of FIG. 16 showing a deformable puck on the stacker adjacent the back of the ninth trolley and poised to enter the channel defined in the ninth trolley.

At the start of a tube cleaning operation (FIG. 16), platform 70 with translation mechanism 68 and rotation mechanism 66 thereon is located proximate the second end of the rail 12 (i.e., proximate second end 10B) and proximate support frame 11. The trolleys 22-58 are generally equidistantly spaced from each other along rail 12 and stacker 64 is in its at-rest position where the tip 64B is located somewhere between eighth trolley 50 and the ninth trolley 54. It will be understood that stacker shaft 64A is already extending through the channel 27H of ninth and tenth trollies 54, 58 and is poised to pass into the channel 27H of the eighth trolley 50 as is shown in FIG. 17A but the puck 64C has not yet entered channel 27H of the ninth trolley 54. As is evident from FIG. 17A, puck 64C on stacker 64 is in a non-deformed state. It will be understood that puck 64C is positioned between front 27C of tenth trolley 58 and back 27D of ninth trolley 54. It will be understood that in other applications, the tip 64B of stacker 64 may be located between the ninth trolley 54 and tenth trolley 58 before a cleaning operation begins or between any other trolleys of system 10. The stacker 64 may also be of any length suitable to permit the puck 64C to pass out of the channel 27H of the first trolley 22 regardless of the number of trolleys utilized in system 10.

Prior to actuation, all the trolleys 22-58 are magnetically engaged with their respective rail stops 24-60. The distance between end plate 104C of heat exchanger and a front end of the platform 70 is indicated in FIG. 16 as distance R1. The cleaning operation is started when high pressure fluid is provided to system 10 via inlet pipe 80. In the exemplary embodiment, the high pressure fluid is water. Specifically, high pressure fluid will move from the remote fluid source 82 through the inlet pipe 80, enters inputs 76A (FIG. 12) of the splitter 76, flows from the splitter through feed tubes 78 and is subsequently outputted from the feed tubes and into the inputs 75A of swivels 75. From the swivels 75, the fluid flows into the bores of the plurality of lances 62. Lance drive mechanism 74 is then activated by actuating first and second motors 72A, 72B. Motors 72A, 72B rotate the two drive members 74A which in turn cause driven members 74B to rotate. In particular, the rotating chain or belt 74A engaged with the sprockets or pulleys 74B causes the sprockets or pulleys 74B to rotate. Since lance supports 74C are operatively engaged with the sprockets or pulleys 74B, rotation of the sprockets or pulleys 74B causes rotation of the lance supports 74C and thereby of the lances 62 engaged therewith. Each lance 62 has a nozzle at its end, so rotation of the lance 62 causes rotation of the associated nozzle and therefore rotation of the stream of fluid flowing out of the nozzle.

Substantially simultaneously with the actuation of motors 72A, 72B, the operator will actuate moto 84 to activate the translation mechanism 68. As has been described earlier herein, the motor 84 of translation mechanism 68 will rotate the drive gear 68C in the direction "A" (FIG. 15) and the drive gear 68C will then move linearly down the track 12H in a first direction "B" (FIGS. 15 and 18A) towards front end 10A and thereby towards end plate 104C. As drive gear 68C rotates it causes the platform 70 to begin to move in the direction "B" away from rear end 10B and therefore away from the second end of rail 12. The platform 70 moves toward and ultimately contacts tenth trolley 58, as will be described hereafter. Because the lances 62 extend outwardly from rotation mechanism 66, linear movement of the platform 70 will also cause linear movement of the lances 62 in the same direction. The terminal ends of the lances 62 and nozzles thereon will emerge from the nosepieces 16F of end piece 16 and will enter the openings 104D with which the nosepieces 16F are aligned. High pressure fluid exiting the nozzles on the lances 62 will scour away build-up on the interior surface the tube. The rotation of the lances 62 helps to ensure that the circumferential interior surfaces of the heat exchanger tubes are thoroughly cleaned by the high pressure fluid.

Because the heat exchanger tubes may be quite long, the lances 62 need to advance further into the bores of the tubes to ensure that the tubes are thoroughly cleaned. In order to advance the lances 62 further into the tube bores, translation mechanism 68 continues to operate to advance platform 70 toward heat exchanger 104. Referring to FIG. 18A-FIG. 20, when the platform 70 moves down the track 12H from the rear end 10B toward the front end 10A in the direction "B", the pusher 64D (FIG. 9B) on platform 70 makes contact with the rear 29D (FIG. 7) of the plate 29 of tenth trolley 58. This contact is operative to dislodge the magnetic boss 43D on tenth trolley 58 from the opening 60M (FIG. 8A) of tenth rail stop 60. As drive gear 68C continues to rotate, the platform 70 and tenth trolley 58 continue to move in the direction of arrow "B" because the wheels 70B of platform 70 and wheels 31 of tenth trolley 58 ride along upper edge 12E.

Figure 17B:
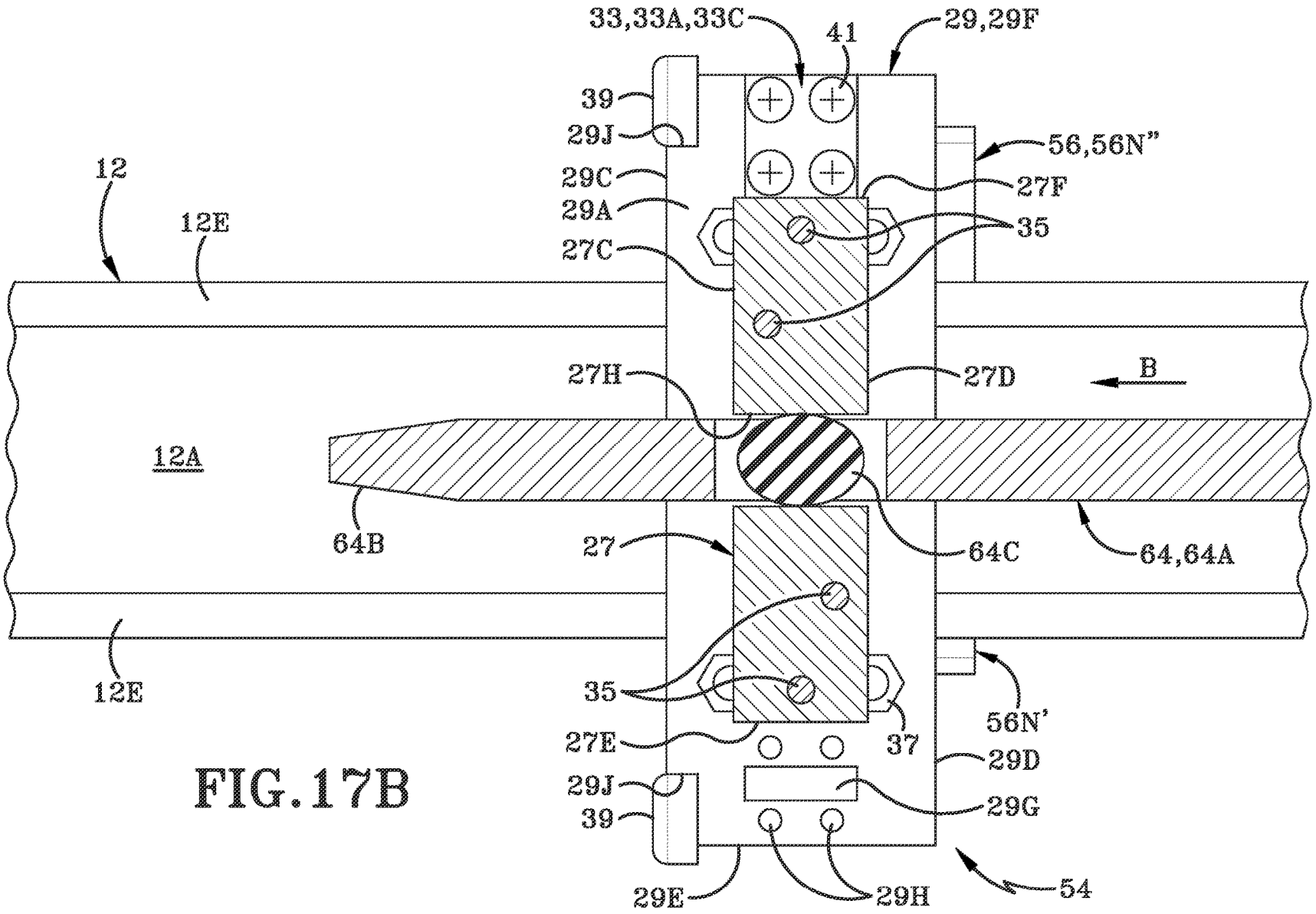
FIG. 17B is a partial cross-section of the ninth trolley similar to FIG. 17A but showing the puck being deformed as it moves through the channel defined in the ninth trolley.
Figure 17C:
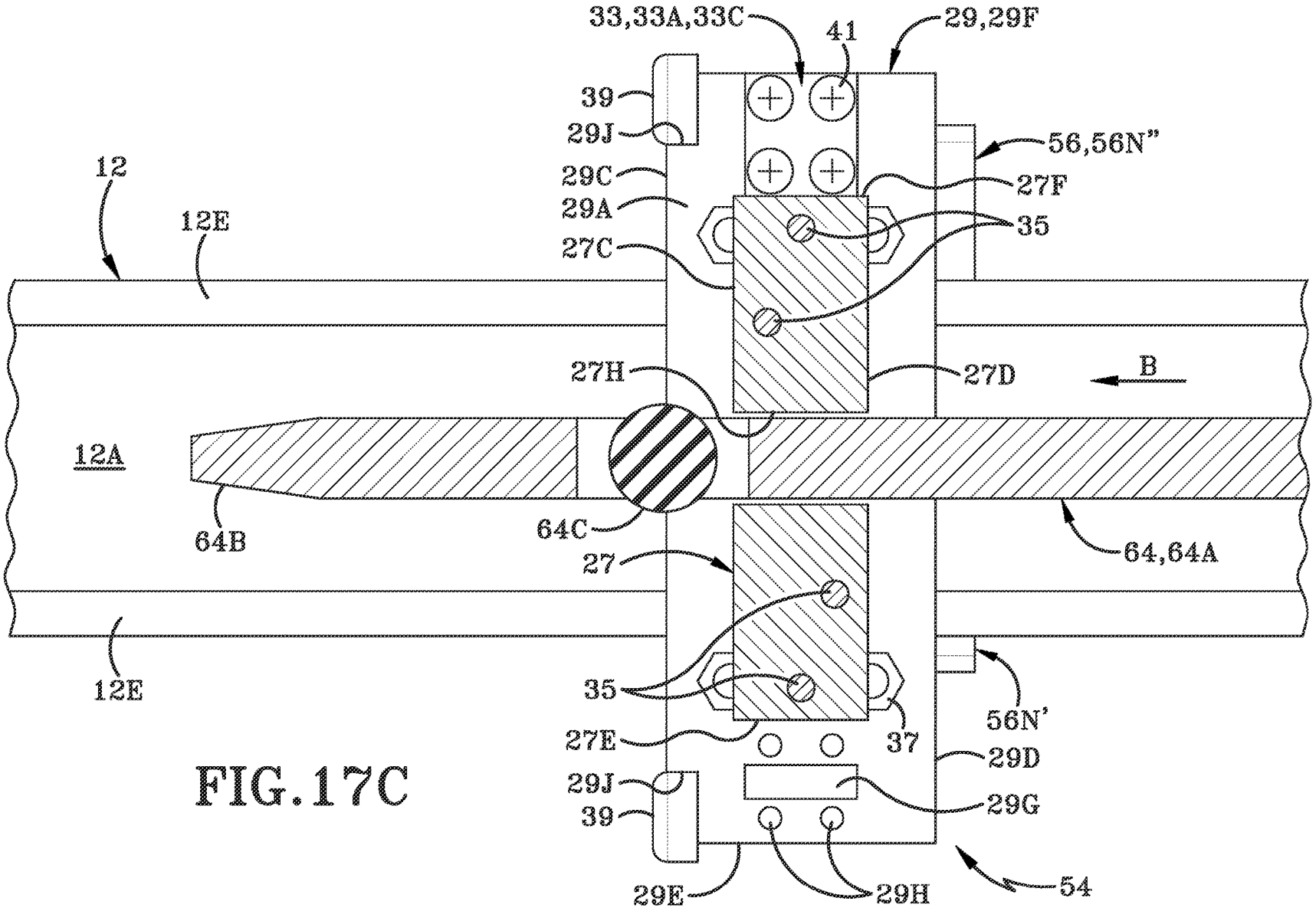
FIG. 17C is a partial cross-section of the ninth trolley similar to FIGS. 17A and 17B showing the puck returned to its non-deformed state.

Pusher 64D forces tenth trolley 58 forwardly in the direction of arrow "B" and, substantially simultaneously, stacker 64 itself moves in the direction arrow "B" and tip 64B thereof moves through the channel 27H of ninth trolley until puck 64C contacts a region of back 27D of ninth trolley 54 and applies force thereto. Continued forward motion of platform 70 and therefore of stacker 64 will cause shaft 64A of stacker and the puck 64C engaged therewith through channel 27H. Puck 64C deforms as shown in FIG. 17B until the puck 64C reaches front 27C of ninth trolley 54 and exits channel 27H. Puck 64C then returns to its non-deformed stated as shown in FIG. 17C.

Ultimately, the bumpers 39 on the moving tenth trolley 58 contact the rear 29D of the plate of ninth trolley 54. As the drive gear 68C continues to rotate, the force applied by the advancing platform 70 and the tenth trolley 58 is sufficient to break the magnetic engagement of boss 43D on ninth trolley 56 with the associated magnet on the ninth rail stop 56 and the ninth trolley 54 will begin to move linearly along rail 12 towards front end 10A. The tenth trolley 58 is able to easily pass over the ninth rail stop 56 because most of the ninth rail stop 56 is on the right side 12D of the rail and the arm 33 of the tenth trolley 58 is on the left side 12C of the rail 12. The portion of the ninth rail stop 56 that is on the left side 12C of the rail 12 is too short to contact arm 33 of tenth trolley 58. There is furthermore no part of the tenth trolley 58 that extends downwardly and contacts any part of the ninth rail stop 56 on the right side 12D of rail 12.

Figure 18A:
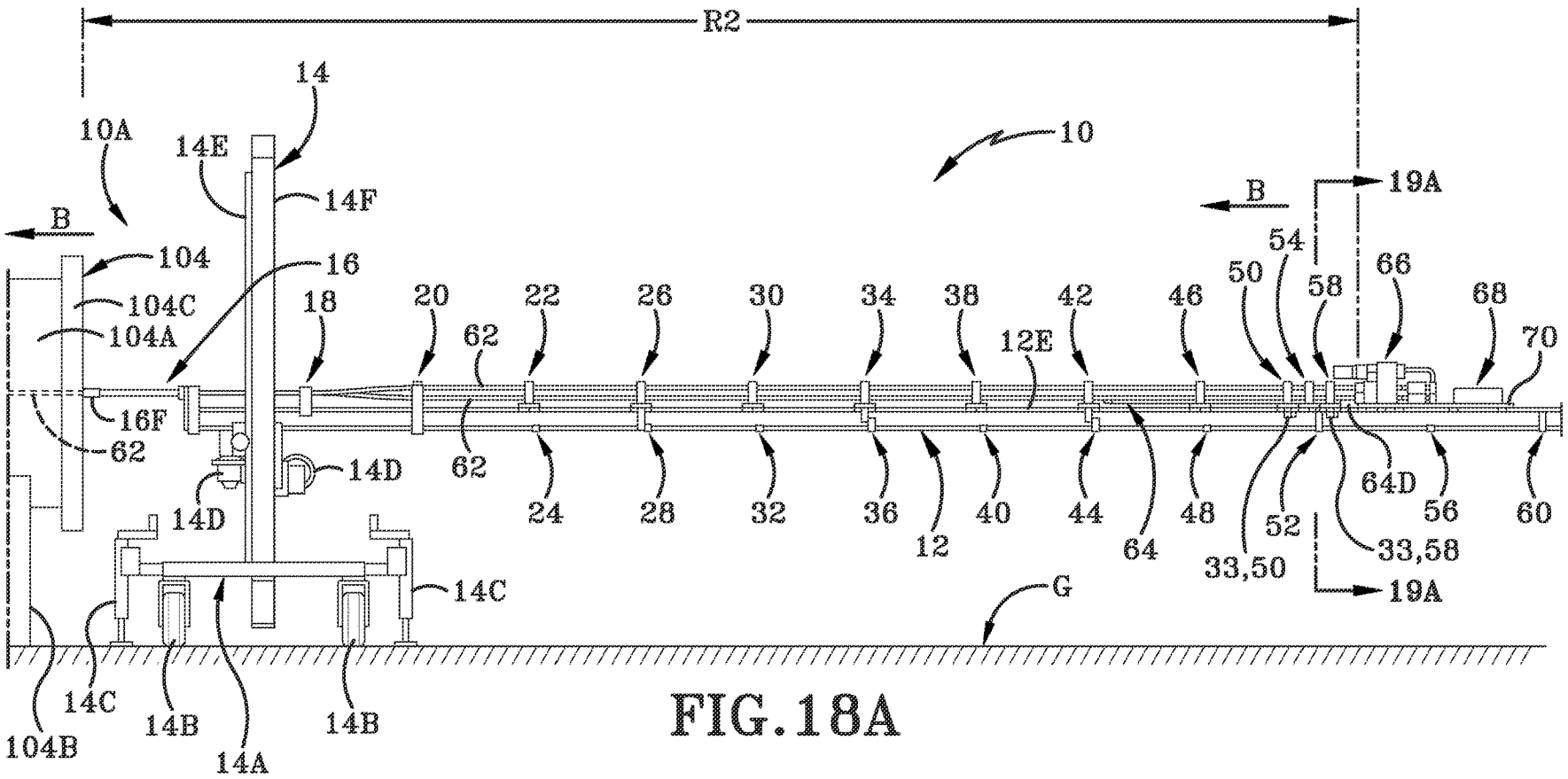
FIG. 18A is a left side elevation view of the exemplary lance cleaning system shown in operation and with the translation mechanism moved to a first position and the lances moved inwardly into the bores of tubes in the heat exchanger tube bundle.

As platform 70 continues to advance in the direction "B", the ninth trolley 54, (and the tenth trolley 58 which is retained with ninth trolley 54 on stacker 64) advances toward eighth trolley 50 and the associated eighth rail stop 52. The wheels 31 of ninth trolley 54 help to ensure smooth travel of ninth trolley 54 along rail 12. As ninth trolley 54 approaches eighth trolley 50, the tip 64B of the stacker 64 will begin to pass through the channel 27H of eighth trolley 50 and the puck 64C will deform as it enters channel 27H and then return to its original shape once puck 64C moves outwardly from channel 27H. (The deformation and then return of puck 64C to its original shape occurs every time a new trolley is engaged on stacker 64.) Bumpers 39 of ninth trolley 54 contact rear 29D of the plate 29 on eighth trolley 50. As a result of the contact, the magnetic attraction between the magnetic boss 43D on eighth trolley 50 and the magnet 49 on eighth rail stop 52 is broken and eighth trolley 50 begins to move in the direction "B". This situation is shown in FIG. 18A. Wheels 31 on eighth trolley 50 are operative to move along the edges 12E of the rail 12 and tip 64B of stacker 64 will pass through the channel 27H of the eighth trolley 50. Since the arm 33 of the ninth trolley 54 is located adjacent the right side 12D of rail 12, no part of the ninth trolley 54 extends downwardly to contact the eighth rail stop 52 which is located adjacent left side 12C of rail 12. Consequently, ninth trolley 54 moves easily past eighth rail stop 52.

Figure 19A:
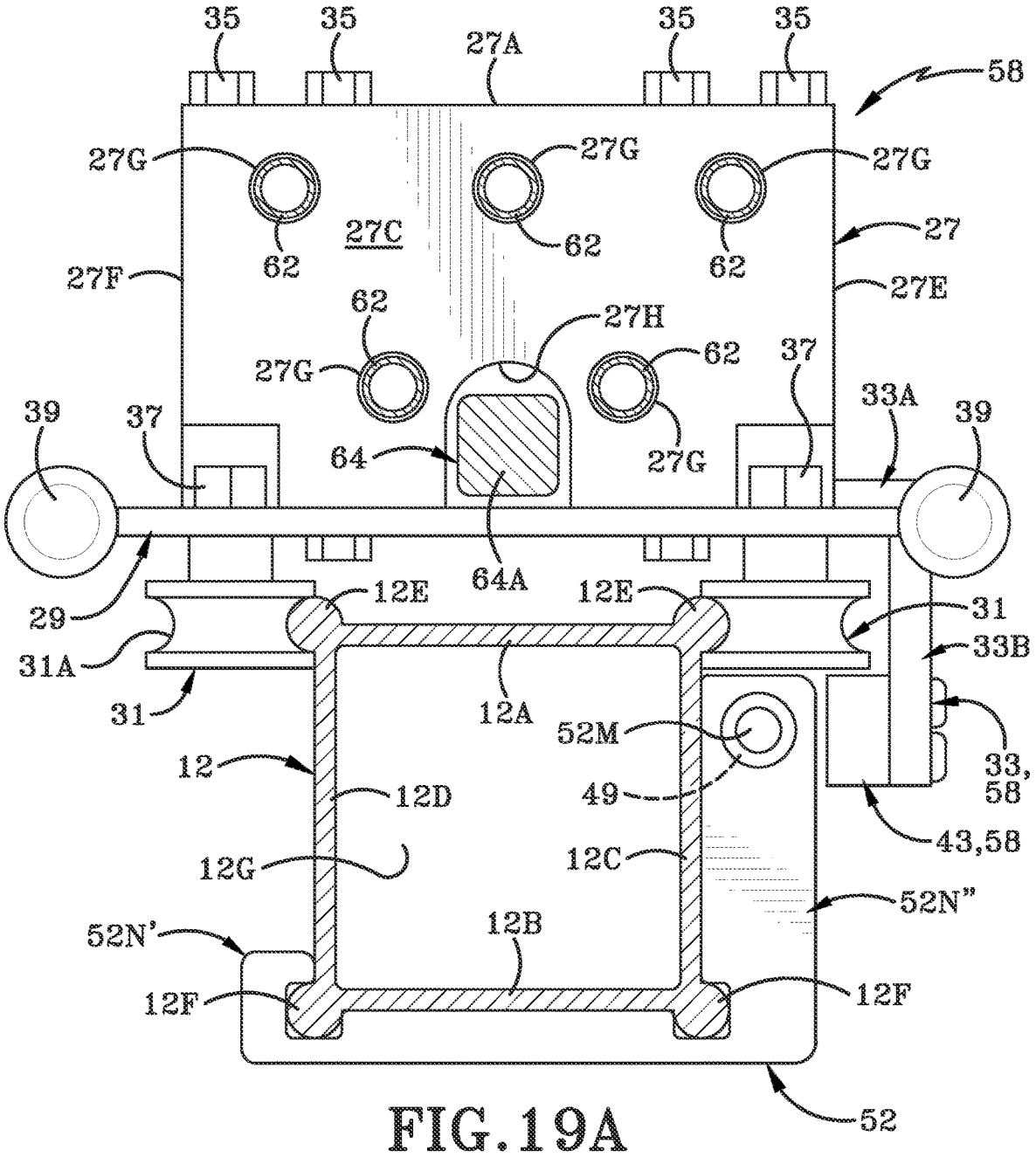
FIG. 19A is a partial cross-section of a tenth trolley of the lance cleaning system shown engaged with the rail and taken along line 19A-19A of FIG. 18A.

The arm 33 of tenth trolley 58 is located adjacent left side 12C of rail 12 and does extend downwardly to the point that it might look as if the eighth rail stop 52 might impede the movement of tenth trolley 58. However, as is illustrated in FIG. 19A and has been discussed earlier herein with respect to FIG. 8B), the shape and width of the second region 52N" is such that arm 33 of tenth trolley 58 does not actually come into contact with second region 52N". Tenth trolley 58 is therefore able to move unimpeded past eighth rail stop 52.

FIG. 18A also shows that tenth trolley 58, ninth trolley 54, and eighth trolley 50 have become stacked upon the stacker 64 and the spacing between these stacked trolleys has been substantially reduced relative to the initial spacing therebetween shown in FIG. 16. Additionally, the distance between the nosepieces 16F and the front of platform 70 has been reduced from a distance R1 to a distance R2. The actual length of the lances 62 has not been reduced but, instead, a length of R1-R2 of the lances 62 has been advanced into the bores of the tubes in the heat exchanger.

As drive gear 68C continues to advance along track 12H toward front end 10A of system 10, eighth trolley 50 (along with tenth and ninth trolleys 58, 54 on stacker 64) moves forwardly in the direction of arrow "B" until bumpers 39 on eighth trolley 50 make contact with rear 29D of plate 29 on seventh trolley 46. As a result of this contact, the magnetic attraction between the magnetic boss 43D on seventh trolley 46 and the magnet 49 on seventh rail stop 48 is broken and seventh trolley 46 begins to move in the direction of arrow "B". Wheels 31 on seventh trolley 46 are operative to move along the edges 12E of the rail 12 and tip 64B of stacker 64 will pass through the channel 27H of the seventh trolley 46. Since the arm 33 of the eighth trolley 50 is located adjacent the left side 12C of rail 12, no part of the eighth trolley 50 extends downwardly to contact the seventh rail stop 48 which is located adjacent right side 12D of rail 12. Consequently, eighth trolley 54 moves easily past seventh rail stop 48. As described earlier herein with respect to FIGS. 8A-8F, all of the trollies located rearwardly of the eighth trolley 50, i.e., trollies 58 and 54 are also able to readily move past seventh rail stop 48.

Figure 18B:
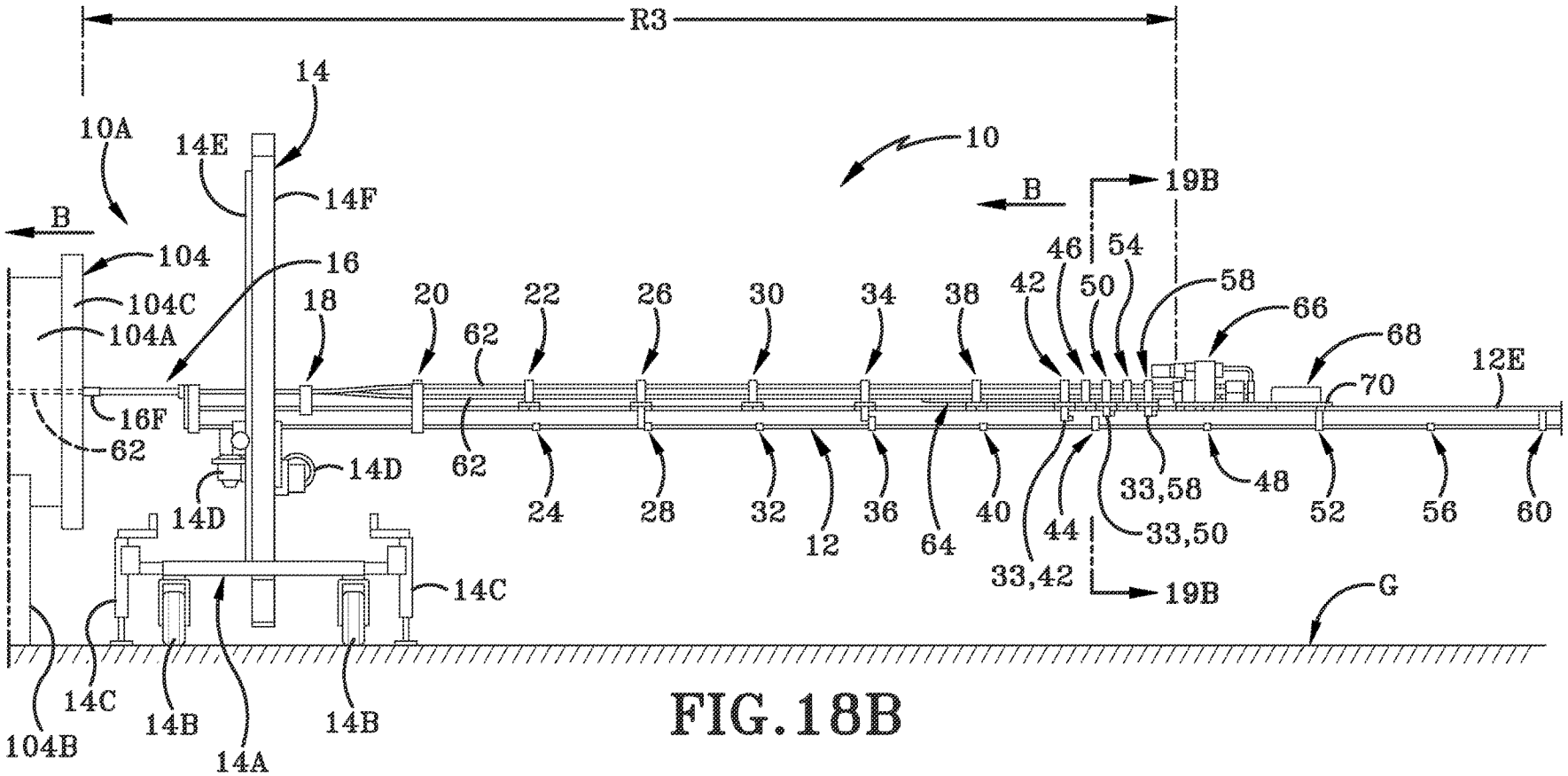
FIG. 18B is a left side elevation view of the exemplary lance cleaning system shown in operation and with the translation mechanism moved to a second position and advancing the lances further inwardly into the bores of tubes in the heat exchanger tube bundle.

Wheels 31 on seventh trolley 46 help the trolley to move along rail 12 in the direction of arrow "B" toward sixth trolley 42 and sixth rail stop 44 until bumpers 39 on seventh trolley 46 contact rear 29D of the plate 29 of sixth trolley 42. As seventh trolley 46 approaches sixth trolley 44, the tip 64B of the stacker 64 will begin to pass through the channel 27H of sixth trolley 44. (It should be noted that all of the tenth trolley 58, ninth trolley 54, eighth trolley 50, and seventh trolley 46 are carried on the shaft 64A of stacker 64 and moved in unison with platform 70 as it moves toward front end 10A.) As a result of the contact between bumpers 39 of seventh trolley 46 and plate 29 of sixth trolley 42, the magnetic attraction between the magnetic boss 43D on sixth trolley 42 and the magnet 49 on sixth rail stop 44 is broken and sixth trolley 42 begins to move in the direction "B". This situation is shown in FIG. 18B. Since the arm 33 of the seventh trolley 46 is located adjacent the right side 12D of rail 12, no part of the seventh trolley 46 extends downwardly to contact the sixth rail stop 42 which is located adjacent left side 12C of rail 12. Consequently, seventh trolley 46 moves easily past sixth rail stop 42.

Figure 19B:
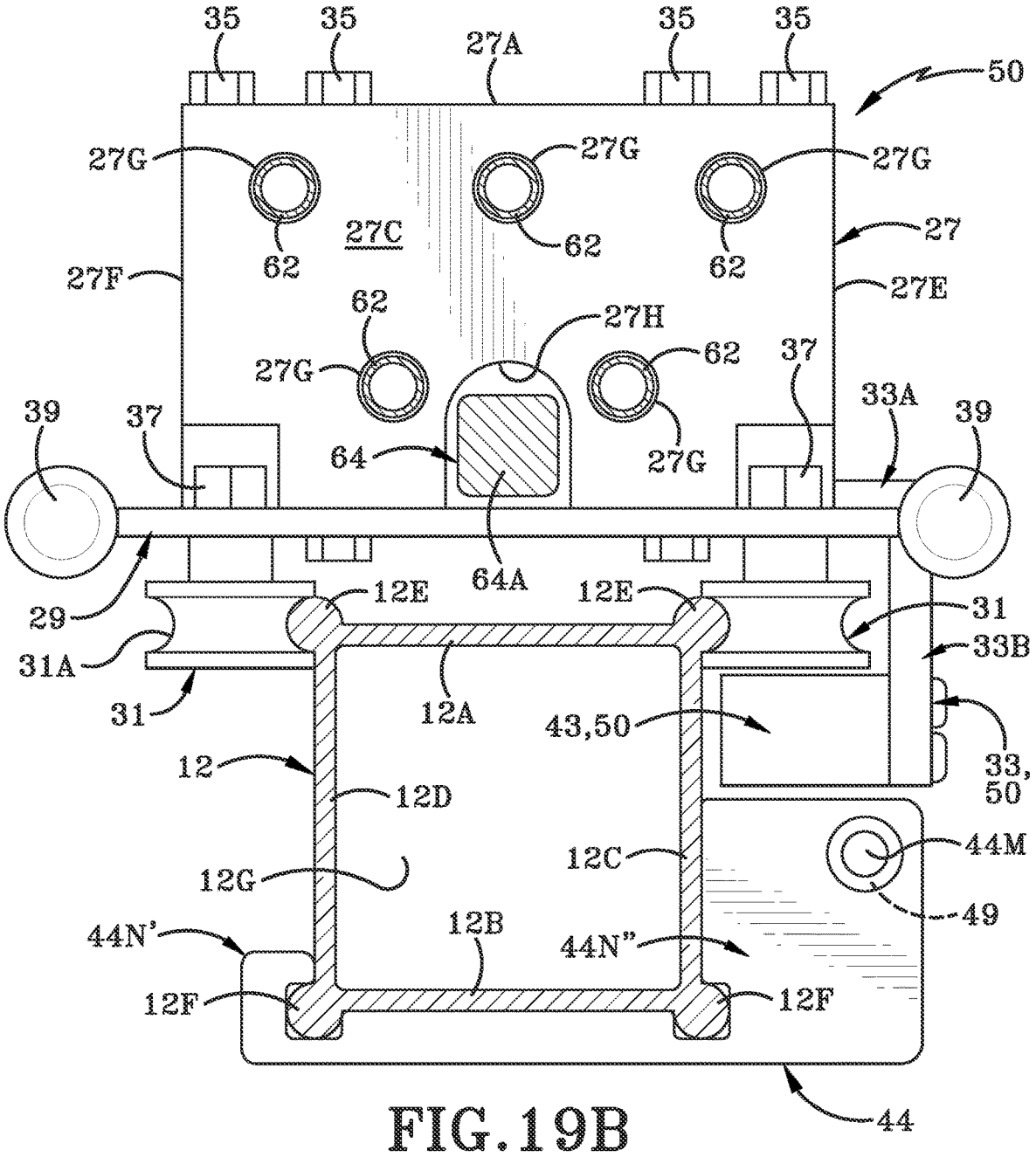
FIG. 19B is a partial cross-section of an eighth trolley of the lance cleaning system shown engaged with the rail and taken along line 19B-19B in FIG. 18B.

The arm 33 of eighth trolley 50 is located adjacent left side 12C of rail 12 and does extend downwardly to the point that it might look as if the sixth rail stop 44 might impede the movement of eighth trolley 50. However, as is illustrated in FIG. 19B and has been discussed earlier herein with respect to FIG. 8C), the shape and width of the second region 44N"" is such that arm 33 of eighth trolley 50 does not actually come into contact with second region 44N". Eighth trolley 50 and both of the ninth trolley 54 and tenth trolley 58 are therefore able to move unimpeded past sixth rail stop 44.

FIG. 18B also shows that tenth trolley 58, ninth trolley 54, eighth trolley 50, seventh trolley 46, and the sixth trolley 46 have become stacked upon the stacker 64 and the spacing between these stacked trolleys has been substantially reduced relative to the initial spacing therebetween shown in FIG. 16. Additionally, the distance between the nosepieces 16F and the front of platform 70 has been further reduced from the distance R2 to a distance R3. Again, the length of the lances 62 has not been reduced but, instead, a length of R1-R3 of the lances 62 has been advanced in the direction "B" into the bores of the tubes in the heat exchanger 104.

As drive gear 68C continues to advance along track 12H toward front end 10A of system 10, sixth trolley 46 (and all the rest of the trolleys stacked on stacker 64) moves forwardly in the direction of arrow "B" until bumpers 39 on sixth trolley 46 make contact with rear 29D of plate 29 on fifth trolley 38. As a result of this contact, the magnetic attraction between the magnetic boss 43D on fifth trolley 38 and the magnet 49 on fifth rail stop 40 is broken and fifth trolley 38 begins to move in the direction of arrow "B". Wheels 31 on fifth trolley 38 are operative to move along the edges 12E of the rail 12 and tip 64B of stacker 64 will pass through the channel 27H of the fifth trolley 38. Since the arm 33 of the sixth trolley 50 is located adjacent the left side 12C of rail 12, no part of the sixth trolley 50 extends downwardly to contact the fifth rail stop 40 which is located adjacent right side 12D of rail 12. Consequently, sixth trolley 42 moves easily past fifth rail stop 40. As described earlier herein with respect to FIGS. 8A-8F, all of the trollies located rearwardly of the sixth trolley 50 are also able to readily move past fifth rail stop 40.

Figure 18C:
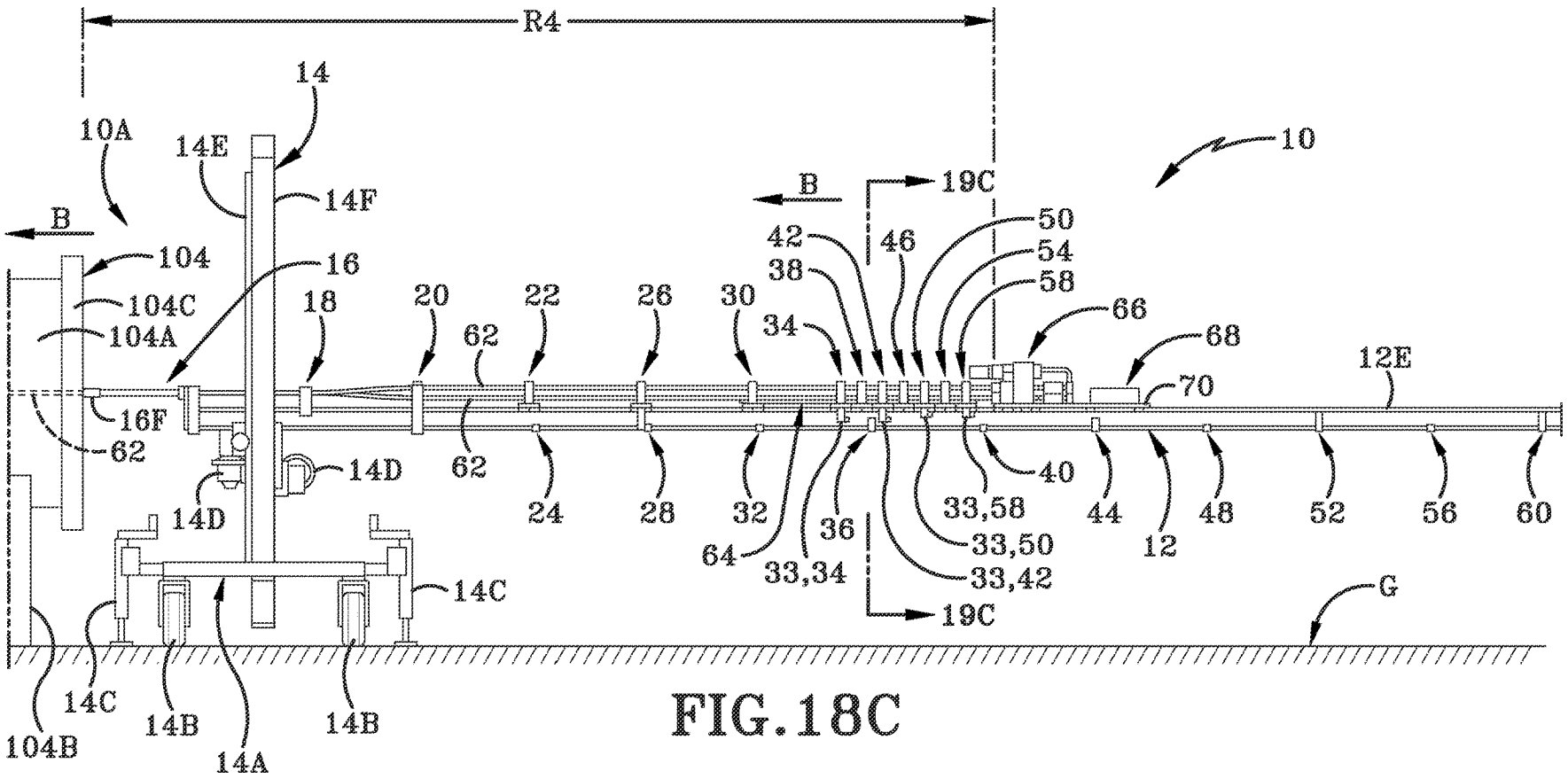
FIG. 18C is a left side elevation view of the exemplary lance cleaning system shown in operation and with the translation mechanism moved to a third position and advancing the lances still further inwardly into the tube bores.

Wheels 31 on fifth trolley 38 help the trolley to move along rail 12 in the direction of arrow "B" toward fourth trolley 34 and fourth rail stop 36 until bumpers 39 on fifth trolley 38 contact rear 29D of the plate 29 of fourth trolley 34. As fifth trolley 38 approaches fourth trolley 34, the tip 64B of the stacker 64 will begin to pass through the channel 27H of fourth trolley 34. (It should be noted that all of the tenth trolley 58, ninth trolley 54, eighth trolley 50, seventh trolley 46, sixth trolley 42, and fifth trolley 38 are carried on the shaft 64A of stacker 64 as platform 70 moves toward front end 10A.) As a result of the contact between bumpers 39 of fifth trolley 38 and plate 29 of fourth trolley 34, the magnetic attraction between the magnetic boss 43D on fourth trolley 34 and the magnet 49 on fourth rail stop 36 is broken and fourth trolley 34 begins to move in the direction "B". This situation is shown in FIG. 18C. Since the arm 33 of the fifth trolley 38 is located adjacent the right side 12D of rail 12, no part of the fifth trolley 38 extends downwardly to contact the fourth rail stop 36 which is located adjacent left side 12C of rail 12. Consequently, fifth trolley 38 moves easily past fourth rail stop 36.

Figure 19C:
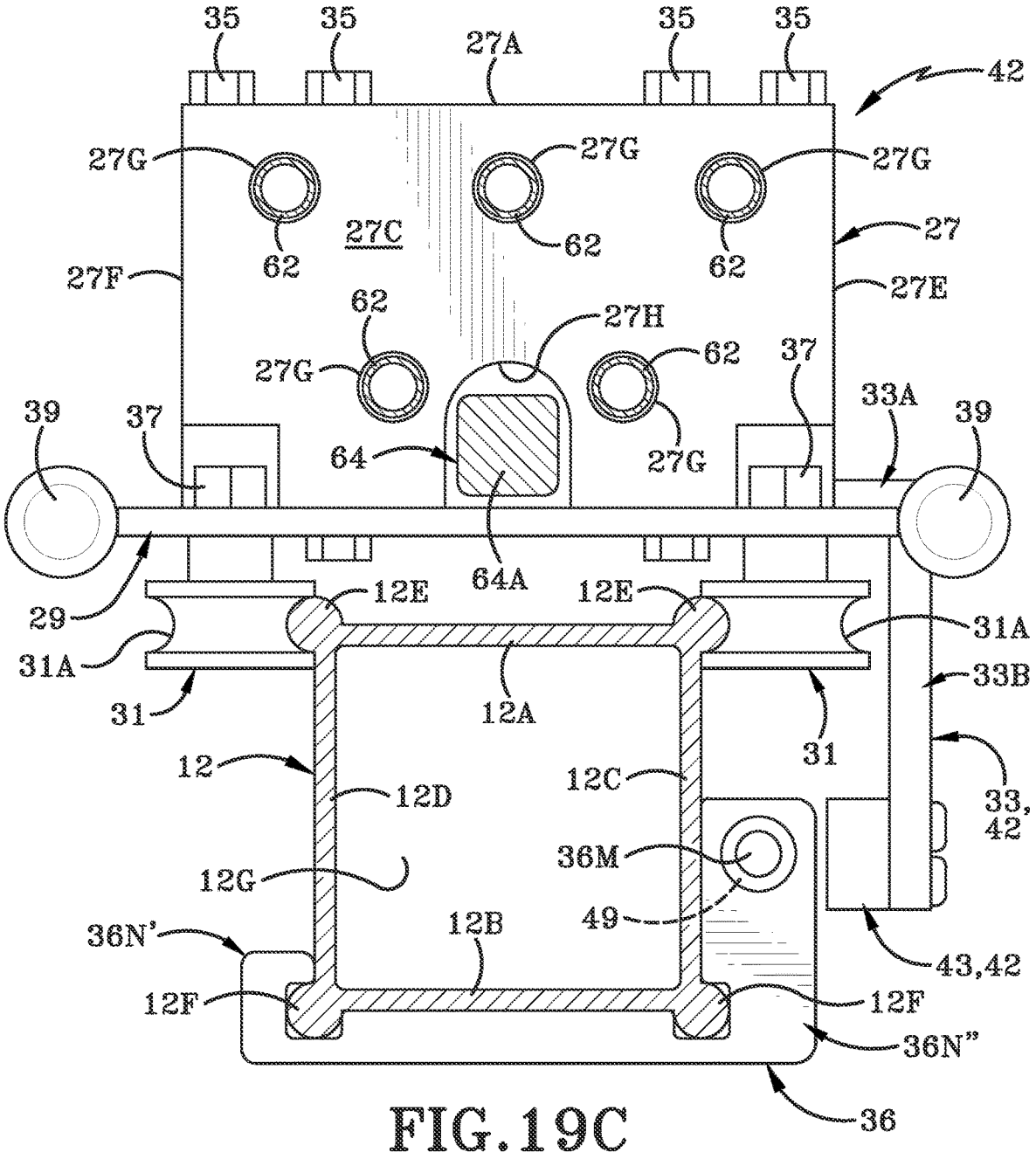
FIG. 19C is a partial cross-section of a sixth trolley of the lance cleaning system shown engaged with the rail and taken along line 19C-19C in FIG. 18C.

The arm 33 of sixth trolley 42 is located adjacent left side 12C of rail 12 and does extend downwardly to the point that it might look as if the fourth rail stop 36 might impede the movement of sixth trolley 42. However, as is illustrated in FIG. 19C and has been discussed earlier herein with respect to FIG. 8D), the shape and width of the second region 36N"" is such that arm 33 of sixth trolley 50 does not actually come into contact with second region 36N". Sixth trolley 42 and all the trollies located rearwardly thereof to the tenth trolley 58 are therefore able to move unimpeded past fourth rail stop 36.

FIG. 18C also shows that tenth trolley 58, ninth trolley 54, eighth trolley 50, seventh trolley 46, the sixth trolley 46, fifth trolley 38, and fourth trolley 34 have become stacked upon the stacker 64 and the spacing between these stacked trolleys has been substantially reduced relative to the initial spacing therebetween shown in FIG. 16. Additionally, the distance between the nosepieces 16F and the front of platform 70 has been further reduced from the distance R3 to a distance R4. Again, the length of the lances 62 has not been reduced but, instead, a length of R1-R4 of the lances 62 has been advanced in the direction "B" into the bores of the tubes in the heat exchanger 104.

As drive gear 68C continues to advance along track 12H toward front end 10A of system 10, fourth trolley 34 (and all the rest of the trolleys stacked on stacker 64) moves forwardly in the direction of arrow "B" until bumpers 39 on fourth trolley 34 make contact with rear 29D of plate 29 on third trolley 30. As a result of this contact, the magnetic attraction between the magnetic boss 43D on third trolley 30 and the magnet 49 on third rail stop 32 is broken and third trolley 30 begins to move in the direction of arrow "B". Wheels 31 on third trolley 30 are operative to move along the edges 12E of the rail 12 and tip 64B of stacker 64 will pass through the channel 27H of the third trolley 30. Since the arm 33 of the fourth trolley 34 is located adjacent the left side 12C of rail 12, no part of the fourth trolley 34 extends downwardly to contact the third rail stop 32 which is located adjacent right side 12D of rail 12. Consequently, fourth trolley 34 moves easily past third rail stop 32. As described earlier herein with respect to FIGS. 8A-8F, all of the trollies located rearwardly of the fourth trolley 34 are also able to readily move past third rail stop 32.

Figure 18D:
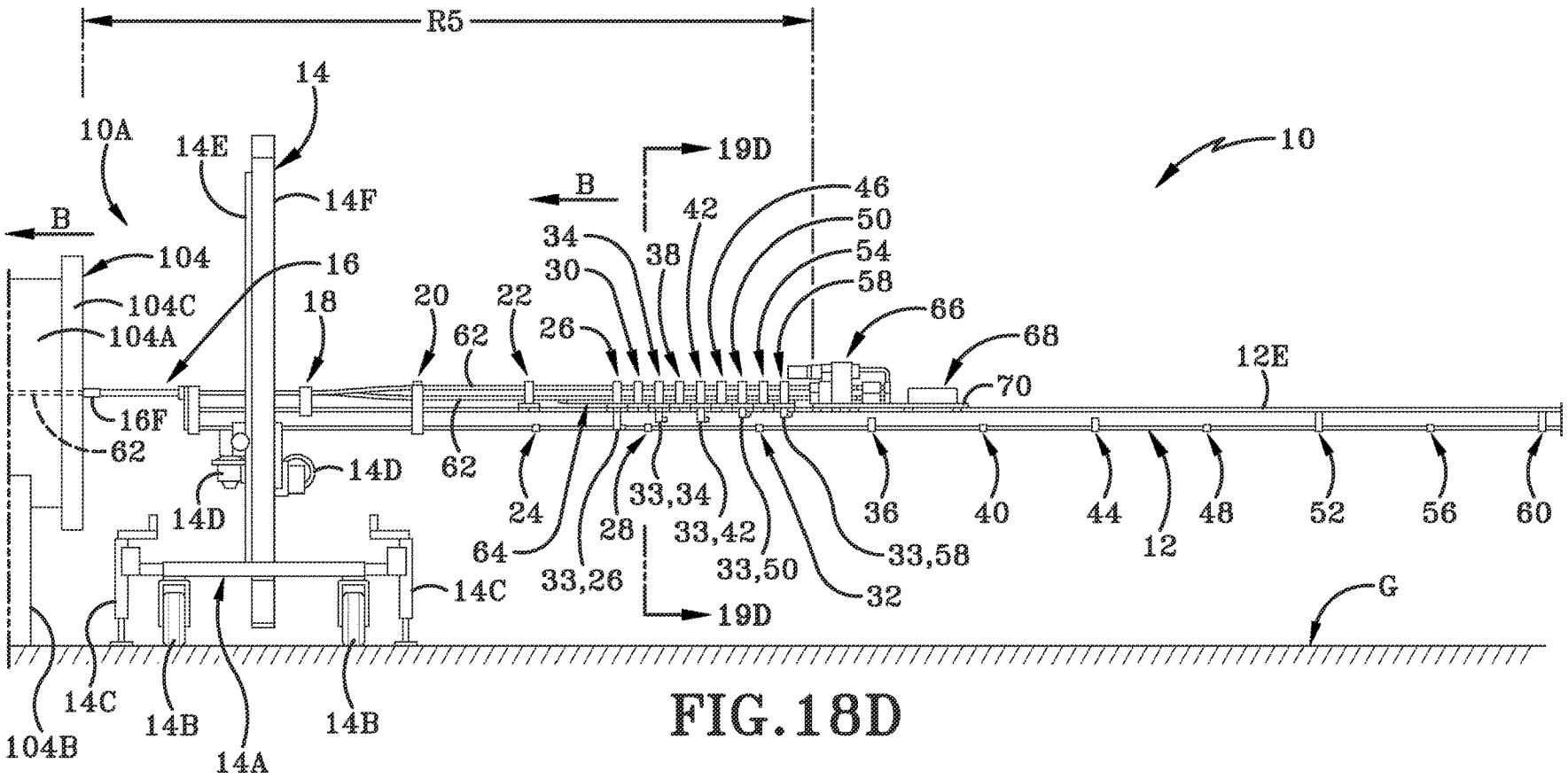
FIG. 18D is a left side elevation view of the exemplary lance cleaning system shown in operation and with the translation mechanism moved to a fourth position and advancing the lances still further inwardly into the tube bores.

Wheels 31 on third trolley 30 help the trolley to move along rail 12 in the direction of arrow "B" toward second trolley 26 and second rail stop 28 until bumpers 39 on third trolley 30 contact rear 29D of the plate 29 of second trolley 26. As third trolley 30 approaches second trolley 26, the tip 64B of the stacker 64 will begin to pass through the channel 27H of second trolley 26. (It should be noted that all of the tenth trolley 58, ninth trolley 54, eighth trolley 50, seventh trolley 46, sixth trolley 42, fifth trolley 38, fourth trolley 34, and third trolley 30 are carried on the shaft 64A of stacker 64 as platform 70 moves toward front end 10A.) As a result of the contact between bumpers 39 of third trolley 30 and plate 29 of second trolley 26, the magnetic attraction between the magnetic boss 43D on second trolley 26 and the magnet 49 on second rail stop 28 is broken and second trolley 26 begins to move in the direction "B". This situation is shown in FIG. 18D. Since the arm 33 of the third trolley 30 is located adjacent the right side 12D of rail 12, no part of the third trolley 30 extends downwardly to contact the second rail stop 28 which is located adjacent left side 12C of rail 12. Consequently, third trolley 30 moves easily past second rail stop 28.

Figure 19D:
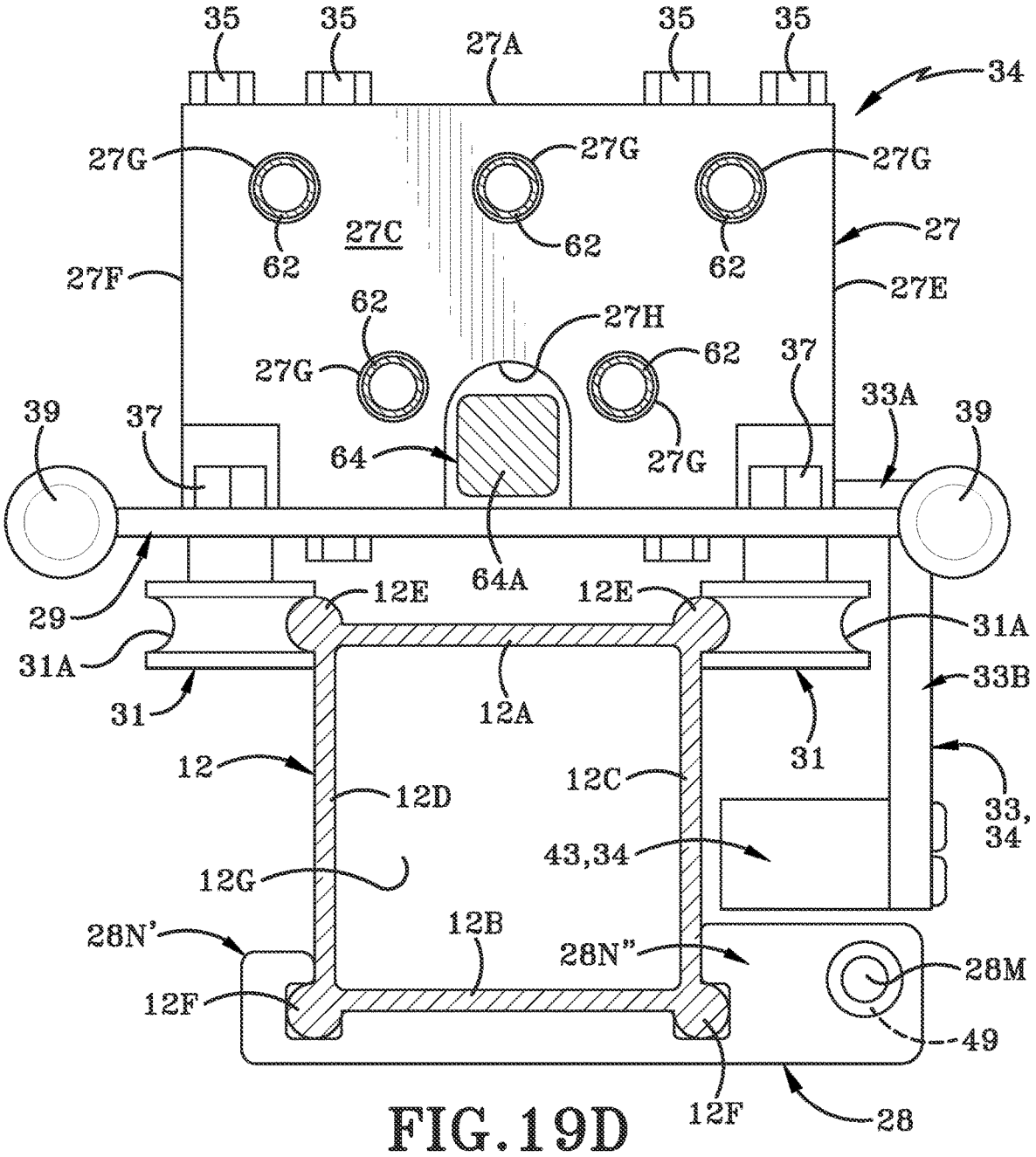
FIG. 19D is a partial cross-section of a fourth trolley of the lance cleaning system shown engaged with the rail and taken along line 19D-19D in FIG. 18D.

The arm 33 of fourth trolley 34 is located adjacent left side 12C of rail 12 and does extend downwardly to the point that it might look as if the second rail stop 28 might impede the movement of fourth trolley 34. However, as is illustrated in FIG. 19D and has been discussed earlier herein with respect to FIG. 8E), the shape and width of the second region 28N"" is such that arm 33 of fourth trolley 34 does not actually come into contact with second region 28N". Fourth trolley 34 and all the trollies located rearwardly thereof to the tenth trolley 58 are therefore able to move unimpeded past second rail stop 28.

FIG. 18D also shows that tenth trolley 58, ninth trolley 54, eighth trolley 50, seventh trolley 46, sixth trolley 46, fifth trolley 38, fourth trolley 34, third trolley 30, and second trolley 26 have become stacked upon the stacker 64 and the spacing between these stacked trolleys has been substantially reduced relative to the initial spacing therebetween shown in FIG. 16. Additionally, the distance between the nosepieces 16F and the front of platform 70 has been further reduced from the distance R4 to a distance R5. Again, the length of the lances 62 has not been reduced but, instead, a length of R1-R5 of the lances 62 has been advanced in the direction "B" into the bores of the tubes in the heat exchanger 104.

As drive gear 68C continues to advance along track 12H toward front end 10A of system 10, second trolley 26 (and all the rest of the trolleys stacked on stacker 64) moves forwardly in the direction of arrow "B" until bumpers 39 on second trolley 26 make contact with rear 29D of plate 29 on first trolley 22. As a result of this contact, the magnetic attraction between the magnetic boss 43D on first trolley 22 and the magnet 49 on first rail stop 24 is broken and first trolley 22 begins to move in the direction of arrow "B" and towards lance guide 20. Wheels 31 on first trolley 22 are operative to move along the edges 12E of the rail 12 and tip 64B of stacker 64 will pass through the channel 27H of the first trolley 22. Since the arm 33 of the second trolley 26 is located adjacent the left side 12C of rail 12, no part of the second trolley 26 extends downwardly to contact the first rail stop 24 which is located adjacent right side 12D of rail 12. Consequently, second trolley 26 moves easily past first rail stop 24. As described earlier herein with respect to FIGS.

8A-8F, all of the trollies located rearwardly of the second trolley 26 are also able to readily move past first rail stop 24.

Figure 18E:
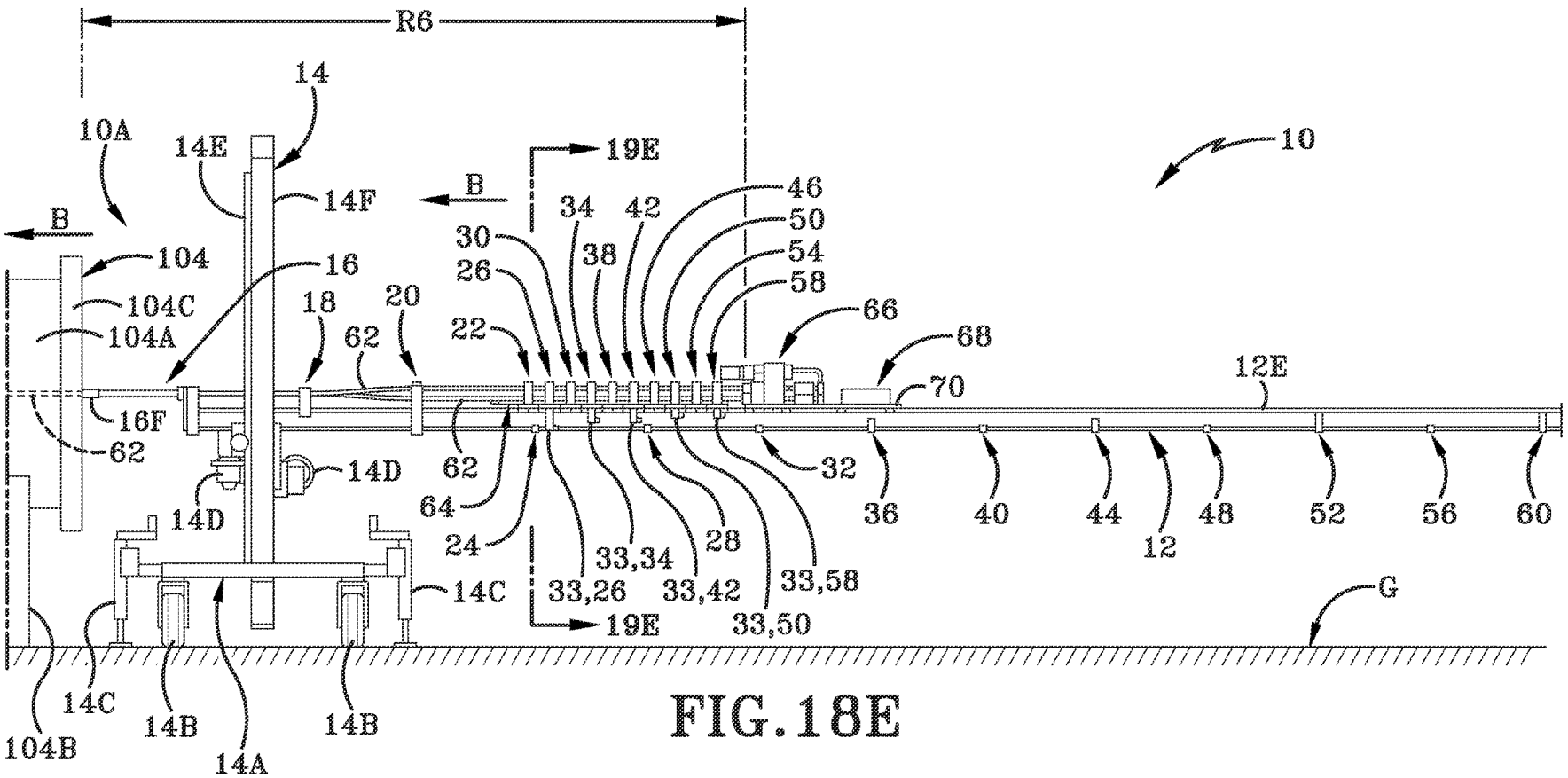
FIG. 18E is a left side elevation view of the exemplary lance cleaning system shown in operation and with the translation mechanism moved to a fifth position and advancing the lances further inwardly into the tube bores.
Figure 18F:
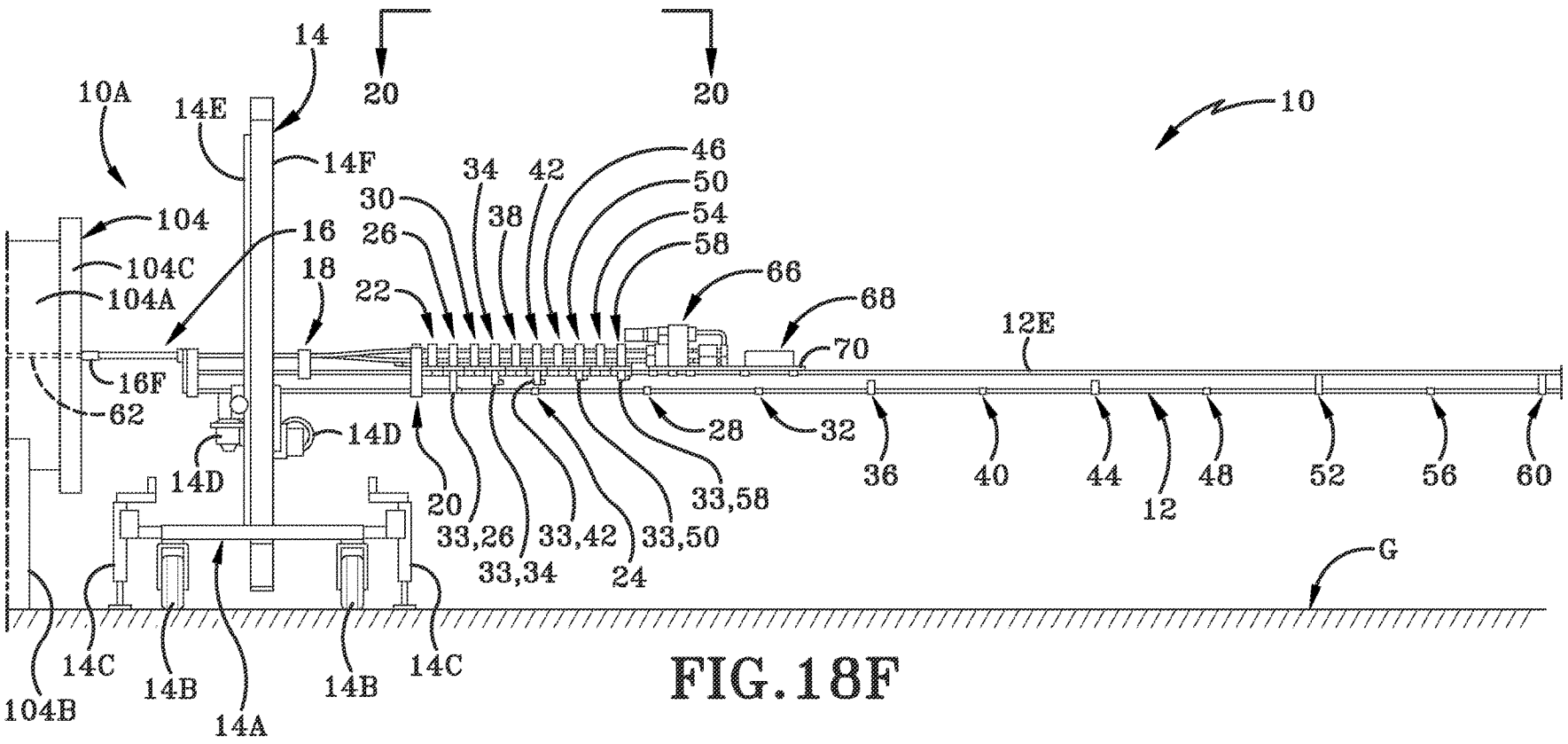
FIG. 18F is a left side elevation view of the exemplary lance cleaning system shown in operation and with the translation mechanism moved to a sixth position where the lances have been fully advanced into the heat exchanger and the trolley assemblies are all stacked onto a stacker of the lance cleaning system.

FIG. 18E shows that all of the trolleys 22-58 are engaged on stacker 64 and that the first trolley 22 is located a distance rearwardly from lance guide 20. Additionally, the distance between the nosepieces 16F and the front of platform 70 has been further reduced from the distance R5 to a distance R6. Again, the length of the lances 62 has not been reduced but, instead, a length of R1-R6 of the lances 62 has been advanced in the direction "B" into the bores of the tubes in the heat exchanger 104.

Figure 19E:
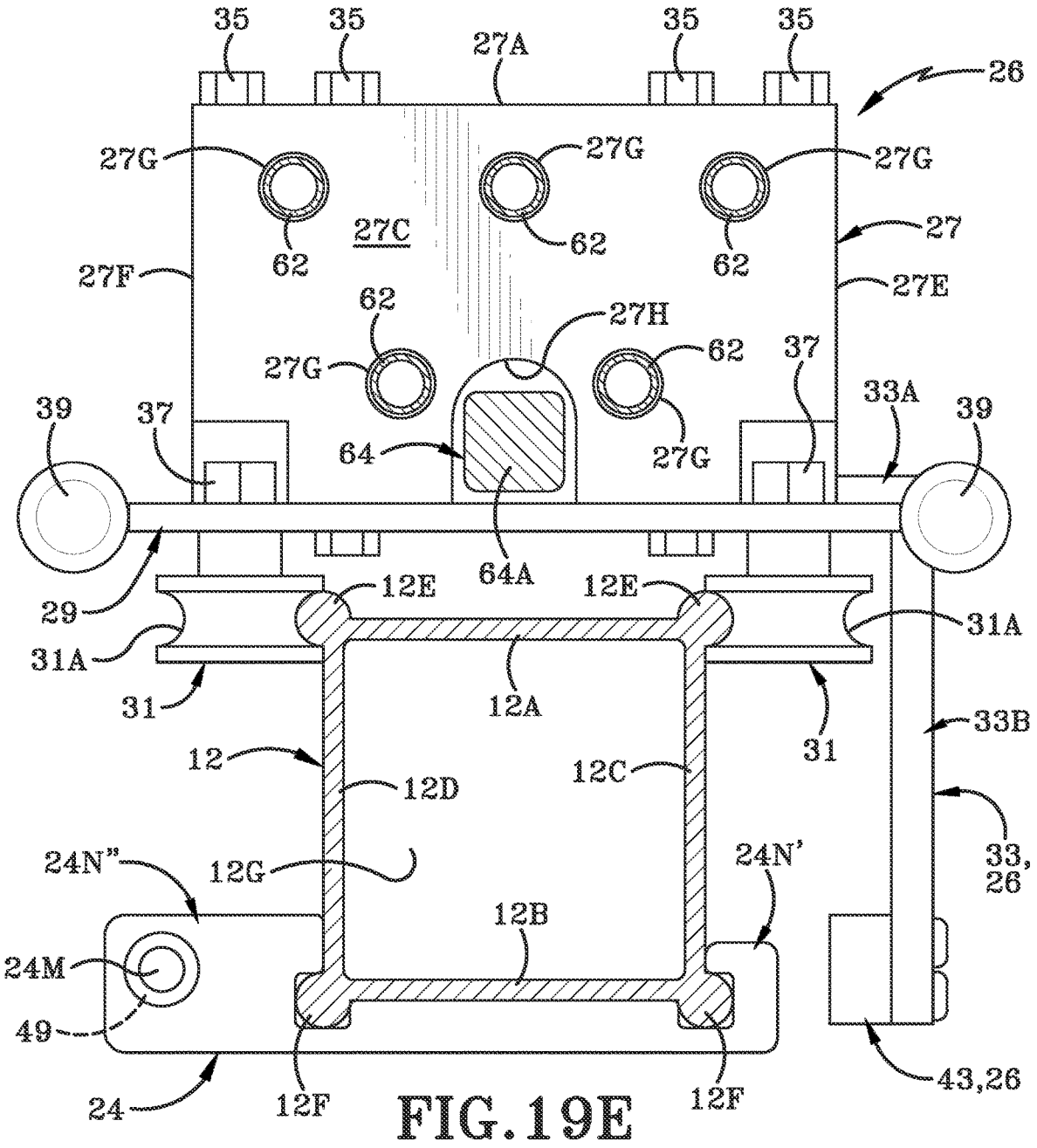
FIG. 19E is a partial cross-section of a second trolley of the lance cleaning system shown engaged with the rail and taken along line 19E-19E in FIG. 18E

FIG. 19E shows why the second trolley 26 is able to move past the first rail stop 24. As is evident from this figures, the first region 24N' of the first rail stop 24 is located adjacent the left side 12C of rail 12. Arm 33 of second trolley 26 is laterally spaced from first region 24N' and therefore the first region 24N' cannot impede the forward movement of second trolley 26 past first rail stop 24. Additionally, the figure shows that the second region 24N" of first rail stop 24 which includes the magnet 49, is nowhere near where it needs to be to magnetically engage the magnetic boss on locking member 43 of second trolley 26.

Figure 20:
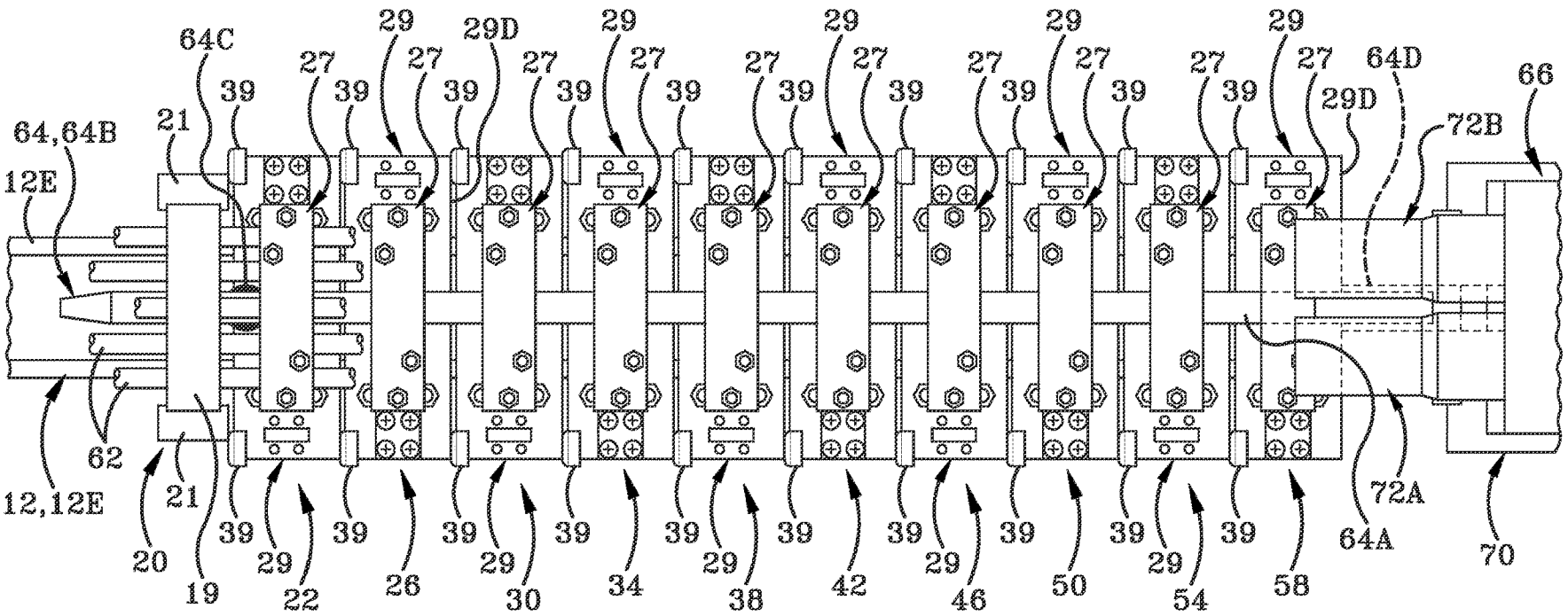
FIG. 20 is a top plan view of the stacked trolleys of the lance cleaning system taken along line 20-20 of FIG. 18F.

As drive gear 68C continues to advance along track 12H toward front end 10A of system 10, first trolley 22 (and all the rest of the trolleys stacked on stacker 64) moves forwardly in the direction of arrow "B" until bumpers 39 on first trolley 26 make contact with rear 29D of plate 29 on lance guide 20. As a result of this contact all forward motion in the direction of arrow "B" (FIG. 18F) is halted. The tip 64B of stacker 64 moves through the channel 19H of lance guide 20. All of the trolleys 22-58 are stacked on stacker 64 and are retained between lance guide 20 and rotation mechanism 6 as can be seen in FIG. 20. Through the movement of first trolley 22 forwardly toward lance guide 20, the distance between the nosepieces 16F and the front of platform 70 has been further reduced from the distance R6 to a distance R7. Again, the length of the lances 62 has not been reduced but, instead, a length of R1-R7 of the lances 62 has been advanced in the direction "B" into the bores of the tubes in the heat exchanger 104. This is the maximum length of the lances 62 that can be inserted into the tube bores. As will be evident from this description, throughout the entire process of inserting a set of long-length lances 62 into the heat exchanger tubes, the lances 62 have been well supported and have not been inadvertently bent or curved while doing so. Additionally, the lances 62 have been well supported while performing a cleaning operation as they are inserted into the tubes of heat exchanger 104.

After fully inserting lances 62 entirely into the heat exchanger 104 and properly cleaning the elongated tubes therein, it may be desired to clean additional tubes of the heat exchanger 104. In order to do this the lances 62 must be retracted back into their original position (shown in FIG. 16). This occurs by reversing the process described above. To begin the reverse movement of the lances, i.e., in the direction of arrow "C" in FIGS. 21-23, the translation mechanism 68 must be actuated to cause the lances 62 and trollies 22-58 to be moved in the direction of arrow "C". This is accomplished by reversing the direction of rotation of drive shaft 84A and thereby the rotation of drive gear 68C. In other words, referring to FIG. 15, drive gear 68C is rotated in the opposite direction to arrow "A". The rotation of drive gear 68C in the opposite direction to arrow "A" causes the drive gear 68C to move along track 12H towards rear end 10B of system 10 and away from nosepieces 16F. As drive gear 68C moves in the direction "C" along track 12H, platform 70 is moved in the direction "C". Because stacker 64 is operatively engaged with translation mechanism 66 and platform 70, as translation mechanism 66 moves in the direction of arrow "C", stacker 64 is also moved in the direction of arrow "C".

Figure 21:
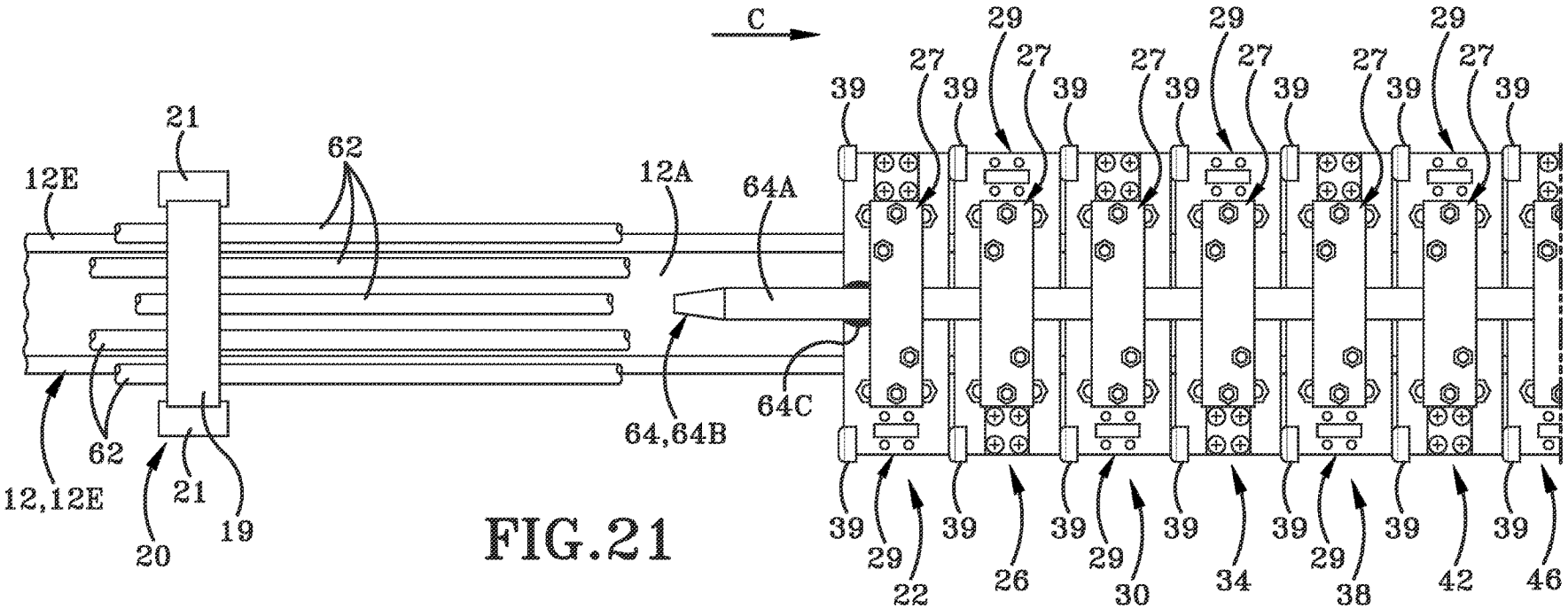
FIG. 21 is a top plan view of the stacked trollies of the lance cleaning system beginning to be move backwards by the stacker and in a direction away from the heat exchanger, and showing only part of the lances for clarity of illustration.
Figure 22A:
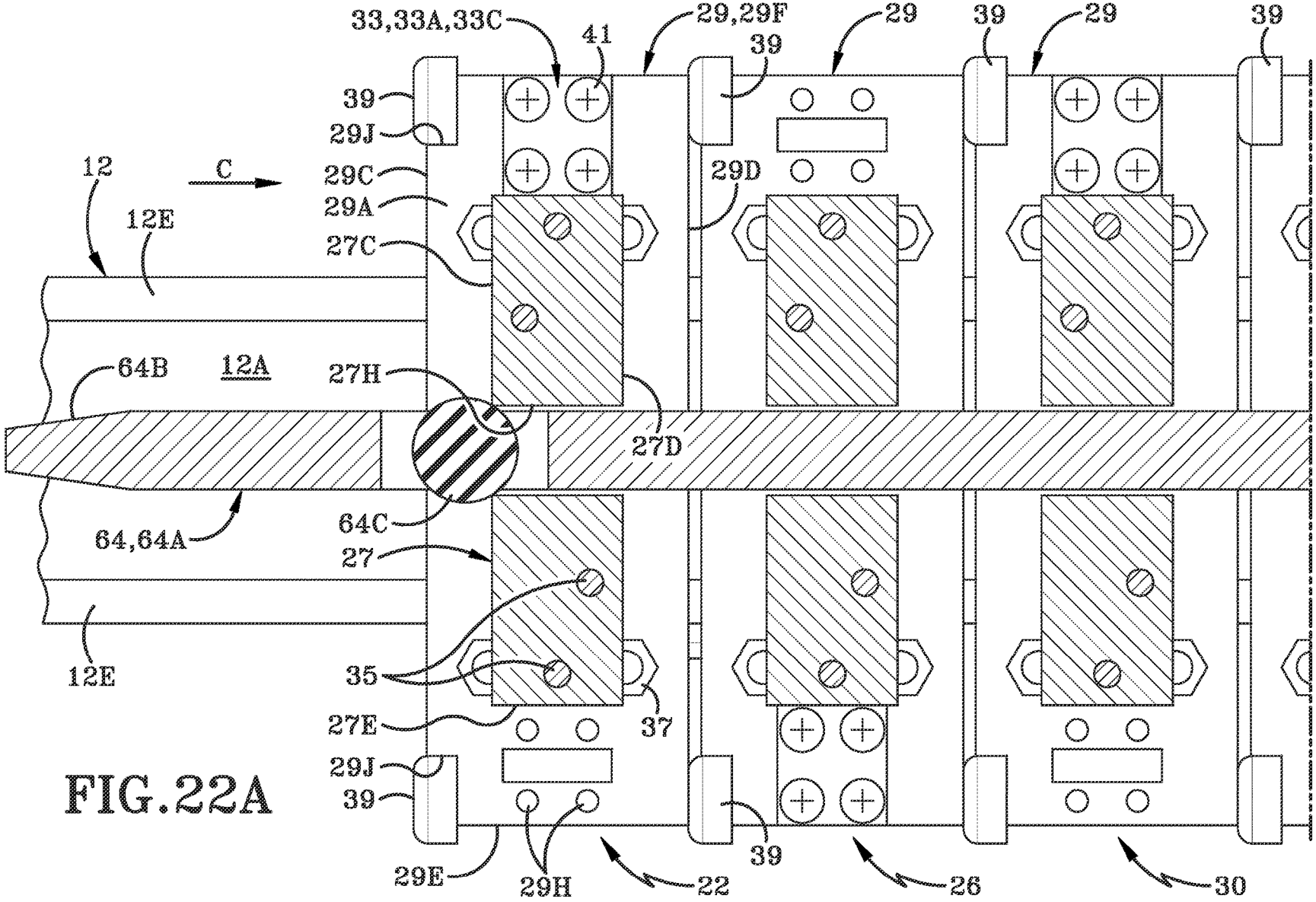
FIG. 22A is a partial cross-section of the stacked trollies taken along line 22A-22A of FIG. 21 showing a puck that is engaged with the stacker engaged with the first trolley and causing the stacked trollies to move backwards as the stacker is retracted.
Figure 22B:
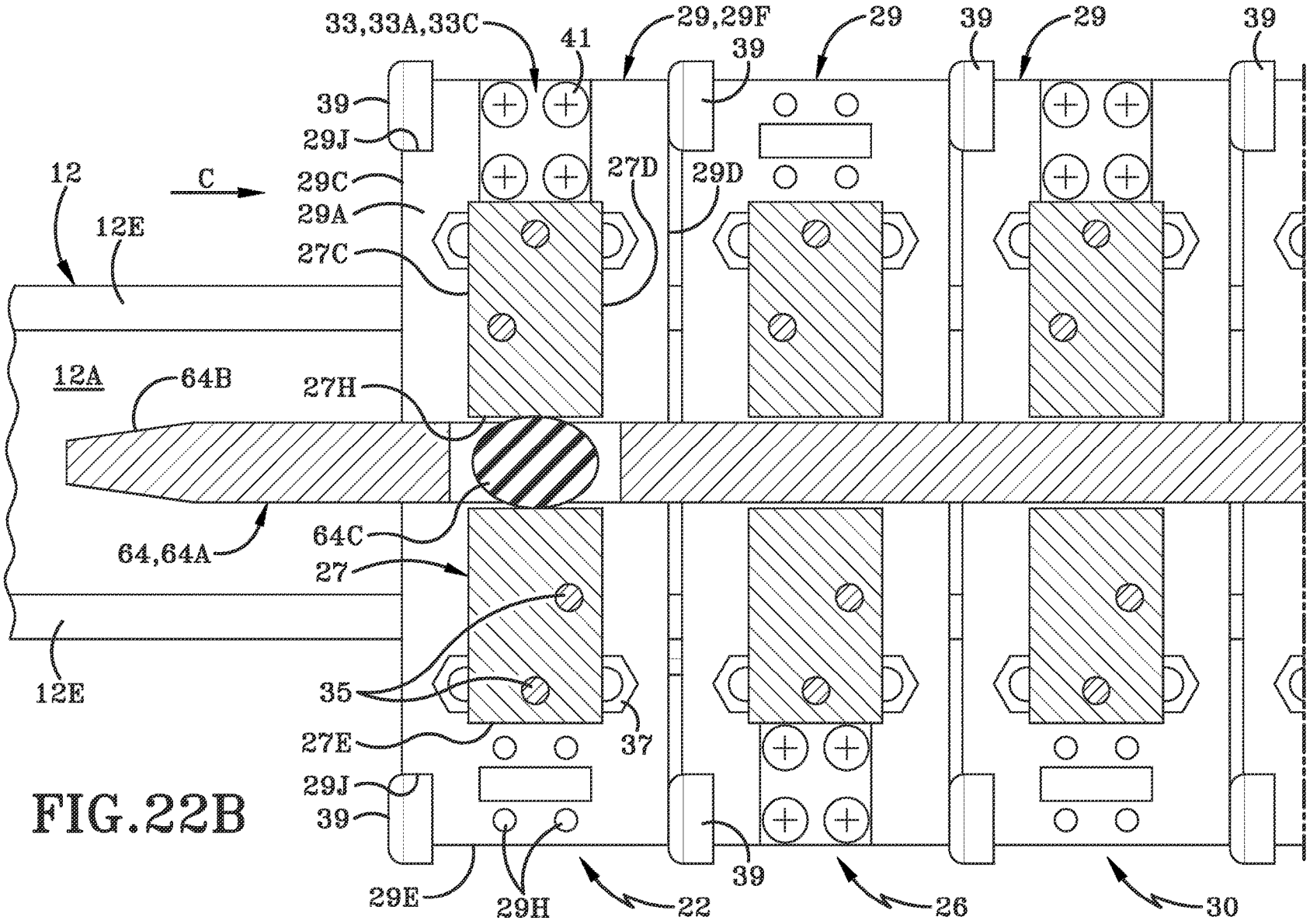
FIG. 22B is a partial cross-section of the stacked trollies similar to FIG. 22A but showing the puck being deformed as the puck moves through a channel opening defined in the first trolley.
Figure 22C:
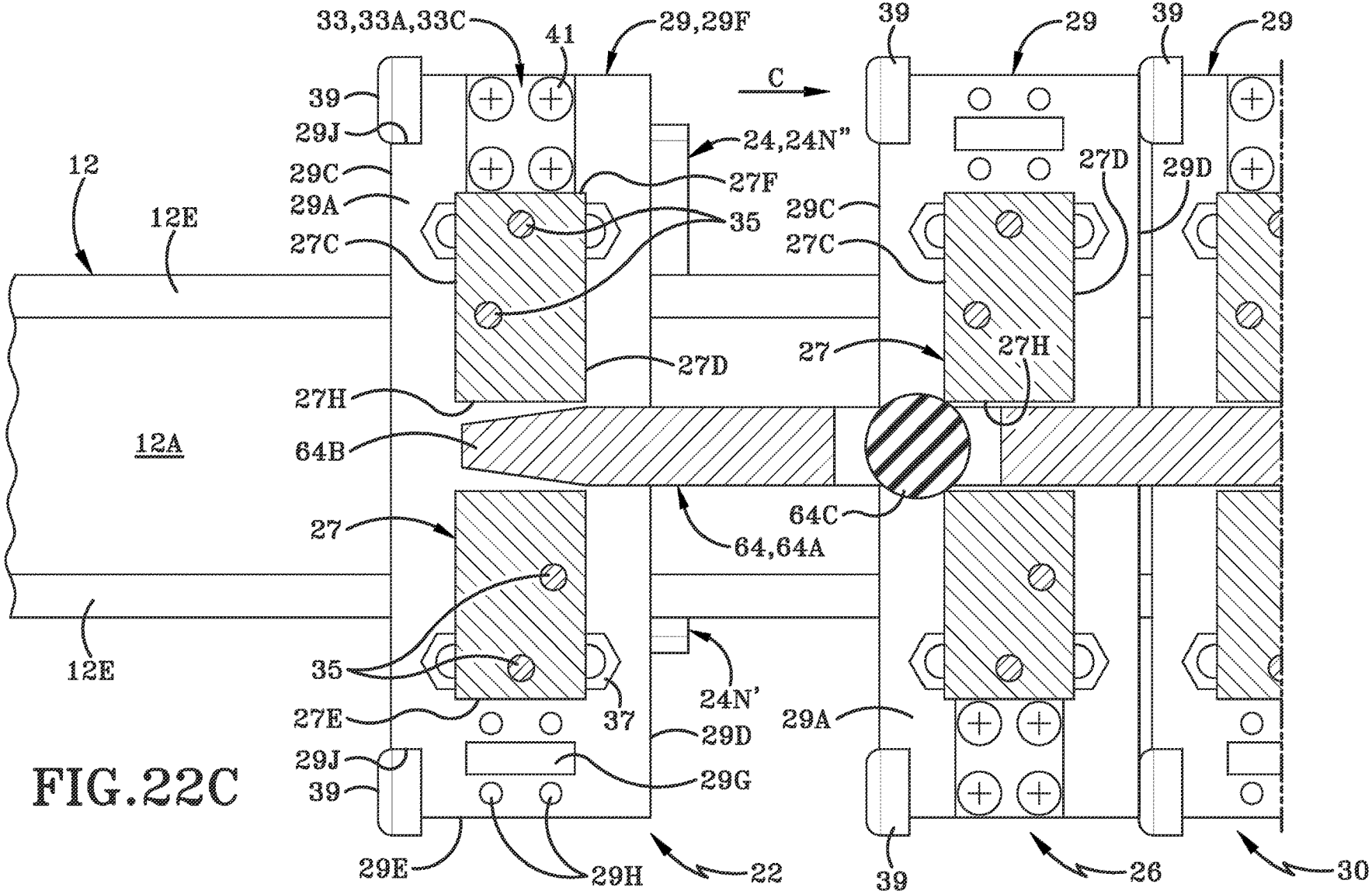
FIG. 22C is a partial cross-section of the stacked trollies similar to FIGS. 22A and 22B showing the first trolley disengaged from the trolley stack and the puck on the stacker engaging the second trolley in the trolley stack.
Figure 23:
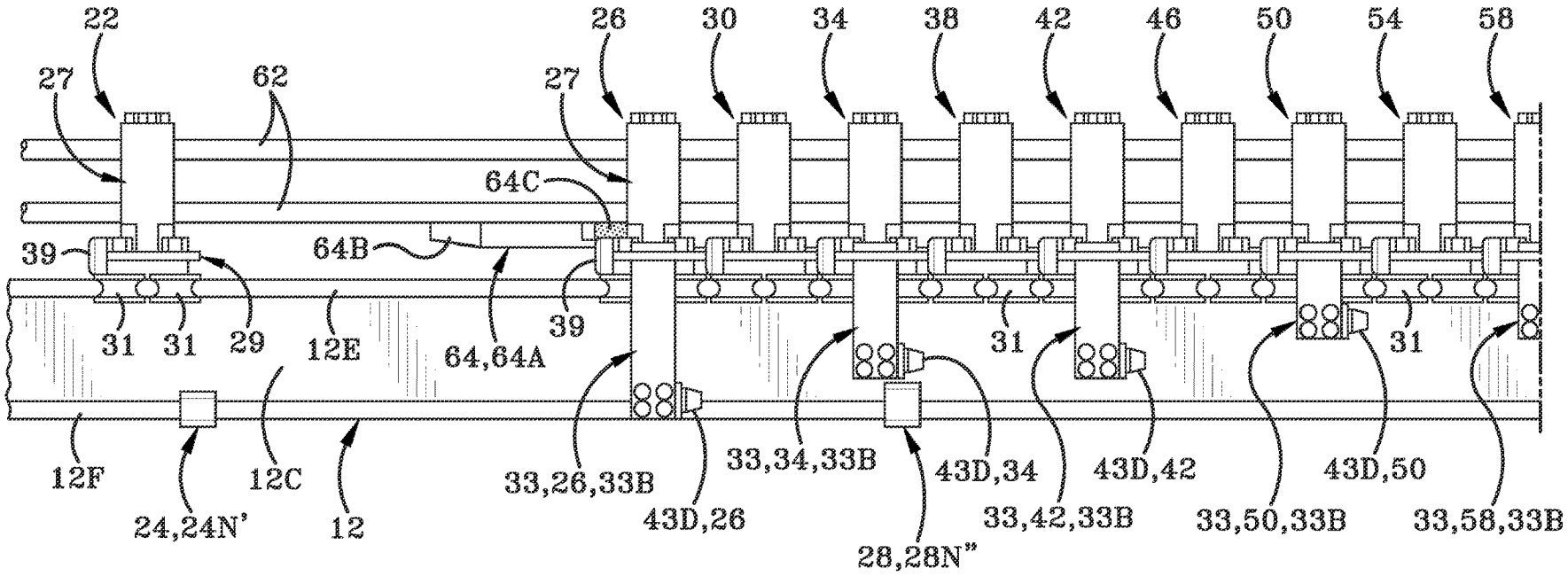
FIG. 23 is a left side elevation view of the lance cleaning system as illustrated in FIG. 22C and showing the first trolley disengaged from the trolley stack and the puck engaging the second trolley of the trolley stack while the stacker is being retracted.

As is shown in FIGS. 21-23, stacker 64 is provided with a deformable member (puck 64C) causes the trollies 22-58 to be moved rearwardly in response to the movement of platform 70 and thereby of stacker 64. Referring now to FIG. 21, the platform 70 (not shown) has begun retracing along the track 12H toward the rear end 10B of the system 10. (It will be understood that some of the lances 62 are only partially shown for clarity of illustration.) Stacker 64 has begun to move rearwardly in the direction of arrow "C" and away from lance guide 20. Puck 64C on stacker 64 is of a greater diameter than the width of channel 27H defined in first trolley 22 (FIG. 22A). Because of this, puck 64C initially cannot enter channel 27H but instead abuts regions of the front 27C of the trolley body 27 of first trolley 22. As stacker 64 continues to move rearwardly, the trollies 22-58 carried on stacker 64 are caused to move with the stacker because the puck 64C is pulling the first trolley 22 rearwardly with it.

The rear movement of the trollies 22-58 continues until first trolley 22 comes into contact with the first rail stop 24. The magnetic boss 43D on first trolley 22 will be received within the aligned opening 22M (FIG. 19E) and magnet 49 on first rail stop 24 and the rearward movement of first trolley 22 will be arrested. Because the drive gear 68C continues to move rearwardly and the platform 70 and therefore the stacker 64 continue to move rearward in the direction of arrow "C", eventually the force applied to the puck by the rearward motion of the stacker 64 will cause the puck 64C to deform and enter into the channel 27H of first trolley 22. The deformed puck 64C traveling through the channel 27H is shown in FIG. 22B. The continued rearward motion will eventually pull puck 64C out of channel 27H of first trolley 22 as shown in FIG. 22C. As rearward motion of translation mechanism 66 continues, the puck 64C will come into contact with regions of the front 27 of second trolley 26 and will begin to drag the second trolley 26 to tenth trolley 58 carried on the stacker 64 rearwardly with it. First trolley 22 remains in magnetic engagement with first rail stop 24 in the position shown in FIGS. 16 and 23.

Continued rearward movement of stacker 64 in response to the action of translation mechanism 66 will move the stack of trollies 26-58 toward the second rail stop 28 (FIG. 23). When second trolley 26 reaches the second rail stop 28, the magnetic boss 43D on locking member 43 on second trolley 26 will align with the opening 28M and magnet 49 on second rail stop 28 (FIG. 8E) and the second trolley 26 will become magnetically engaged with second rail stop 28. The rearward motion of second trolley 26 will therefore cease. Puck 64C will deform and travel through the channel 27H of second trolley 26, exit the channel and come into abutting contact with third trolley 30 and repeat the process described above. Each trolley 22-58 will therefore sequentially become re-engaged with the complementary rail stop and ultimately the system 10 will be in the configuration shown in FIG. 16. The indexer 14 will be actuated to shift nosepieces 16F to align with different openings 104D in end plate 104C of heat exchanger 104, and the process described herein will be repeated until all tubes in the heat exchanger have been cleaned by the high power water jets issuing from the nozzles of the lances 62.

It will be understood that the indexing process may be controlled electronically by a suitable control system such as THE LUNCHBOX® created by Terydon Incorporated of Navarre, Ohio, USA. This program allows an operator to position himself or herself a distance away from the end plate 104C of the heat exchanger and safely move the lances 62 into and out of the openings 104D in the end plate and clean the tube bores aligned therewith with high pressure fluid.

While the embodiment described herein describes ten trollies with ten staggered rail stop apertures, further embodiments may provide for as few as one and as many as two hundred trollies and apertures each. In this embodiment there is a lead trolley, or first trolley 22, a plurality of intermediate trollies 26, 30, 34, 38, 42, 46, 50, 54, and a rear trolley or tenth trolley 58. As such, additional configurations of rails and apertures may be provided, including where all are on one side with differing arm shapes, and staggered in any manner to allow the back trollies to pass the front trollies in a first direction and allowing the front trollies to lock back in place through the magnetic portions on the trollies and apertures on the rail stops. Any other type of latching or locking engagement may be utilized instead of the magnetic portions and apertures on the rail stops described herein.

Further, while the embodiment provides for five lances further embodiments may provide for as few as one and as many as fifty. Additional embodiments would operate in substantially the same way, would just require fewer or additional apertures within the trollies to adequately support the lances as well as additional swivels operative to rotate the lances.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A method of cleaning elongated tubes comprising: positioning a terminal end of at least one lance adjacent an opening to an elongated tube bore; rotating the at least one lance about an axis utilizing a rotation mechanism; supporting the at least one lance with one or more trolleys engaged on a support rail forwardly of the rotation mechanism; activating a translation mechanism; moving linearly, with the translation mechanism, the rotation mechanism and the at least one lance in a first direction along the support rail: advancing the at least one lance in the first direction toward the opening and into the elongated tube bore; moving the one or more trolleys along the support rail as the translation mechanism moves the at least one lance and the rotation mechanism in the first direction; stacking the one or more trolleys on a stacker when the one or more trolleys are moved in the first direction; operatively engaging the stacker with one of the translation mechanism and the rotation mechanism; defining a channel in each of the one or more trolleys; and selectively receiving the stacker through the channel of one of the one or more trolleys when the translation mechanism moves the rotation mechanism in the first direction.

2. The method of claim 1, further comprising:

connecting the at least one lance to a source of high pressure fluid.

3. The method of claim 2, further comprising:

spraying a volume of the high pressure fluid out of the terminal end of the at least one lance and into the elongated tube bore.

4. The method of claim 3, further comprising:

rotating the at least one lance with the rotation mechanism while spraying the volume of the high pressure fluid out of the terminal end of the at least one lance.

5. The method of claim 1, wherein moving of the one or more trolleys along the support rail in the first direction is preceded by:

disengaging a locking mechanism which secures at least one of the one or more trolleys to a rail stop that is engaged on the support rail.

6. The method of claim 1, wherein moving of the one or more trolleys in the first direction includes:

contacting at least one of the one or more trolleys with a pusher extending forwardly from the translation mechanism.

7. The method of claim 6, further comprising:

imparting motion to the at least one of the one or more trolleys with the pusher.

8. The method of claim 1, further comprising: providing a puck on the stacker; and selectively moving the puck from an un-deformed state to a deformed state to move through the channel of the one of the one or more trolleys.

9. The method of claim 1, further comprising:

moving the translation mechanism in a second direction along the support rail after completing of a cleaning operation with the at least one lance.

10. The method of claim 9, further comprising:

withdrawing the terminal end of each of the at least one lance from an associated elongated tube bore; and moving the rotation mechanism and the at least one lance in the second direction with the translation mechanism.

11. The method of claim 10, further comprising: withdrawing, progressively, the stacker from the one or more trolleys; contacting, with a puck provided on the stacker, a front surface of a forwardmost one of the one or more trolleys; and imparting motion in the second direction to the one more trolleys with the puck.

12. The method of claim 11, further comprising:

engaging, progressively, each of the one or more the trolleys with an associated one of a plurality of dedicated rail stops provided on the support rail.

13. The method of claim 12, further comprising:

arresting, progressively, motion of the one of the one or more trolleys in the second direction.

14. The method of claim 13, further comprising:

moving a locking mechanism from a disengaged position to an engaged position; and securing at least one of the one or more trolleys to one of the rail stops on the support rail with the locking mechanism.

15. The method of claim 1, further comprising:

supporting the support rail a distance above a ground surface on a support frame;

providing an indexer on the support frame, and engaging the at least one lance with the indexer.

16. The method of claim 15, further comprising:

selectively moving the indexer across the ground surface on a plurality of wheels or a plurality of casters.

17. The method of claim 1, wherein the at least one lance comprises a plurality of lances, and wherein the method further comprises:

rotating each lance of the plurality of lances with the rotation mechanism and about an axis extending along a length of the respective lance.

* * * * *